United States Patent [19]

Podolsky et al.

[11] 4,418,285

[45] Nov. 29, 1983

[54] SYSTEM AND METHOD FOR CONTROLLING A TURBINE POWER PLANT IN THE SINGLE AND SEQUENTIAL VALVE MODES WITH VALVE DYNAMIC FUNCTION GENERATION

[75] Inventors: Leaman B. Podolsky, Wilmington, Del.; Uri G. Ronnen, Monroeville; Francesco Lardi, O'Hara Township, Allegheny County, both of Pa.

[73] Assignee: Westinghouse Electric Corp., Pittsburgh, Pa.

[21] Appl. No.: 866,150

[22] Filed: Dec. 30, 1977

Related U.S. Application Data

[63] Continuation of Ser. No. 306,942, Nov. 15, 1972, abandoned.

[51] Int. Cl.[2] ..... F01B 25/00

[52] U.S. Cl. ..... 290/40 R; 415/17

[58] Field of Search ..... 290/40; 415/1, 14, 17; 364/103, 200, 505; 60/646

[56] References Cited

U.S. PATENT DOCUMENTS

| | | | |
|---|---|---|---|
| 3,400,374 | 9/1968 | Schumann | 364/200 |
| 3,552,872 | 1/1971 | Giras et al. | 415/17 |
| 3,555,251 | 1/1971 | Shauit | 364/505 |
| 3,561,216 | 2/1971 | Moore | 415/14 |
| 3,564,273 | 2/1971 | Cockrell | 290/40 |
| 3,588,265 | 6/1971 | Berry | 415/1 |
| 3,643,437 | 2/1972 | Birnbaum et al. | 290/40 X |

*Primary Examiner*—Gene Z . Rubinson
*Assistant Examiner*—W. E. Duncanson, Jr.
*Attorney, Agent, or Firm*—D. Schron

[57] ABSTRACT

A system and method for operating a turbine power plant, wherein a demand signal based upon load or total turbine steam flow required for a predetermined level of operation controls the value of individual signals representative of valve position for respective steam inlet valves in the single and sequential mode of operation, is disclosed. Each individual valve position signal, which is representative of a selected portion of the total demand signal, is dynamically calculated to reflect the effect of the pressure drop across the nozzles, and to correct for the number of inlet nozzles, associated with each valve. The total demand signal is modified in accordance with actual throttle pressure over a period of time that is dependent on the amount of throttle pressure change.

25 Claims, 45 Drawing Figures

TABLE 1-1. TASK PRIORITY ASSIGNMENT

| Level | Function | Frequency | Core Location |
|---|---|---|---|
| F | STOP/INITIALIZE | ON DEMAND | 2F40 |
| E | AUXILIARY SYNCHRONIZER | 0.1 SEC | 14BD |
| D | CONTROL | 1.0 SEC | 2730 |
| C | OPERATOR'S PANEL | ON DEMAND | 21B0 |
| B | ANALOG SCAN | 0.5 SEC | 16D0 |
| A | ATS-PERIODICS | 1.0 SEC | 4420 |
| 9 | LOGIC | ON DEMAND | 1962 |
| 8 | VISUAL DISPLAY | 1.0 SEC | 1E60 |
| 7 | DATA LINK | ON DEMAND | 3D10 |
| 6 | ATS-ANALOG CONVERSIONS | 5.0 SEC | 6960 |
| 5 | FLASH | 0.5 SEC | 15A0 |
| 4 | PROGRAMMER'S CONSOLE | ON DEMAND | 3000 |
| 3 | ATS-MESSAGE WRITER | 5.0 SEC | 6CA0 |
| 2 | ANALOG/DIGITAL TREND | 1.0 SEC | 3E70 |
| 1 | CCO TEST* | ON DEMAND | 0E80 |
| 0 | BATCH PROCESSORS** | ON DEMAND | 4000 |

*The CCO test task may be used only during maintenance and debugging periods, since this program overlays the data link program area.

**The batch processors may be used only on manual control and with the sync disabled; also, the sequence of events interrupt must be disabled since the batch processor programs overlay the ATS program area.

FIG. 9

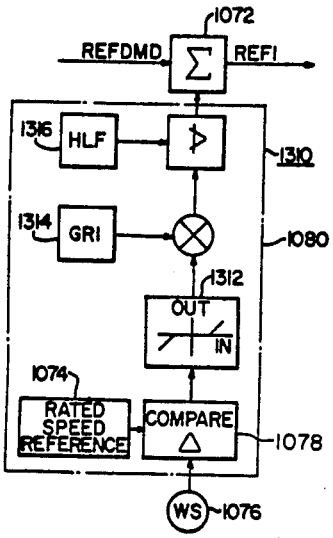

FIG. 10

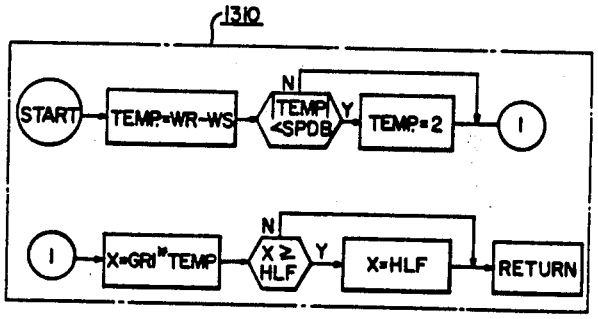

FIG. 11

NOTE
SHADED REGIONS REPRESENT AREA IN WHICH THE VALVE DOES NOT CONTROL

SYSTEM AND METHOD FOR CONTROLLING A TURBINE POWER PLANT IN THE SINGLE AND SEQUENTIAL VALVE MODES WITH VALVE DYNAMIC FUNCTION GENERATION

CROSS-REFERENCE TO RELATED APPLICATIONS

This is a continuation of application Ser. No. 306,942, filed Nov. 15, 1972, now abandoned.

1. Ser. No. 408,962 which is a continuation of Ser. No. 247,877, now abandoned, which is a continuation-in-part of Ser. No. 247,440, now abandoned, which is a continuation-in-part of Ser. No. 246,900, now abandoned, and all entitled "General System and Method For Starting, Synchronizing And Operating A Steam Turbine With Digital Computer Control", all filed by Theodore C. Giras and Robert Uram and assigned to the present assignee. Said original application being filed on Apr. 24, 1972.

2. Ser. No. 306,752, entitled "Improved System And Method of Controlling Steam Inlet Valves For a Turbine Power Plant", filed by Leaman Podolsky and Theodore C. Giras on Nov. 15, 1972 and assigned to the present assignee.

3. Ser. No. 306,789, entitled "System And Method For Transferring The Opertion of a Turbine Power Plant Between Single And Sequential Modes of Turbine Valve Operation", filed by Leaman Podolsky and Uri-George Ronnen on Nov. 15, 1972, and assigned to the present assignee.

4. Ser. No. 306,943, entitled "System And Method For Transferring Operation of a Turbine Power Plant Between Manual And Automatic Turbine Valve Operation", filed by Uri George Ronnen and Gerald E. Waldron on Nov. 15, 1972 and assigned to the present assignee.

5. Ser. No. 306,979, entitled "Improved System And Method For Operating a Turbine Powered Electrical Generating Plant in a Sequential Mode", filed by Uri George Ronnen on Nov. 15, 1972 and assigned to the present assignee.

BACKGROUND OF THE INVENTION

In an electrical generating plant powered by a steam turbine, the high pressure stage of the turbine is constructed to receive steam through a plurality of arcuately spaced nozzles adjacent the turbine first stage or impulse blading. The steam then flows from the impulse blading to an impulse chamber through the remaining rows of high pressure blades. The nozzles are segregated into individual groups about the circumference of the impulse blading; and an individual governor valve controls the steam flow through each nozzle group, the number of which may vary for respective valves. There are, typically eight governor valves in a fossil-fuel powered generating plant, and four governor valves in a nuclear powered generating plant. Steam is directed to the governor valves through one or more throttle or stop valves from the steam source.

When starting up the turbine, it is common practice to operate all the governor valves as a single valve to admit the steam in a full 360 degree arc through the nozzles to the inpulse blading. This practice, which is termed single valve, or full arc, operation permits the heating of all blading evenly which minimizes thermal shock. However, when the turbine is "hot" and all the valves are admitting the required steam, in a partially open position, the efficiency of the plant is considerably reduced because of the pressure drop or throttling action across all the partially open valves. In this situation, the efficiency of the turbine can be increased by admitting the steam through a portion of so-called partial arc of fully-open valves with the steam flow variations being controlled by one or more of the remaining valves in a sequential manner.

In the automatic control of governor valves, in either the single or sequential valve mode of operation, a load demand or in turn a flow demand signal may be used to control the position of the individual valves. When the valve of such representation bears a definite relationship to the position or change of position of the valves, such control may be termed feedforward. This is in contrast to a feedback control where the value of an error representation is related to the distance a valve is required to travel, for example, from its instant position in order to null or change the representation to a predetermined value. In any event, it is necessary to have an accurate relationship between steam flow and valve lift position for accurate turbine control.

For a valve operating in conjunction with a group of nozzles, the position/flow relationship remains linear as long as there is critical flow across the valve. However, the valve characteristic begins to change, as soon as the pressure drop across the nozzles, is reduced below critical, or in other words, when the valve is subjected to the effect of pressure drop across the nozzles or of impulse chamber pressure, the maximum flow through the valve when fully open is reduced. A change in inlet steam pressure also affects the steam flow; and a steam flow demand change that results from a substantial change in pressure, can produce increased oscillation between the boiler and turbine control system.

Heretofore, in proposed systems, as far as known, the characterization of lift position versus steam flow was fixed for a given load demand at a predetermined pressure. Thus, of course, at such flow and pressure, accuracy between flow and valve position could be presumed, but for different load or flow levels and at other pressures, such accuracy is not obtainable.

SUMMARY OF THE INVENTION

The present invention relates broadly to a control system for a turbine power plant wherein the valve lift position of each of a plurality of steam inlet valves is controlled to admit a selected portion of the total turbine steam flow in accordance with a single or sequential mode of valve operation.

A valve position signal is generated for each of the valves in accordance with a flow/position characterization for various inlet steam conditions. In one aspect a predetermined valve characterization is varied in accordance with the total steam flow or load demand to provide for the effects of pressure drop across the valve or nozzles.

In a more specific aspect, the flow demand and the representation of maximum flow for each valve is varied in accordance with a change in pressure, and such maximum flow is further modified in accordance with a variation in the number of nozzles associated with each valve.

FEED FORWARD

In the preferred embodiment of the present invention the infinitely variable dynamic function generation of flow demand versus actuator lift characteristics allows the use of a feedforward system without the need of feedback. In the present invention feedback signals of impulse stage pressure, turbine speed and kilowatt output are utilized solely as trim functions. Any slight deviations in the feedforward characteristics can thereby be adjusted to within very close tolerances. However, the valve management system can and does function without a signal representing first stage impulse pressure, turbine speed and megawatt output.

NOZZLE CORRECTION

The present invention includes the capability for correcting for the number of nozzles connected under each control valve. The number of nozzles emitting steam into the high pressure turbine may vary because of defects which inevitably do occur in the foundry casting into which the nozzles are machined. A variation in the number of nozzles may occur in order to be able to utilize the nozzle casting most efficiently.

VALVE MANAGEMENT

The valve management program dynamically calculates data which represents control valve demand or flow as a function of the valve lift of a control valve while compensating for the pressure variation and the corrected first stage flow of coefficient. The calculation of a dynamic flow demand versus lift characteristic is dependent upon the total flow of fluid through the turbine. The stage flow coefficient is constant regardless of the mode of operation of the turbine whether it be single valve or sequential valve. In addition, the valve demand versus lift characteristic data is modified dynamically for variations in the throttle pressure and also for the variation in the number of nozzles under each valve.

Transfers between the single valve mode, the sequential valve mode and manual mode are accomplished by dynamic calculation of the control valve curve for a desired total flow through the turbine. First, a total flow demand is computed by the DEH program. Second, a corrected stage flow coefficient is determined for the flow demand. Third, data is generated which can be represented in curve form as total flow demand versus control valve actuator lift utilizing the corrected stage flow coefficient. Fourth, the difference between the calculated total flow demand or target flow and the initial flow demand is calculated. Fifth, the number of variations or iterations required to implement the change of positions from the actual initial flow to the target flow is computed by dividing the greatest flow change by a maximum allowable flow change per sampling period. Sixth, the flow changes for each valve are then divided by the number of iterations required to perform the change from initial to target flow. During all mode transfers the same approach is used.

BRIEF DESCRIPTION OF THE DRAWINGS

FIG. 9 shows a typical table of program or task priority assignments of one embodiment of the digital Electro Hydraulic system;

FIG. 10 shows a block diagram of a proportional controller function with dead band for a system of the present invention;

FIG. 11 shows a flow chart of a speed loop (SPDLOOP) subroutine for a system of the present invention;

DESCRIPTION OF THE PREFERRED EMBODIMENT

A. POWER PLANT

Figure 1:
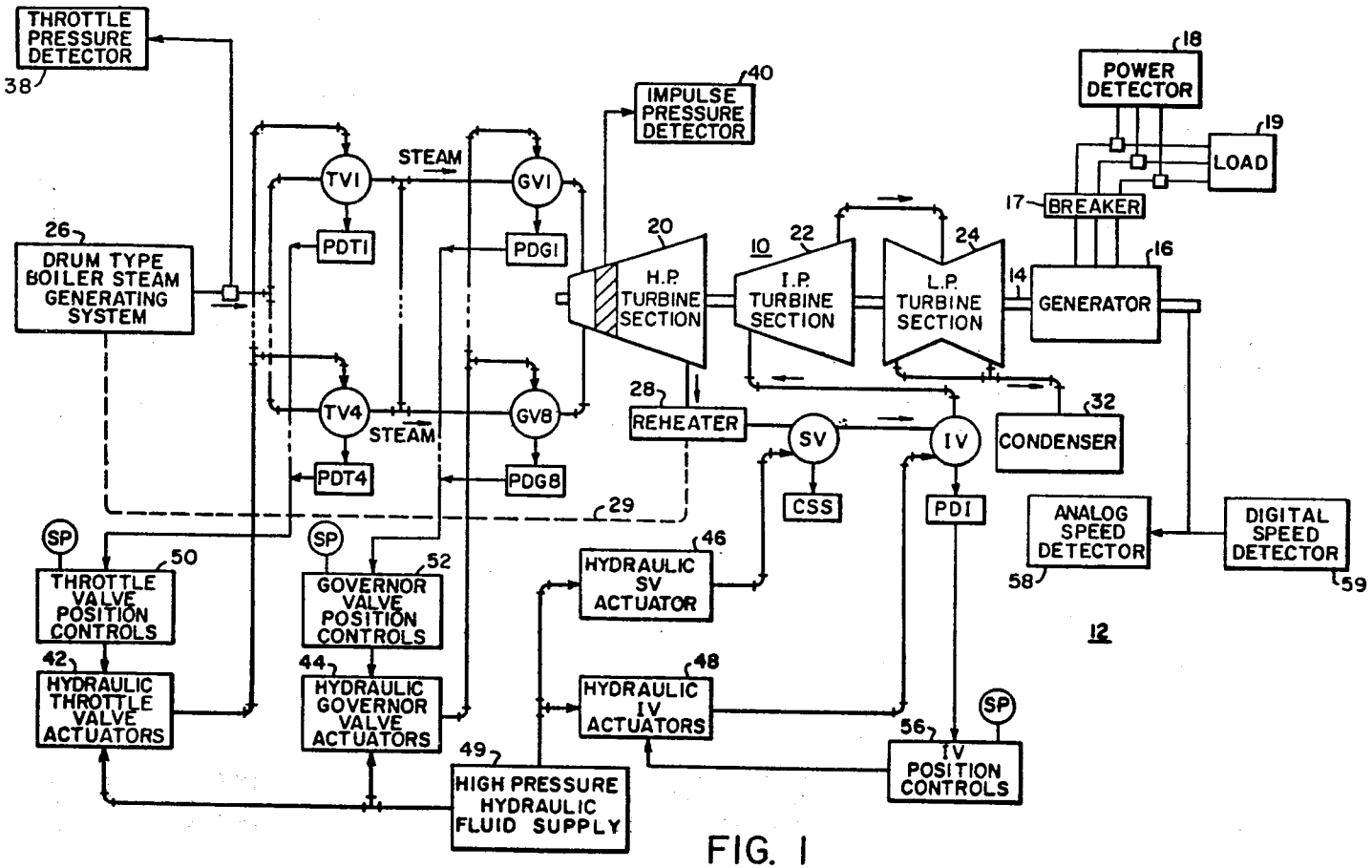
FIG. 1 shows a schematic diagram of an electric power plant including a large steam turbine and a fossil fuel fired drum type boiler and control devices in which the principles of the present invention are utilized.
Figure 2:
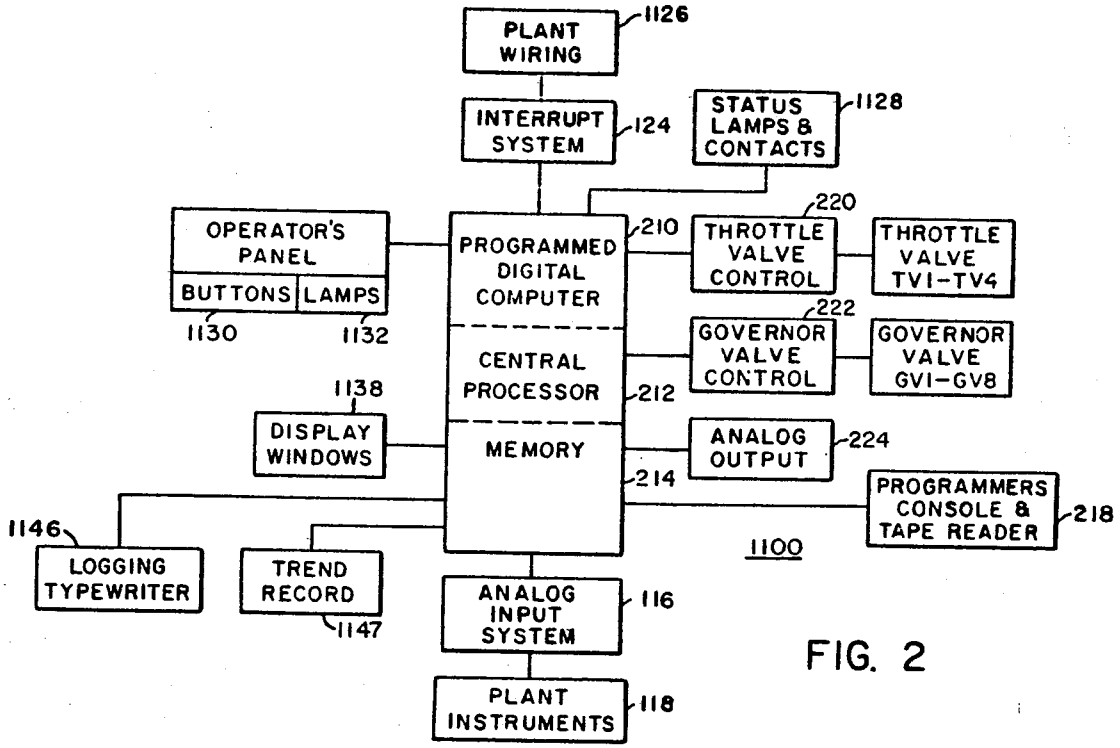
FIG. 2 shows a schematic diagram of a programmed digital computer control system operable with the steam turbine and its associated devices shown in FIG. 1.

More specifically, there is shown in FIG. 1 a large single reheat steam turbine constructed in a well known manner and operated and controlled in an electric power plant 12 in accordance with the principles of the invention. As will become more evident through this description, other types of steam turbines can also be controlled in accordance with the principles of the invention and particularly in accordance with the broader aspects of the invention. The generalized electric power plant shown in FIG. 1 and the more general aspects of the computer control system to be described in connection with FIG. 2 are like those disclosed in the Giras and Birnbaum patent application Ser. No. 319,115. As already indicated, the present application is directed to general improvements in turbine operation and control as well as more specific improvements related to digital computer operation and control of turbines.

The turbine 10 is provided with a single output shaft 14 which drives a conventional large alternating current generator 16 to produce three-phase electric power (or any other phase electric power) as measured by a conventional power detector 18 which measures the rate of flow of electric energy. Typically, the generator 16 is connected through one or more breakers 17 per phase to a large electric power network and when so connected causes the turbo-generator arrangement to operate at synchronous speed under steady state conditons. Under transient electric load change conditions, system frequency may be affected and conforming turbo-generator speed changes would result. At synchronism, power contribution of the generator 16 to the network is normally determined by the turbine steam flow which in this instance is supplied to the turbine 10 at substantially constant throttle pressure.

In this case, the turbine 10 is of the multistage axial flow type and includes a high pressure section 20, an intermediate pressure section 22, and a low pressure section 24. Each of these turbine sections may include a plurality of expansion stages provided by stationary vanes and an interacting bladed rotor connected to the shaft 14. In other applications, turbines operating in accordance with the present invention may have other forms with more or fewer sections tandemly connected to one shaft or compoundly coupled to more than one shaft.

The constant throttle pressure steam for driving the turbine 10 is developed by a steam generating system 26 which is provided in the form of a conventional drum type boiler operated by fossil fuel such as pulverized coal or natural gas. From a generalized standpoint, the present invention can also be applied to steam turbines associated with other types of steam generating systems such as nuclear reactor or once through boiler systems.

The turbine 10 in this instance is of the plural inlet front end type, and steam flow is accordingly directed to the turbine steam chest (not specifically indicated) through four throttle inlet valves TV1–TV4. Generally, the plural inlet type and other front end turbine types such as the single ended type or the end bar lift type may involve different numbers and/or arrangements of valves.

Steam is directed from the admission steam chest to the first high pressure section expansion stage through eight governor inlet valves GV1–GV8 which are arranged to supply steam to inlets arcuately spaced about the turbine high pressure casing to constitute a somewhat typical governor valving arrangement for large fossil fuel turbines. Nuclear turbines might on the other hand typically utilize only four governor valves.

During start-up, the governor valves GV1–GV8 are typically all fully opened and steam flow control is provided by a full arc throttle valve operation. At some point in the start-up process, transfer is made from full arc throttle valve control to full arc governor valve control because of throttling energy losses and/or throttling control capability. Upon transfer the throttle valves TV1–TV4 are fully opened, and the governor valves GV1–GV8 are normally operated in the single valve mode. Subsequently, the governor valves may be individually operated in a predetermined sequence usually directed to achieving thermal balance on the rotor and reduced rotor blade stressing while producing the desired turbine speed and/or load operating level. For example, in a typical governor valve control mode, governor valves GV5–GV8 may be initially closed as the governor valves GV1–GV4 are jointly operated from time to time to define positions producing the desired corresponding total steam flows. After the governor valves GV1–GV4 have reached the end of their control region, i.e., upon being fully opened, or at some overlap point prior to reaching their fully opened position, the remaining governor valves GV5–GV8 are sequentially placed in operation in numerical order to produce continued steam flow control at higher steam flow levels. This governor valve sequence of operation is based on the assumption that the governor valve controlled inlets are arcuately spaced about the 360° periphery of the turbine high pressure casing and that they are numbered consecutively around the periphery so that the inlets corresponding to the governor valves GV1 and GV8 are arcuately adjacent to each other.

The preferred turbine start-up method is to raise the turbine speed from the turning gear speed of about 2 rpm to about 80% of the synchronous speed under throttle valve control and then transfer to governor valve control and raise the turbine speed to the synchronous speed, then close the power system breakers and meet the load demand. On shutdown, similar but reverse practices or simple coastdown may be employed. Other transfer practice may be employed, but it is unlikely that transfer would be made at a loading point above 40% rated load because of throttling efficiency considerations.

After the steam has crossed past the first stage impulse blading to the first stage reaction blading of the high pressure section, it is directed to a reheater system 28 which is associated with a boiler or steam generating system 26. In practice, the reheater system 28 may typically include a pair of parallel connected reheaters coupled to the boiler 26 in heat transfer relation as indicated by the reference character 29 and associated with opposite sides of the turbine casing.

With a raised enthalpy level, the reheated steam flows from the reheater system 28 through the intermediate pressure turbine section 22 and the low pressure turbine section 24. From the latter, the vitiated steam is exhausted to a condenser 32 from which water flow is directed (not indicated) back to the boiler 26.

To control the flow of reheat steam, a stop valve SV including one or more check valves is normally open and closed only when the turbine is tripped. Interceptor valves IV (only one indicated), are also provided in the reheat steam flow path, and they are normally open and if desired they may be operated over a range of position control to provide reheat steam flow cutback modulation under turbine overspeed conditions. Further description of an appropriate overspeed protection system is presented in U.S. Pat. No. 3,643,437 issued to M. Birnbaum, A. Braytenbah and A. Richardson and assigned to the present assignee.

In the typical fossil fuel drum type boiler steam generating system, the boiler control system controls boiler operations so that steam throttle pressure is held substantially constant. In the present description, it is therefore assumed as previously indicated that throttle pressure is an externally controlled variable upon which the turbine operation can be based. A throttle pressure detector 38 of suitable conventional design measures the throttle pressure to provide assurance of substantially constant throttle pressure supply, and, if desired as a programmed computer protective system override control function, turbine control action can be directed to throttle pressure control as well as or in place of speed and/or load control if the throttle pressure falls outside predetermined constraining safety and turbine condensation protection limits.

In general, the steady state power or load developed by a steam turbine supplied with substantially constant throttle pressure steam is determined as follows:

$$\text{power or load} = K_P(P_i/P_O) = K_F S_F \qquad \text{Equation (1)}$$

where $P_i$=first stage impulse pressure $P_O$=throttle pressure $K_P$=constant of proportionality $S_F$=steam flow $K_F$=constant of proportionality Where the throttle pressure is held substantially constant by external control as in the present case, the turbine load in thus proportional to the first stage impulse pressure $P_i$. The ratio $P_i/P_O$ may be used for control purposes, for example to obtain better anticipatory control of $P_i$ (i.e. turbine load) as the boiler control throttle pressure $P_O$ undergoes some variation within protective constraint limit values. However, it is preferred in the present case that the impulse pressure $P_i$ be used for feedback signalling in load control operation as subsequently more fully described, and a conventional pressure detector 40 is employed to determine the pressure $P_i$ for the assigned control usage.

Within its broad field of applicability, the invention can also be applied in nuclear reactor and other applications involving steam generating systems which produce steam without placement of relatively close steam generator control on the constancy of the turbine throttle pressure. In such cases, throttle control and operating philosophies are embodied in a form preferred for and tailored to the type of plant and turbine involved. In cases of unregulated throttle pressure supply, turbine operation may be directed with top priority to throttle pressure control or constraint and with lower priority to turbine load and/or speed control.

Respective hydraulically operated throttle valve actuators indicated by the reference character 42 are provided for the four throttle valves TV1–TV4. Similarly, respective hydraulically operated governor valve actuators indicated by the reference character 44 are provided for the eight governor valves GV1–GV8. Hydraulically operated actuators indicated by the reference characters 46 and 48 are provided for the reheat stop and interceptor valves SV and IV. A computer monitored high pressure fluid supply 49 provides the controlling fluid for actuator operation of the valves TV1–TV4, GV1–GV8, SV and IV. A computer supervised lubricating oil system (not shown) is separately provided for turbine plant lubricating requirements.

The respective actuators 42, 44, 46 and 48 are of conventional construction, and the inlet valve actuators 42 and 44 are operated by respective stabilizing position controls indicated by the reference characters 50 and 52. If desired, the interceptor valve actuators 48 can also be operated by a position control 56 although such control is not employed in the present detailed embodiment of the invention. Each position control includes a conventional analog controller (not shown in FIG. 1) which drives a suitable known actuator servo valve (not indicated) in the well known manner. The reheat stop valve actuators 46 are fully open unless the conventional trip system or other operating means causes them to close and stops the reheat steam flow.

Since the turbine power is proportional to steam flow under the assumed control condition of substantially constant throttle pressure, steam valve positions are controlled to produce control over steam flow as an intermediate variable and over turbine speed and/or load as an end control variable or variables. Actuator operation provides the steam valve positioning, and respective valve position detectors PDT1-PDT4, PDG1-PDG8 and PDI are provided to generate respective valve position feedback signals for developing position error signals to be applied to the respective position controls 50, 52 and 56. One or more contact sensors CSS provides status data for the stop valving SV. The position detectors are provided in suitable conventional form, for example, they may make conventional use of linear variable differential transformer operation in generating negative position feedback signals for algebraic summing with respect to position setpoint signals SP in developing the respective input error signals. Position controlled operation of the interceptor valving IV would typically be provided only under a reheat steam flow cutback requirement.

The combined position control, hydraulic actuator, valve position detector element and other miscellaneous devices (not shown) from a local hydraulic electric analog valve position control for each throttle or governor inlet steam valve. The position setpoints SP are computer determined and supplied to the respective local loops and updated on a periodic basis. Setpoints SP may also be computed for the interceptor valve controls when the latter are employed. A more complete general background description of electrohydraulic steam valve positioning and hydraulic fluid supply systems for valve actuation is presented in the a Birnbaum and Noyes paper enentitled, ELECTRO-HYDRAULIC CONTROL FOR IMPROVED AVAILABILITY AND OPERATION OF LARGE STEAM TURBINES presented at the Sept. 19-23, 1965 ASME-IEEE National Power Conference In the present case, the described hybrid arrangement including local loop analog electrohydraulic position control is preferred primarily because of the combined effects of control computer operating speed capabilities and computer hardware economics, i.e., the cost of manual backup analog controls is less than that for backup computer capacity at present control computer operating speeds for particular applications so far developed. Further consideration of the hybrid aspects of the turbine control system is presented subsequently herein. However, economic and fast operating backup control computer capability is expected and direct digital computer control of the hydraulic valve actuators will then likely be preferred over the digital control of local analog controls described herein.

A speed detector 58 is provided for determining the turbine shaft speed for speed control and for frequency participation control purposes. The speed detector 58 can for example be in the form of a reluctant pickup (not shown) magnetically coupled to a notched wheel (not shown) on the turbo-generator shaft 14. In the detailed embodiment subsequently described herein, a plurality of sensors are employed for speed detection. Analog and/or pulse signals produced by the speed detector 58, the electric power detector 18, the pressure detectors 38 and 40, the valve position detectors PDT1-PDT4, PDG1-PDG8 and PDI, the status contact or contacts CSS, and other sensors (not shown) and status contacts (not shown) are employed in programmed computer operation of the turbine 10 for various purposes including controlling turbine performance on an on-line real time basis and further including monitoring, sequencing, supervising, alarming, displaying and logging.

B. DEH-COMPUTER CONTROL SYSTEM

As generally illustrated in FIG. 2, a Digital Electro-Hydraulic control system (DEH) 1100 includes a programmed digital computer 210 to operate the turbine 10 and the plant 12 with improved performance and operating characteristics. The computer 210 can include conventional hardware including a central processor 212 and a memory 214. The digital computer 210 and its associated input/output interfacing equipment is a suitable digital computer system such as that sold by Westinghouse Electric Corporation under the trade name of P2000. In cases when the steam generating system 26 as well as the turbine 10 are placed under computer control, use can be made of one or more P2000 computers or alternatively a larger computer system such as that sold by Xerox Data Systems and known as the Sigma 5. Separate computers, such as P2000 computers, can be employed for the respective steam generation and turbine control functions in the controlled plant unit and interaction is achieved by interconnecting the separate computers together through data links or other means.

The digital computer used in the DEH control system 1100 is a P2000 computer which is designed for real time process control applications. The P2000 typically uses a 16 bit word length with 2's complement, a single address and fixed word length operated in a parallel mode. All the basic DEH system functions are performed with a 16,000 word (16 K), 3 microsecond magnetic core memory. The integral magnetic core memory can be expanded to 65,000 words (65 K).

The equipment interfacing with the computer 210 includes a contact interrupt system 124 which scans contacts representing the status of various plant and equipment conditions in plant wiring 1126. The status contacts might typically be contacts of mercury wetted relays (not shown) which operate by energization circuits (not shown) capable of sensing the predetermined conditions associated with the various system devices. Data from status contacts is used in interlock logic functioning and control for other programs, protection analog system functioning, programmed monitoring and logging and demand logging, etc.

Operator's panel buttons 1130 transmit digital information to the computer 210. The operator's panel buttons 1130 can set a load reference, a pulse pressure, megawatt output, speed, etc.

In addition, interfacing with plant instrumentation 1118 is provided by an analog input system 1116. The analog input system 1116 samples analog signals at a predetermined rate from predetermined input channels and converts the signals sampled to digital values for entry into the computer 210. The analog signals sensed in the plant instrumentation 1118 represent parameters including the impulse chamber pressure, the megawatt power, the valve positions of the throttle valves TV1 through TV4 and the governor valves GV1 through GV8 and the interceptor valve IV, throttle pressure, steam flow, various steam temperatures, miscellaneous equipment operating temperature, generator hydrogen cooling pressure and temperature, etc. Such parameters include process parameters which are sensed or controlled in the process (turbine or plant) and other variables which are defined for use in the programmed computer operation. Interfacing from external systems such as an automatic dispatch system is controlled through the operator's panel buttons 1130.

A conventional programmer's console and tape reader 218 is provided for various purposes including program entry into the central processor 212 and the memory 214 thereof. A logging typewriter 1146 is provided for logging printouts of various monitored parameters as well as alarms generated by an automatic turbine startup system (ATS) which includes program system blocks 1140, 1142, 1144 (FIG. 8) in the DEH control system 1100. A trend recorder 1147 continuously records predetermined parameters of the system. An interrupt system 124 is provided for controlling the input and output transfer of information between the digital computer 210 and the input/output equipment. The digital computer 210 acts on interrupt from the interrupt system 124 in accordance with an executive program. Interrupt signals from the interrupt system 124 stop the digital computer 210 by interrupting a program in operation. The interrupt signals are serviced immediately.

Output interfacing is provided by contacts 1128 for the computer 210. The contacts 1128 operate status display lamps, and they operate in conjunction with a conventional analog/output system and a valve position control output system comprising a throttle valve control system 220 and a governor valve control system 222. A manual control system is coupled to the valve position control output system 220 and is operable therewith to provide manual turbine control during computer shut-down. The throttle and governor valve control systems 220 and 222 correspond to the valve position controls 50 and 52 and the actuators 42 and 44 in FIG. 1. Generally, the manual control system is similar to those disclosed in prior U.S. Pat. No. 3,552,872 by T. Giras et al. and U.S. Pat. No. 3,741,246 by A. Braytenbah, both assigned to the present assignee.

Digital output data from the computer 210 is first converted to analog signals in the analog output system 224 and then transmitted to the valve control system 220 and 222. Analog signals are also applied to auxiliary devices and systems, not shown, and interceptor valve systems, not shown.

C. SUBSYSTEMS EXTERNAL TO THE DEH COMPUTER

Figure 3:
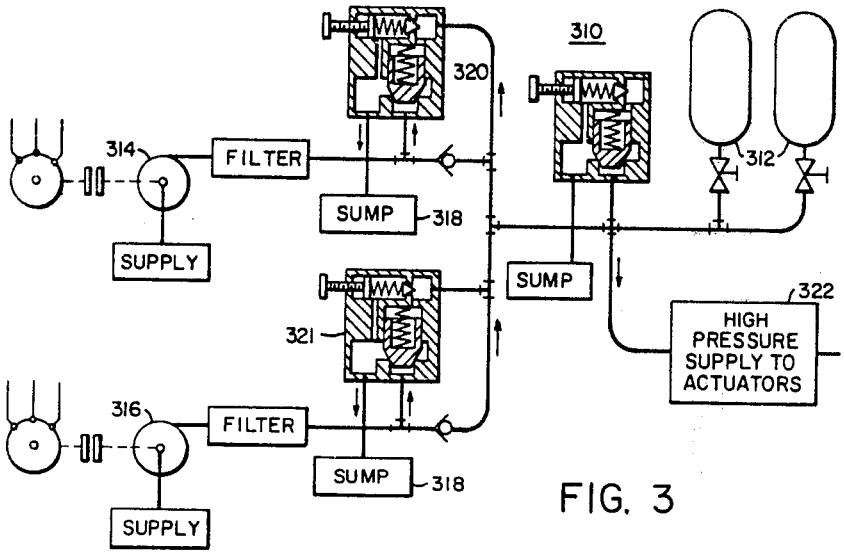
FIG. 3 shows a hydraulic system for supplying hydraulic fluid to valve actuators of the steam turbine.

At this point in the description, further consideration of certain subsystems external to the DEH computer will aid in reaching an understanding of the invention. Making reference now to FIG. 3, a high pressure HP fluid supply system 310 for use in controlled actuation of the governor valves GV1 through GV8, the throttle valves TV1 through TV4 and associated valves is shown. The high pressure fluid supply system 310 corresponds to the supply system 49 in FIG. 1 and it uses a synthetic, fire retardant phosphate ester-based fluid and operates in the range of 1500 and 1800 psi. Nitrogen charged piston type accumulators 312 maintain a flow of fluid to the actuators for the governor valves GV1–GV8, the throttle valves TV1–TV4, etc. when pumps 314 and 316 are discharging to a reservoir 318 through unloader valves 320 and 321. In addition, the accumulators 312 provide additional transient flow capacity for rapid valve movements.

Figure 4:
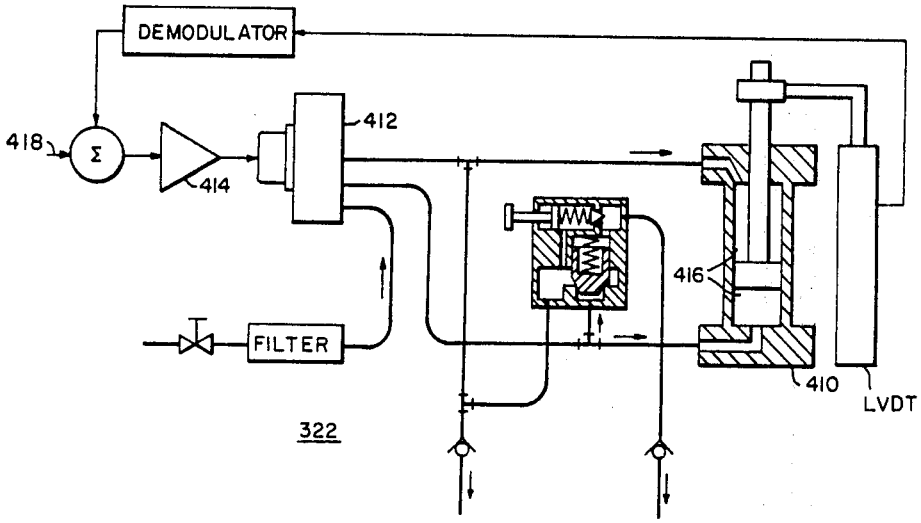
FIG. 4 shows a schematic diagram of a servo system connected to the valve actuators.

Referring now to FIG. 4, a typical electrohydraulic valve actuation system 322 is shown in greater detail for positioning a modulating type valve actuator 410 against the closing force of a large coil spring. A servo-valve 412 which is driven by a servo-amplifier 414 controls the flow of fluid therethrough. The servo-valve 412 controls the flow of fluid entering or leaving the valve actuator cylinder 416 relative to the HP fluid supply system 310. A linear voltage differential transformer LVTD generates a valve position indicating transducer voltage which is summed with a valve position demand voltage at connection 418. The summation of the two previously mentioned voltages produces a valve position error input signal to the servo-amplifier 414. The linear voltage differential transformer LVTD has a linear voltage characteristic with respect to displacement thereof in the preferred embodiment. Therefore, the position of the valve actuator 410 is made proportional to the valve position demand voltage at connection 418.

Figure 5:
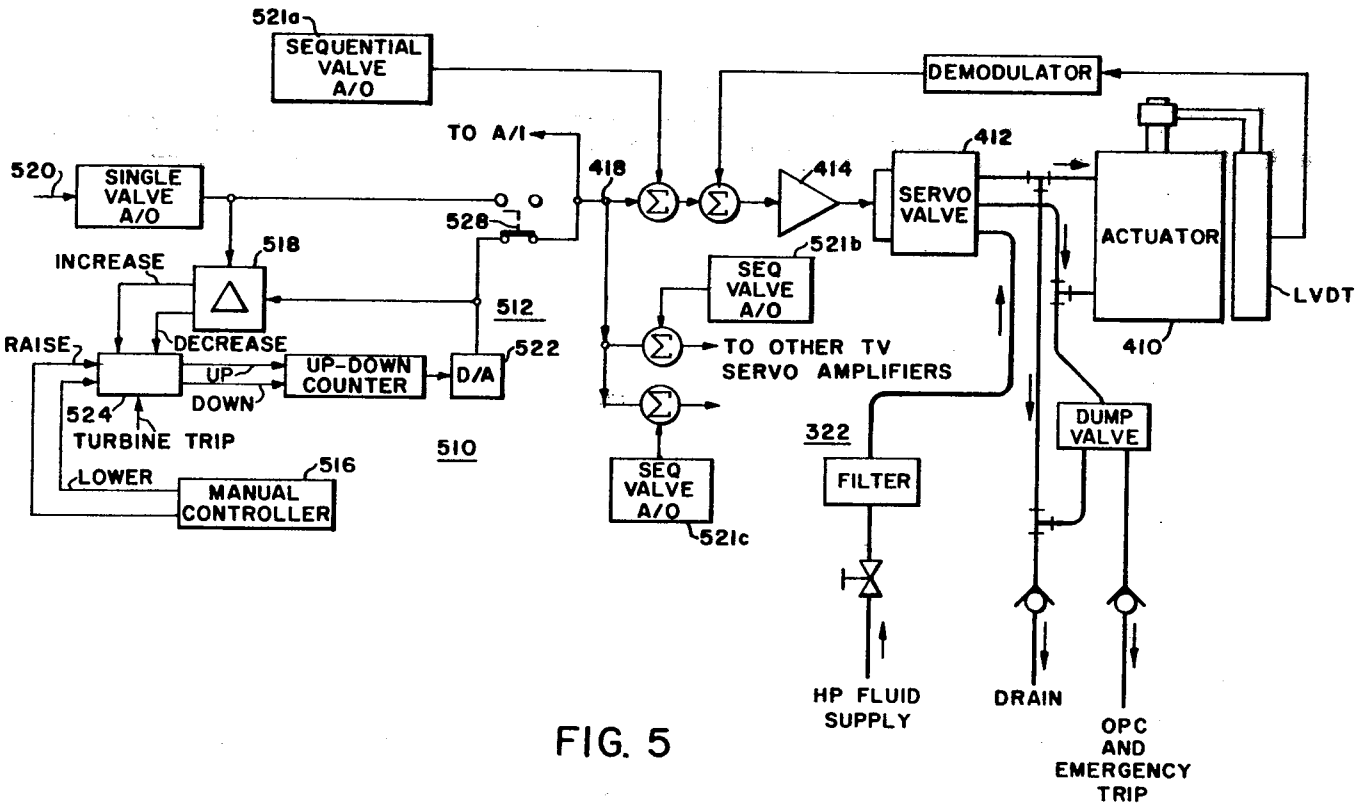
FIG. 5 shows a schematic diagram of a hybrid interface between a manual backup system and the digital computer connected with the servo system controlling the valve actuators.

Making reference now to FIG. 5, a hardwired digital-/analog system forms a part of the DEH control system 1100 (FIG. 2). Structurally, it embraces elements which are included in the blocks 50, 52, 42 and 44. of FIG. 1 as well as additional elements. A hybrid interface 510 is included as a part of the hardwired system 512. The hybrid interface 510 is connected to actuator system servo-amplifiers 414 for the various steam valves which in turn are connected to a manual controller 516, an overspeed protection controller, not shown, and redundant DC power supplies, not shown.

A controller shown in FIG. 5 is employed for throttle valve TV1–TV4 control in the TV control system 50 of FIG. 1. The governor valves GV1–GV8 are controlled in an analogous fashion by the GV control system 52.

While the steam turbine is controlled by the digital computer 210, the hardwired system 512 tracks single valve analog outputs 520 from the digital computer 210. A comparator 518 compares a signal from a digital-to-analog converter 522 of the manual system with the signal 520 from the digital computer 210. A signal from the comparator 518 controls a logic system 524 such that the logic system 524 runs an updown counter 526 to the point where the output of the converter 522 is equal to the output signal 520 from the digital computer 210. Should the hardwired system 512 fail to track the signal 520 from the digital computer 210 a monitor light will flash on the operator's panel. A sequential valve A/O 521*a, b, c,* etc., controls the governor valve GV1–GV8 servo amplifiers in partial arc admission mode.

When the DEH control system reverts to the control of the backup manual controller 516 as a result of an operator selection or due to a contigency condition, such as loss of power on the automatic digital computer 210, or a stoppage of a function in the digital computer 210, or a loss of a speed channel in the wide range speed control all as described in greater detail infra, the input of the valve actuation system 322 (FIG. 4) is switched by switches 528 from the automatic controllers in the blocks 50, 52 (FIG. 1) or 220, 222 (FIG. 2) to the control of the manual controller 516. Bumpless transfer is thereby accomplished between the digital computer 210 and the manual controller 516.

Similarly, tracking is provided in the computer 210 for switching bumplessly from manual to automatic turbine control. As previously indicated, the presently disclosed hybrid structural arrangement of software and hardware elements is the preferred arrangement for the provision of improved turbine and plant operation and control with backup capability. However, other hybrid arrangements can be implemented within the field of application of the invention.

D. DEH PROGRAM SYSTEM

DEH Program System Organization, DEH Control Loops And Control Task Program

Figures 6, 7:
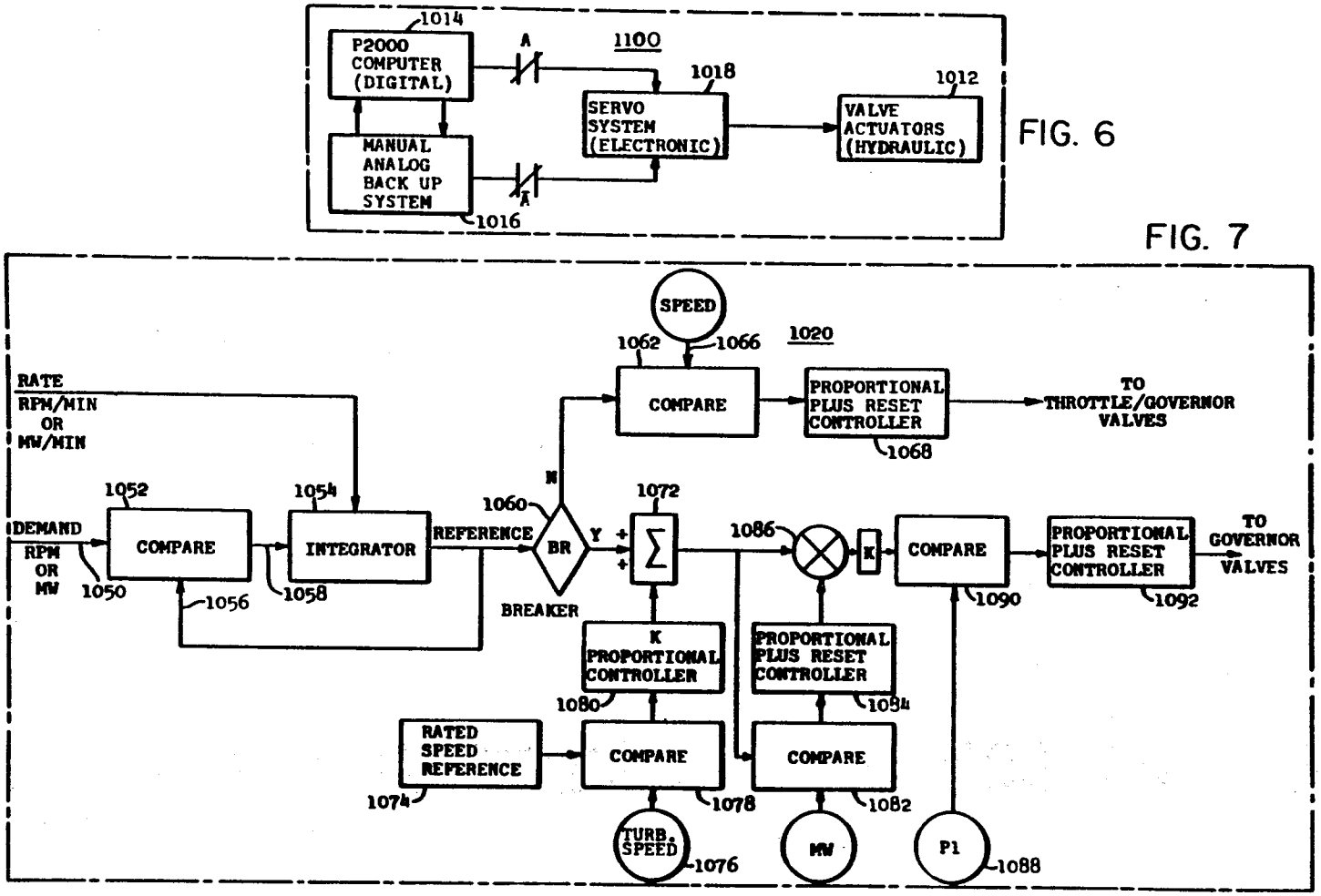
FIG. 6 shows a simplified block diagram of the digital Electro Hydraulic Control System in which the present invention can be utilized.
FIG. 7 shows a block diagram of a control program used with the present invention.

With reference now to FIG. 6, an overall generalized control system of this invention is shown in block diagram form. The digital electrohydraulic (DEH) control system 1100 operates valve actuators 1012 for the turbine 10. The digital electrohydraulic control system 1100 comprises a digital computer 1014, corresponding to the digital computer 210 in FIG. 2, and it is interconnected with a hardwired analog backup control system 1016. The digital computer 1014 and the backup control system 1016 are connected to an electronic servo system 1018 corresponding to blocks 220 and 222, in FIG. 2. The digital computer control system 1014 and the analog backup system 1016 track each other during turbine operations in the event it becomes necessary or desirable to make a bumpless transfer of control from a digital computer controlled automatic mode of operation to a manual analog backup mode or from the manual mode to the digital automatic mode.

In order to provide plant and turbine monitor and control functions and to provide operator interface functions, the DEH computer 1014 is programmed with a system of task and task support programs. The program system is organized efficiently and economically to achieve the end operating functions. Control functions are achieved by control loops which structurally include both hardware and software elements, with the software elements being included in the computer program system. Elements of the program system are considered herein to a level of detail sufficient to reach an understanding of the invention.

As previously discussed, a primary function of the digital electrohydraulic (DEH) system 1100 is to automatically position the turbine throttle valves TV1 through TV4 and the governor valves GV1 through GV8 at all times to maintain turbine speed and/or load. A special periodically executed program designated the CONTROL task is utilized by the P2000 computer along with other programs to be described in greater detail subsequently herein.

With reference now to FIG. 7, a functional control loop diagram in its preferred form includes the CONTROL task or program 1020 which is executed in the computer 1014. Inputs representing demand and rate provide the desired turbine operating setpoints. The demand is typically either the target speed in specified revolutions per minute of the turbine systems during startup or shutdown operations or the target load in megawatts of electrical output to be produced by the generating system 16 during load operations. The demand enters the block diagram configuration of FIG. 7 at the input 1050 of a compare block 1052.

The rate input either in specified RPM per minute or specified megawatts per minute, depending upon which input is to be used in the demand function, is applied to an intergrator block 1054. The rate inputs in RPM and megawatts of loading per minute are established to limit the buildup of stresses in the rotor of the turbine-generator 10. An error output of the compare block 1052 is applied to the integrator block 1054. In generating the error output the demand value is compared with a reference corresponding to the present turbine operating setpoint in the compare block 1052. The reference value is representative of the setpoint RPM applied to the turbine system or the setpoint generator megawatts output, depending upon whether the turbine generating system is in the speed mode of operation or the load mode of operation. The error output is applied to the integrator 1054 so that a negative error drives the integrator 1054 in one sense and a positive error drives it in the opposite sense. The polarity error normally drives the integrator 1054 until the reference and the demand are equal or if desired until they bear some other predetermined relationship with each other. The rate input to the integrator 1054 varies the rate of integration, i.e., the rate at which the reference or the turbine operating setpoint moves toward the entered demand.

Demand and rate input signals can be entered by a human operator from a keyboard. Inputs for rate and demand can also be generated or selected by automatic synchronizing equipment, by automatic dispatching system equipment external to the computer, by another computer automatic turbine startup program or by a boiler control system. The inputs for demand and rate in automatic synchronizing and boiler control modes are preferably discrete pulses. However, time control pulse widths or continuous analog input signals may also be utilized. In the automatic startup mode, the turbine acceleration is controlled as a function of detected turbine operating conditions including rotor thermal stress. Similarly, loading rate can be controlled as a function of detected turbine operating conditions.

The output from the integrator 1054 is applied to a breaker decision block 1060. The breaker decision block 1060 checks the state of the main generator circuit breaker 17 and whether speed control or load control is to be used. The breaker block 1060 then makes a decision as to the use of the reference value. The decision made by the breaker block 1060 is placed at the earliest possible point in the control task 1020 thereby reducing computational time and subsequently the duty cycle required by the control task 1020. If the main generator circuit breaker 17 is open whereby the turbine system is in wide range speed control the reference is applied to the compare block 1062 and compared with the actual turbine generator speed in a feedback type control loop. A speed error value from the compare block 1062 is fed to a proportional plus reset controller block 1068, to be described in greater detail later herein. The proportional plus reset controller 1068 provides an integrating function in the control task 1020 which reduces the speed error signal to zero. In the prior art, speed control systems limited to proportional controllers are unable to reduce a speed error signal to zero. During manual operation an offset in the required setpoint is no longer required in order to maintain the turbine speed at a predetermined value. Great accuracy and precision of turbine speed whereby the turbine speed is held within one RPM over tens of minutes is also accomplished. The accuracy of speed is so high that the turbine 10 can be manually synchronized to the power line without an external synchronizer typically required. An output from the proportional plus reset controller block 1068 is then processed for external actuation and positioning of the appropriate throttle and or governor valves.

If the main generator circuit breaker 17 is closed, the CONTROL task 1020 advances from the breaker block 1060 to a summer 1072 where the REFERENCE acts as a feedforward setpoint in a combined feedforward-feedback load control system. If the main generator circuit breaker 17 is closed, the turbine generator system 10 is being loaded by the electrical network connected thereto.

The control task 1020 of the DEH system 1100 utilizes the summer 1072 to compare the reference value with the output of speed loop 1310 (FIG. 10) in order to keep the speed correction independent of load. A multiplier function has a sensitivity to varying load which is objectionable in the speed loop 1310.

During the load mode of operation the DEMAND represents the specified loading in MW of the generator 16 which is to be held at a predetermined value by the DEH system 1100. However, the actual load will be modified by any deviations in system frequency in accordance with a predetermined regulation value. To provide for frequency participation, a rated speed value in box 1074 is compared in box 1078 with a "two signal" speed value represented by box 1076. The two signal speed system provides high turbine operating reliability to be described infra herein. An output from the compare function 1078 is fed through a function 1080 which is similar to a proportional controller which converts the speed error value in accordance with the regulation value. The speed error from the proportional controller 1080 is combined with the feedforward megawatt reference, i.e., the speed error and the megawatt reference are summed in summation function or box 1072 to generate a combined speed compensated reference signal.

The speed compensated load reference is compared with actual megawatts in a compare box or function 1082. The resultant error is then run through a proportional plus reset controller represented by program box 1084 to generate a feedback megawatt trim.

The feedforward speed compensated reference is trimmed by the megawatt feedback error multiplicatively, to correct load mismatch, i.e., they are multiplied together in the feedforward turbine reference path by multiplication function 1086. Multiplication is utilized as a safety feature such that if one signal e.g., MW should fail, a large value would not result which could cause an overspeed condition but instead the DEH system 1100 would switch to a manual mode. The resulting speed compensated and megawatt trimmed reference serves as an impulse pressure setpoint in an impulse pressure controller and it is compared with a feedback impulse chamber pressure representation from input 1088. The difference between the feed-forward reference and the impulse pressure is developed by a comparator function 1090, and the error output therefrom functions in a feedback impulse pressure control loop. Thus, the impulse pressure error is applied to a proportional plus reset controller function 1092.

During load control the megawatt loop comprising in part blocks 1082 and 1084 may be switched out of service leaving the speed loop 1310 and an impulse pressure loop operative in DEH system 1100.

Impulse pressure responds very quickly to changes of load and steam flow and therefore provides a signal with minimum lag which smooths the output response of the turbine generator 10 because the lag dynamics and subsequent transient response is minimized. The impulse pressure input may be switched in and out from the compare function 1090. An alternative embodiment embracing feedforward control with impulse pressure feedback trim is applicable.

Between block 1092 and the governor valves GV1–GV8 a valve characterization function for the purpose of linerizing the response of the valves is interposed. The valve characterization function is utilized in both automatic modes and manual modes of operation of the DEH system 1100. The output of the proportional plus reset controller function 1092 is then ultimately coupled to the governor valves GV1–GV8 through electrohydraulic position control loops implemented by equipment considered elsewhere herein. The proportional plus reset controller output 1092 causes positioning of the governor valves GV1–GV8 in load control to achieve the desired megawatt demand while compensation is made for speed, megawatt and impulse pressure deviations from desired setpoints.

Figure 8:
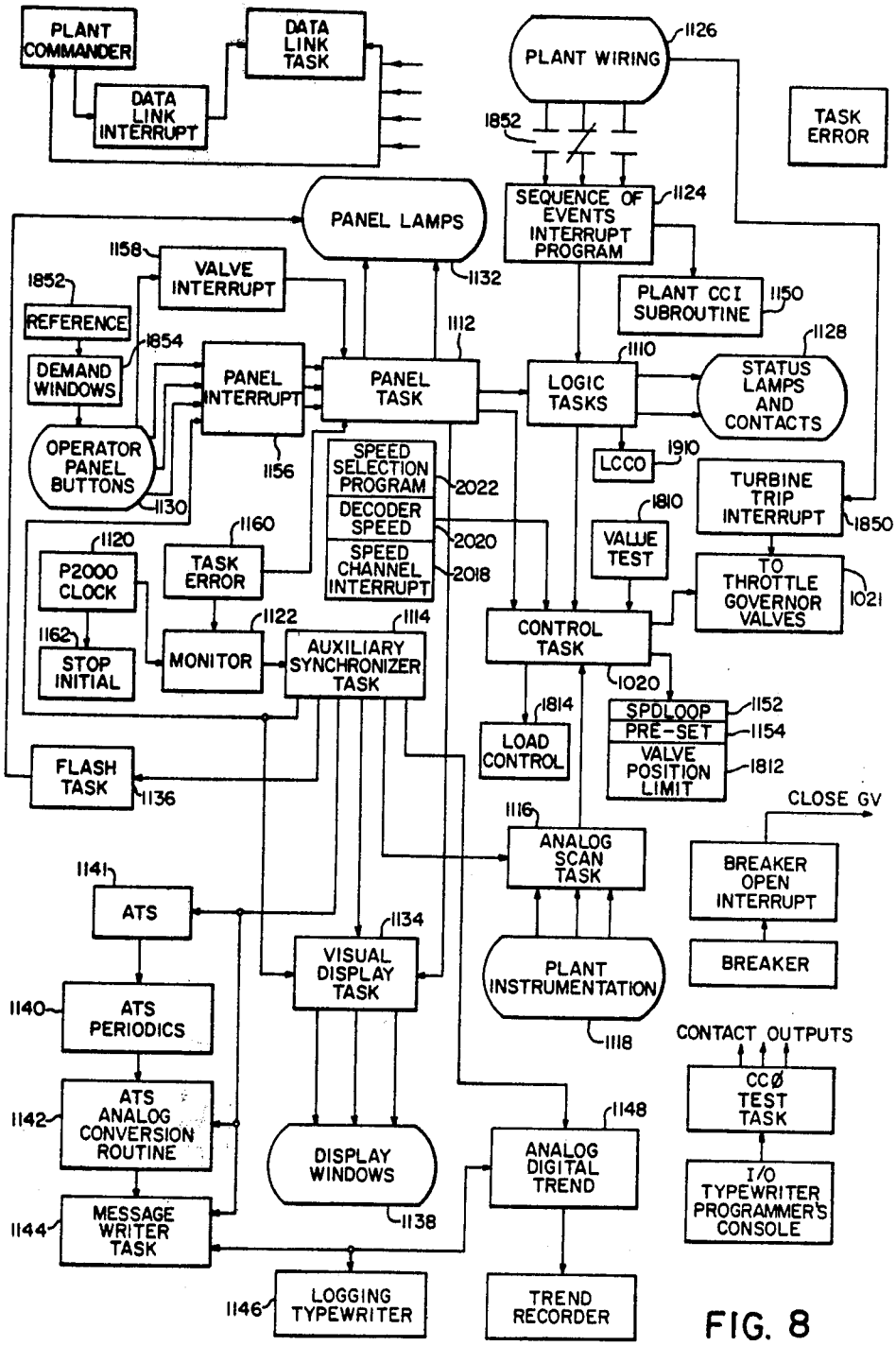
FIG. 8 shows a block diagram of one embodiment of the programs and subroutines of the digital Electro Hydraulic system used with the present invention.
Figure 12:
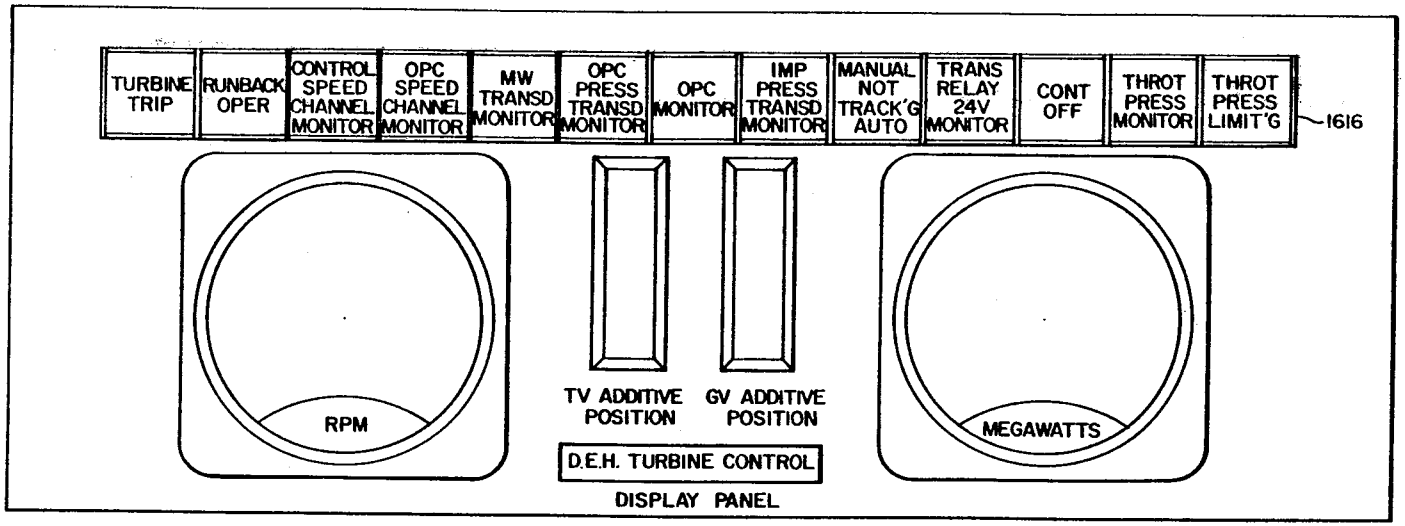
FIGS. 12, 13 and 14 illustrate portions of a typical operator's control panel used with the system of the invention.

Making reference to FIG. 8, the control program 1020 is shown with interconnections to other programs in the program system employed in the Digital Electro Hydraulic (DEH) system 1100. The periodically executed program 1020 receives data from a logic task 1110 where mode and other decisions which affect the control program are made, a panel task 1112 where operator inputs may be determined to affect the control program, an auxiliary synchronizer program 1114 and an analog scan program 1116 which processes input process data. The analog scan task 1116 receives data from plant instrumentation 1118 external to the computer as considered elsewhere herein, in the form of pressures, temperatures, speeds, etc. and converts such data to proper form for use by other programs. Generally, the auxiliary synchronizer program 1114 measures time for certain important events and it periodically bids or runs the control and other programs. An extremely accurate clock function 1120 operates through monitor program 1122 to run the auxiliary synchronizer program 1114.

The monitor program or executive package 1122 also provides for controlling certain input/output operations of the computer and, more generally, it schedules the use of the computer to the various programs in accordance with assigned priorities.

The logic task 1110 is fed from outputs of a contact interrupt or sequence of events program 1124 which monitors contact variables in the power plant 1126. The contact parameters include those which represent breaker state, turbine auto stop, tripped/latched state interrogation data states, etc. Bids from the interrupt program 1124 are registered with and queued for execution by the executive program 1122. The control program 1110 also receives data from the panel task 1112 and transmits data to status lamps and output contacts 1128. The panel task 1112 receives data instruction based on supervision signals from the operator panel buttons 1130 and transmits data to panel lamps 1132 and to the control program 1020. The auxiliary synchronizer program 1114 synchronizes through the executive program 1122 the bidding of the control program 1020, the analog scan program 1116, a visual display task 1134 and a flash task 1136. The visual display task transmits data to display windows 1138.

The control program 1020 receives numerical quantities representing process variables from the analog scan program 1116. As already generally considered, the control program 1020 utilizes the values of the various feedback variables including turbine speed, impulse pressure and megawatt output to calculate the position of the throttle valves TV1–TV4 and governor valves GV1–GV8 in the turbine system 10, thereby controlling the megawatt load and the speed of the turbine 10.

To interface the control and logic programs efficiently the sequence of events program 1124 normally provides for the logic task 1110 contact status updating on demand rather than periodically. The logic task 1110 computes all logical states, according to predetermined conditions and transmits this data to the control program 1020 where this information is utilized in determining the positioning control action for the throttle valves TV1–TV4, and the governor valves GV1–GV8. The logic task 1110 also controls the state of various lamps and relay type contact outputs in a predetermined manner.

E. TASK PRIORITY ASSIGNMENTS

With reference now to FIG. 9, a table of program priority assignments is shown as employed in the executive monitor. A program with the highest priority is run first under executive control if two or more programs are ready to run. The stop/initialize program function has top priority and is run on startup of the computer or after the computer has been shut down momentarily and is being restarted. The control program 1020 is next in order of priority. The operator's panel program 1130, which generates control data, follows the control task 1020 in priority. The analog scan program 1116 also provides information to the control task 1020 and operates at a level of priority below that of the operator's panel 1130. The automatic turbine starting (ATS) periodic program 1140 is next in the priority list. ATS stands for automatic turbine startup and monitoring program, and is shown as a major task program 1140 of FIG. 8 for the operation of the DEH system 1100. The ATS-periodic program 1140 monitors the various temperatures, pressures, breaker states, rotational velocity, etc. during start-up and during load operation of the turbine system.

The logic task 1110, which generates control and operating mode data, follows in order of operating priority. The visual display task program 1134 follows the logic task program 1110 and makes use of outputs from the latter. A data link program for transmitting data from the DEH system to an external computer follows. An ATS-analog conversion task program 1142 for converting the parameters provided by the ATS-periodic program 1142 to usable computer data follows in order of priority. The flash task program 1136 is next, and it is followed by a programmer's console program which is used for maintenance testing and initial loading of data tapes. The next program is an ATS-message writer 1144 which provides for printout of information from the ATS analog conversion program 1142 on a suitable typewriter 1146. The next program in the priority list is an analog/digital trend which monitors parameters in the turbine system 10 and prints or plots them out for operator perusal. The remaining two programs are for debugging and special applications.

In the preferred embodiment, the stop/initialize program is given the highest priority in the table of FIG. 9 because certain initializing functions must be completed before the DEH system 1100 can run. The auxiliary synchronizer program 1114 provides timing for all programs other than the stop/initialize program while the DEH system 1100 is running. Therefore, the auxiliary synchronizer task program 1114 has the second order of priority of the programs listed. The control program 1020 follows at the third descending order of priority since the governor valves GV1 through GV8 and the throttle valves TV1 through TV4 must be controlled at all times while the DEH system 1100 is in operation.

The operator's panel program 1130 is given the next order of priority in order to enable an operator to exercise direct and instantaneous control of the DEH system 1100. The analog scan program 1116 provides input data for the control program 1020 and, therefore, is subordinate only to the initialize synchronizer control and operator functions.

The logic task 1110 which control the operations of some of the functions of the control task program 1020 is next in order of priority. The visual display task 1134 follows in order of priority in order to provide an operator with a visual indication of the operation of the DEH program 1100. The visual display program 1134 is placed in the relatively low eighth descending order of priority since the physical response to an operator is limited in speed to 0.2 to 0.5 sec. as to a visual signal. The rest of the programs are in essentially descending order of importance in the preferred embodiment. In alternative embodiment of the inventions, alternate priority assignments can be employed for the described or similar programs, but the general priority listing described is preferred for the various reasons presented.

A series of interrupt programs interrupt the action of the computer and function outside the task priority assignments to process interrupts. One such program in FIG. 8 is the sequence events or contact interrupt program 1124 which suspends the operation of the computer for a very short period of time to process an interrupt. Between the operator panel buttons 1130 and the panel task program 1112 a panel interrupt program 1156 is utilized for signalling any changes in the operator's panel buttons 1130. A valve interrupt program 1158 is connected directly between the operator's panel buttons 1130 and the panel task program 1112 for operation during a valve test or in case of valve contingency situations.

Proportional plus reset controller subroutine 1154 (FIG. 11) is called by the control task program 1020 of FIG. 7 as previously described when the turbine control system is in the speed mode of control and also, for computer use efficiency, when the turbine 10 is in the load mode of control with the megawatt and impulse pressure feedback loops in service. Utilizing the proportional plus reset function 1068 during speed control provides very accurate control of the angular velocity of the turbine system.

In addition to previously described functions, the auxiliary synchronizer program 1114 is connected to and triggers the ATS periodic program 1140, the ATS analog conversion routine 1142 and the message writer 1144. The ATS program 1140 monitors a series of temperature, vibration, pressures, speed, etc. in the turbine system and also contains a routine for automatically starting the turbine system 10. The ATS analog conversion routine 1142 converts the digital computer signals from the ATS periodic program 1140 to analog or digital or hybrid form which can be typed out through the message writer task 1144 to the logging typewriter 1146 or a similar recorder.

The auxiliary synchronizer program 1114 also controls an analog/digital trend program 1148. The analog/digital trend program 1148 records a set of variables in addition to the variables of the ATS periodic program 1140.

Ancillary to a series of other programs is a plant CCI subroutine 1150 where CCI stands for contact closure inputs. The plant CCI subroutine 1150 responds to changes in the state of the plant contacts as transmitted over the plant wiring 1126. Generally, the plant contacts are monitored by the CCI subroutine 1150 only when a change in contact state is detected. This scheme conserves computer duty cycle as compared to periodic CCI monitoring. However, other triggers including operator demand can be employed for a CCI scan.

As shown in FIG. 8, the control task 1020 calls ancillary thereto a speed loop task 1152 and the preset or proportional plus reset controller program 1154. Ancillary to the executive monitoring program 1122 is a task error program 1160. In conjunction with the clock program 1120 a stop/initialize program 1162 is used. Various other functions in FIG. 8 are described in greater detail infra.

2. SPEED LOOP SUBROUTINE

Making reference now to FIG. 10, a speed loop program 1310 which functionally is part of the arrangement shown in FIG. 7 is shown in greater detail. The speed loop (SPDLOOP) program 1310 normally computes data required in the functioning of the speed feedback loop in the load control comprising as shown in FIG. 7 the rated speed reference 1074, the actual turbine speed 1076, the compare function 1078, the proportional controller 1080 and the summing function 1072. The speed loop subroutine 1310 is called upon to perform speed control loop functions by the control program 1020. In FIG. 10, the functioning of the proportional controller 1080 is shown in detail. The error output from the compare function 1078 is fed through a deadband function 1312. A proportionality constant (GR1) 1314 and a high limit function (HLF) 1316 are included in the computation.

The speed loop (SPDLOOP) subroutine is called by the CONTROL TASK during the load control mode and when switching occurs between actual speed signals. Subroutine form reduces the requirement for memory storage space thereby reducing the computer expense required for operation of the DEH system 1100.

The deadband function 1312 provides for bypassing small noise variations in the speed error generated by the compare function 1078 so as to prevent turbine speed changes which would otherwise occur. Systems without a deadband continuously respond to small variations which are random in nature resulting in undue stress in the turbine 10 and unnecessary, time and duty cycle consuming operation of the control system. A continuous hunting about the rated speed due to the gain of the system would occur without the deadband 1312. The speed regulation gain GR1 at 1314 is set to yield rated megawatt output power speed correction for a predetermined turbine speed error. The high limit function HLF at 1316 provides for a maximum speed correction factor.

The turbine speed 1076 is derived from three transducers. The turbine digital speed transducer arrangement is that disclosed in greater element and system implementation detail in the aforementioned Reuther application Ser. No. 412,513. Briefly, in the preferred embodiment for determining the speed of the turbine, the system comprises three independent speed signals. These speed signals consist of a very accurate digital signal generated by special electronic circuitry from a magnetic pickup, an accurate analog signal generated by a second independent magnetic pickup, and a supervisory analog instrument signal from a third independent pickup. The DEH system compares these signals and through logical decisions selects the proper signal to use for speed control or speed compensated load control. This selection process switches the signal used by the DEH control system 1100 from the digital channel signal to the accurate analog channel signal or vice versa under predetermined dynamic conditions. In order to hold the governor valves at a fixed position during this speed signal switching the control program 1020 uses the speed loop subroutine 1310 and performs a computation to maintain a bumpless speed signal transfer.

Making additional reference to FIG. 11, the speed loop (SPDLOOP) subroutine flow chart 1310 is shown in greater detail. Two FORTRAN statements signify the operation of the speed loop subroutine program flow chart 1310. These statements are:

CALL SPDLOOP

REF1=REFDMD+X

Variables in the flow chart 1310 are defined as follows:

| FORTRAN VARIABLES | ENGLISH LANGUAGE EQUIVALENT |
|---|---|
| REFMD | Load reference |
| WR | The turbine rated speed |
| REF1 | Corrected load reference |
| WS | The actual turbine speed |
| TEMP | Temporary storage location variable |
| SPDB | The speed deadband |
| GR1 | The speed regulation gain (normally set to yield rated megawatt speed correction for a 180 rpm speed error) |
| X | Speed correction factor |
| HLF | The high limit function |

LOGIC TASK

Figure 16:
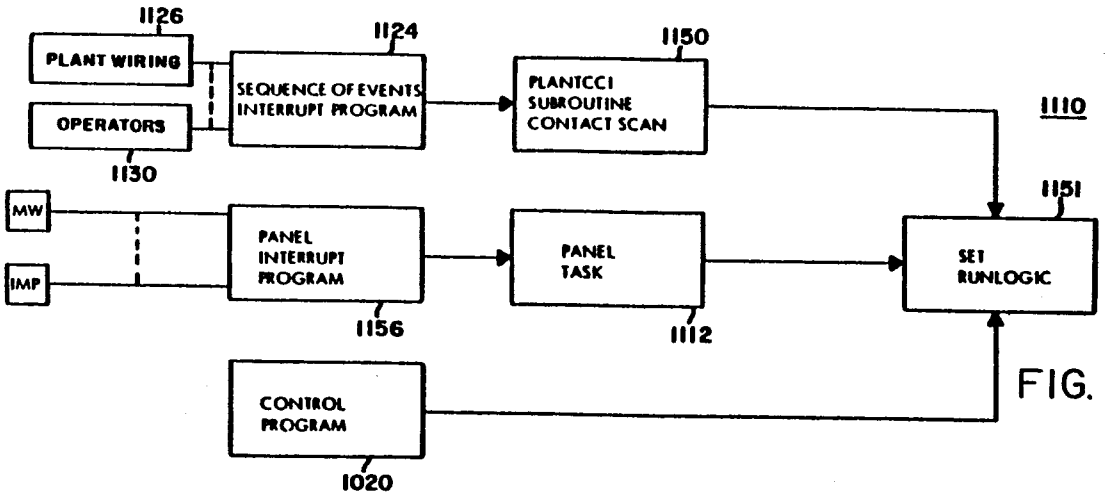
FIG. 16 is a block diagram of conditions which cause initiation of a logic program for a system utilizing the present invention.
Figure 15:
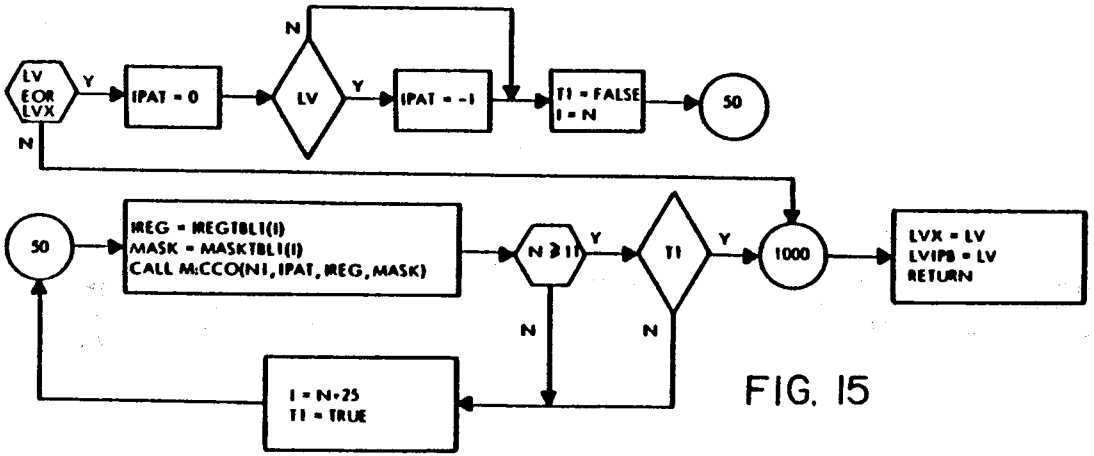
FIG. 15 is a flow chart of a logic contact closure output subroutine for a system utilizing the present invention.
Figure 17:
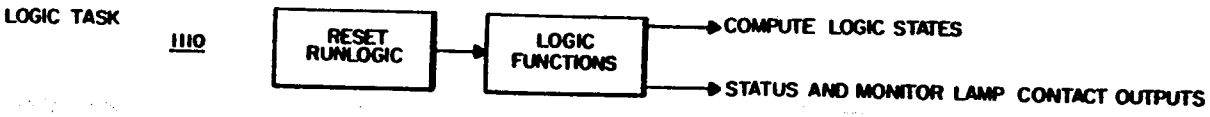
FIG. 17 is a simplified block diagram of a portion of the logic function for a system utilizing the present invention.
Figure 18:
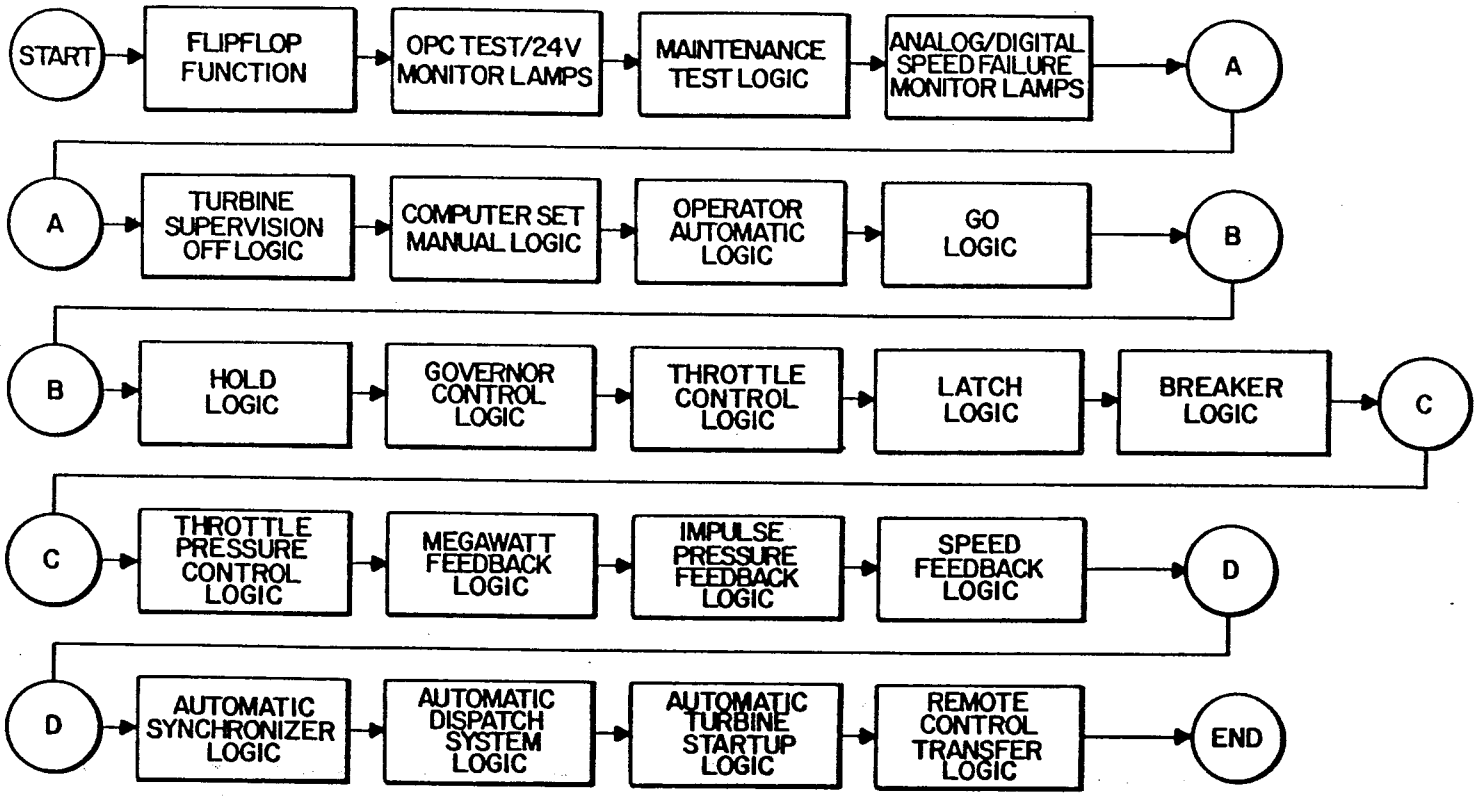
FIG. 18 is a block diagram of the logic program for a system utilizing the present invention.

The logic task 1110, as shown in FIG. 8 selects proper operating states status lamps and contacts 1128, control functions 1020, go logic, throttle pressure logic, breaker logic, interface logic, etc. in the DEH system. Referring now to FIGS. 15 and 16, a block diagram representing the operation of the logic task 1110 is shown. A contact input from the plant wiring 1126 triggers the sequence of events or interrupt program 1124 which calls upon the plant contact closure input subroutine 1150 which in turn requests that the logic program 1110 be executed by the setting of a flag called RUNLOGIC 1151 in the logic program 1110. The logic program 1110 is also run by the panel interrupt program 1156 which calls upon the panel task program 1112 to run the logic program 1110 in response to panel button operations. The control task program 1020 in performing its various computations and decisions will sometimes request the logic program 1110 to run in order to update conditions in the control system. In FIG. 17, the functioning of the logic program 1110 is shown. FIG. 18 shows a more explicit block diagram of the logic program 1110.

The logic program 1110 controls a series of tests which determine the readiness and operability of the DEH system 1100. One of these tests is that for the overspeed protection controller which is part of the analog backup portion of the hardwired system 1016 shown in FIG. 6. Generally, the logic program 1110 is structured from a plurality of subroutines which provide the varying logic functions for other programs in the DEH program system, and the various logic subroutines are all sequentially executed each time the logic program is run.

SELECT OPERATING MODE FUNCTION

Input demand values of speed, load, rate of change of speed, and rate of change of load are fed to the DEH control system 1100 from various sources and transferred bumplessly from one source to another. Each of these sources has its own independent mode of operation and provides a demand or rate signal to the control program 1020. The control task 1020 responds to the input demand signals and generates outputs which ultimately move the throttle valves TV1 through TV4 and/or the governor valves GV1 through GV8.

Figure 13:
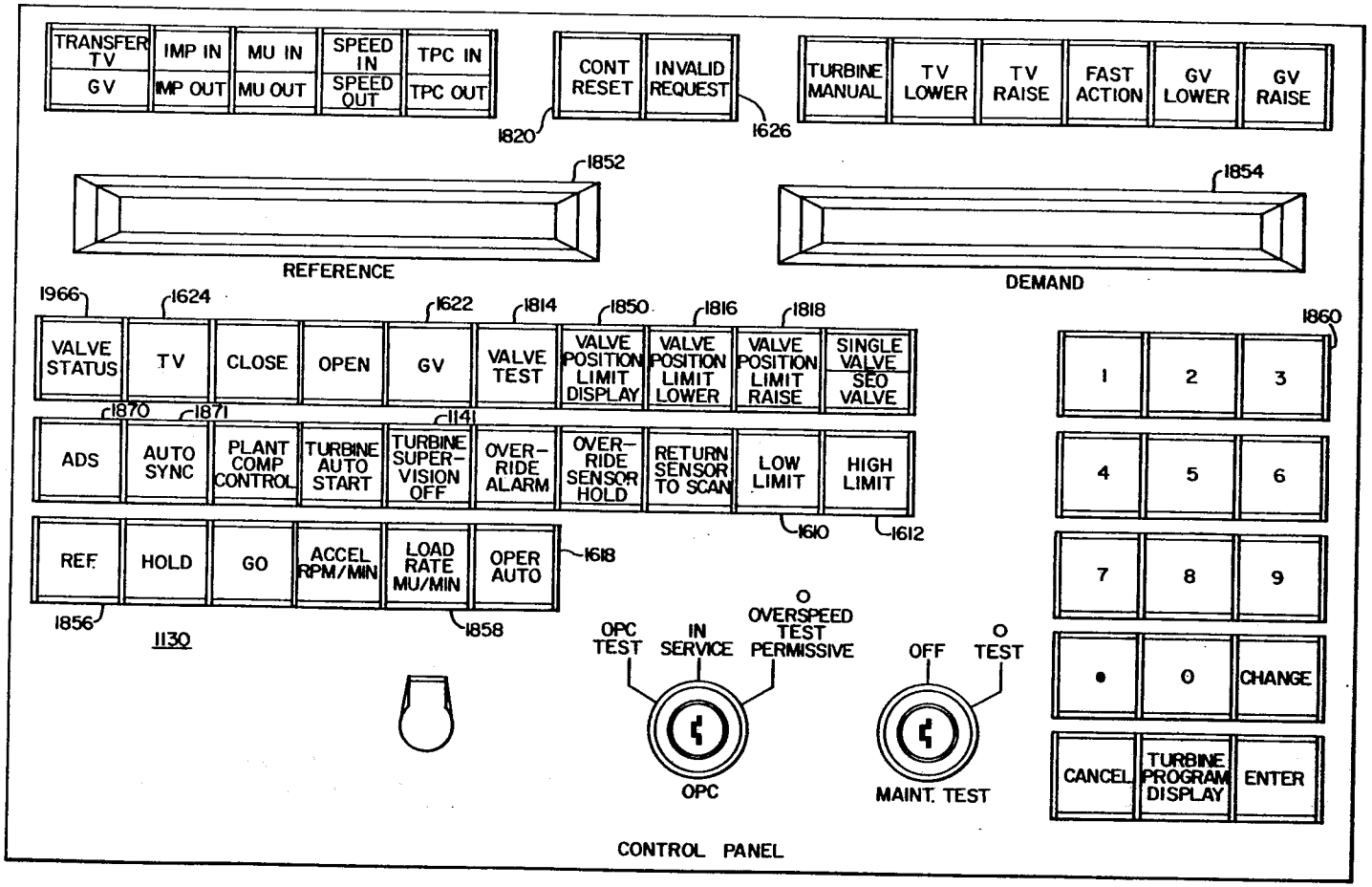
Figure 14:
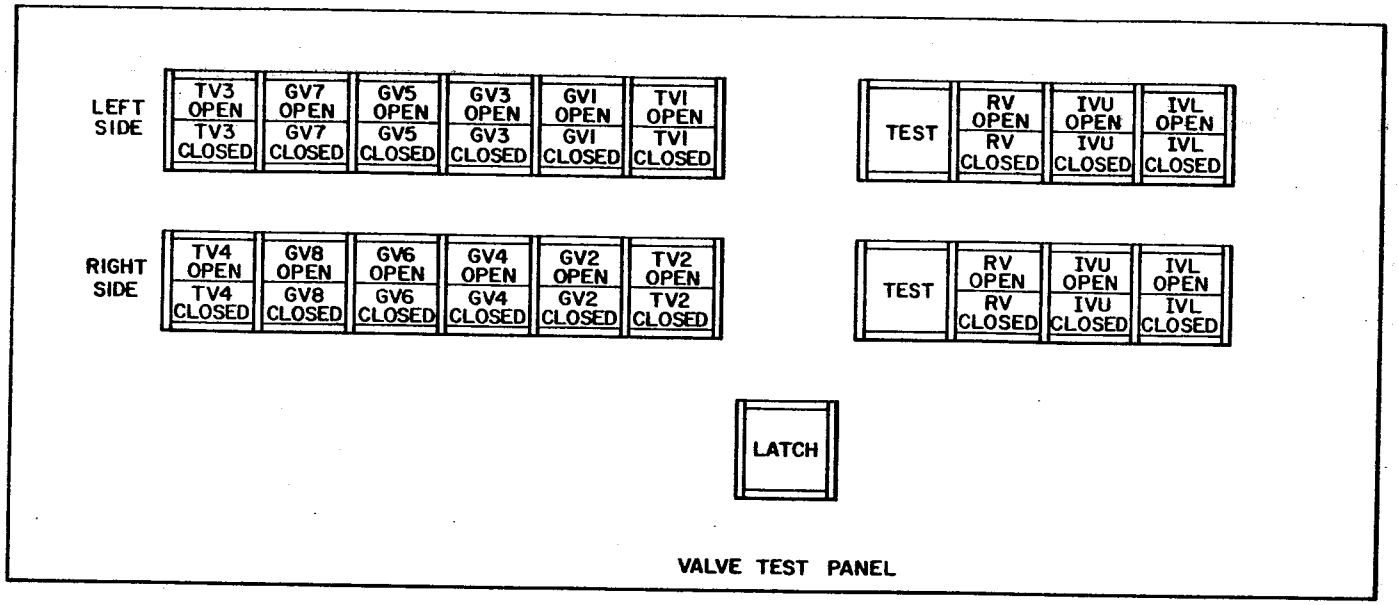

With the breaker 17 open and the turbine 10 in speed control, the following modes of operation may be selected:

1. Automatic synchronizer mode—pulse type contact input for adjusting the turbine speed reference and speed demand and moving the turbine 10 to synchronizing speed and phase.
2. Automatic turbine startup program mode—provides turbine speed demand and rate.
3. Operator automatic mode—speed, demand and rate of change of speed entered from the keyboard 1860 on the operator's panel 1130 shown in FIG. 13.
4. Maintenance test mode—speed demand and rate of change of speed are entered by an operator from the keyboard 1860 on the operator's control panel 1130 of FIG. 13 while the DEH system 1100 is being used as a simulator or trainer.
5. Manual tracking mode—the speed demand and rate of change of speed are internally computed by the DEH system 1100 and set to track the manual analog back-up system 1016 as shown in FIG. 6 in preparation for a bumpless transfer to the operator automatic mode of control.

With the breaker 17 closed and the turbine 10 in the load control mode, the following modes of operation may be selected:

1. Throttle pressure limiting mode—a contingent mode in which the turbine load reference is run back or decreased at a predetermined rate to a predetermined minimum value as long as a predetermined condition exists.
2. Run-back mode—a contingency mode in which the load reference is run back or decreased at a predetermined rate as long as a predetermined condition exists.
3. Automatic dispatch system mode—pulse type contact inputs are supplied from an automatic dispatch system to adjust turbine load reference and demand when the automatic dispatch system button 1870 on the operator's panel 1130 is depressed.
4. Operator automatic mode—the load demand and the load rate are entered from the keyboard 1830 on the control panel 1130 in FIG. 13.
5. Maintenance test mode—load demand and load rate are entered from the keyboard 1860 of the control panel 1130 in FIG. 13 while the DEH system 1100 is being used as a simulator or trainer.
6. Manual tracking mode—the load demand and rate are internally computed by the DEH system 1100 and set to track the manual analog back-up system 1016 preparatory to a bumpless transfer to the operator automatic mode of control.

SPEED/LOAD REFERENCE FUNCTION

Figure 20:
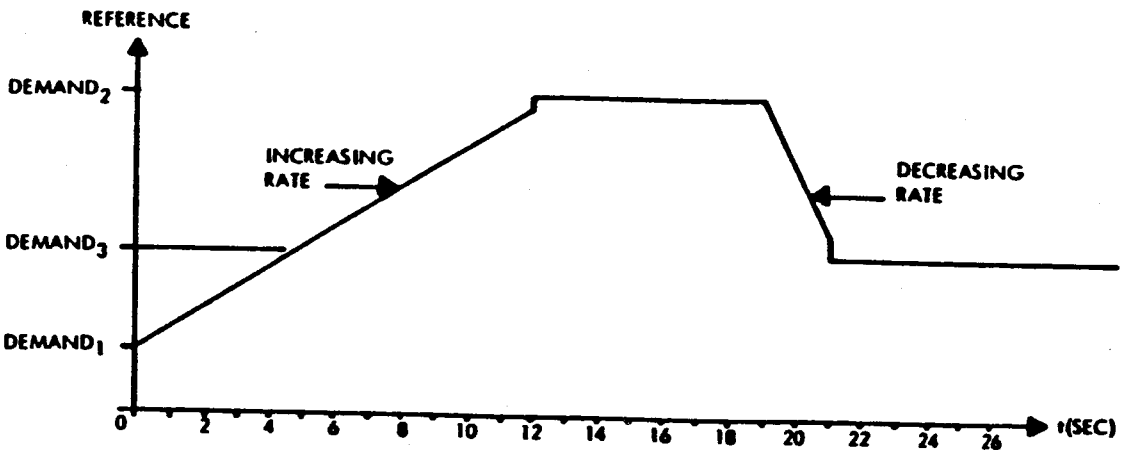
FIG. 20 shows a speed/load reference graph of a system for the present invention.
Figure 19:
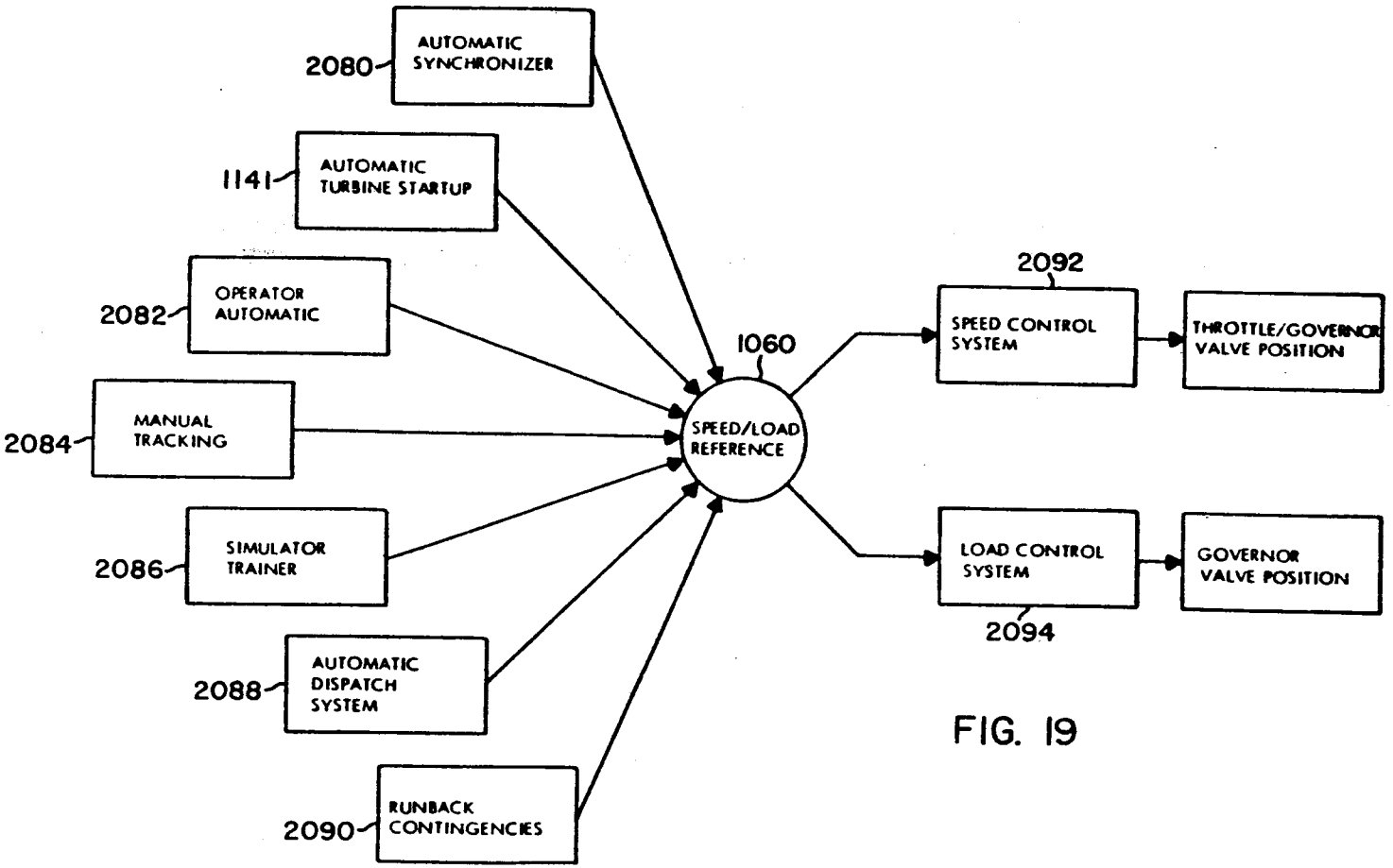
FIG. 19 shows a symbolic diagram of the use of a speed/load reference function for a system utilizing the present invention.

Referring now to FIG. 19, a block diagram of the operation of the speed/load reference function is shown. The decision breaker function 1060, of FIG. 7, is identical to the speed/load reference function 1060, of FIG. 19. A software speed control subsystem 2092 of FIG. 19, corresponds to the compare function 1062, the speed reference 1066 and the proportional plus reset controller function 1068, of FIG. 7. The software load control subsystem 2094, of FIG. 19, corresponds to the rated speed reference 1074, the turbine speed 1076, the compare function 1078, the proportional controller 1080, the summing function 1972, the compare function 1082, the proportional plus reset controller function 1084, the multiplication function 1086, the compare function 1090, the impulse pressure transducer 1088 and the proportional plus reset controller 1092, of FIG. 7. The speed/load reference 1060 is controlled by, depending upon the mode and automatic synchronizer 1080, the automatic turbine starter program 1141, and operator automatic mode 2082, a manual tracking mode 2084, a simulator/trainer 2086, an automatic dispatch system 2088, or a run-back contigency load 2090. Each of these modes increments the speed/load reference function 1060 at a selected rate to meet a selected demand. A typical demand/reference rate is shown in FIG. 20 drawn as a function of time.

DESCRIPTION OF THE EMBODIMENTS OF VALVE MANAGEMENT

Referring to FIG. 8, a diagram which shows the hardware/software organization of the DEH system includes a portion 1020 in which the valve management system is incorporated. The basic additional hardware required for the preferred embodiment of the valve management system are sequential analog outputs and transfer means between sequential and single valve operation for governor valves referred to at 1021.

Figure 23A:
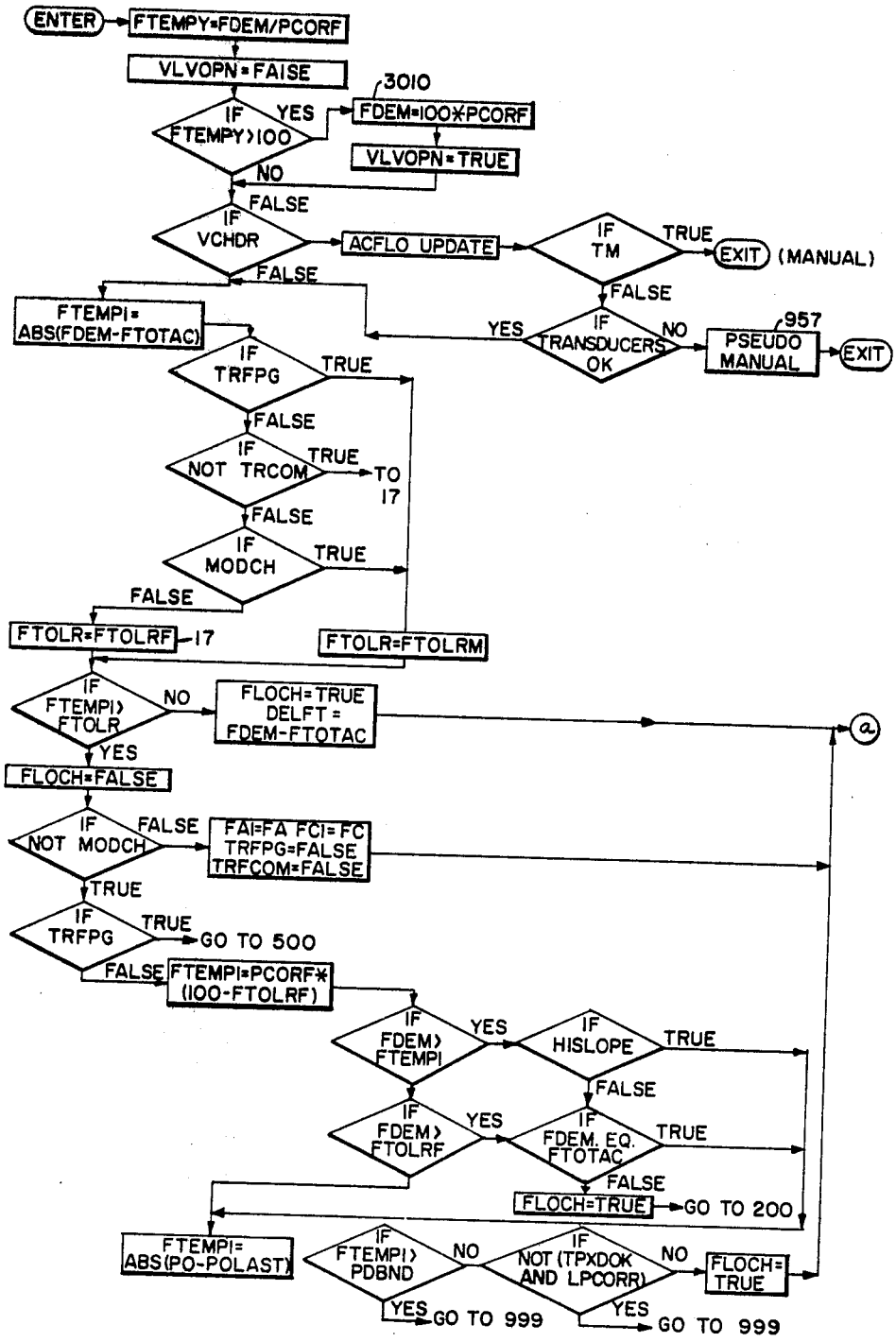
FIG. 23A and 23B are a general flow chart for control of the governor valves in accordance with the present invention.
Figure 23B:
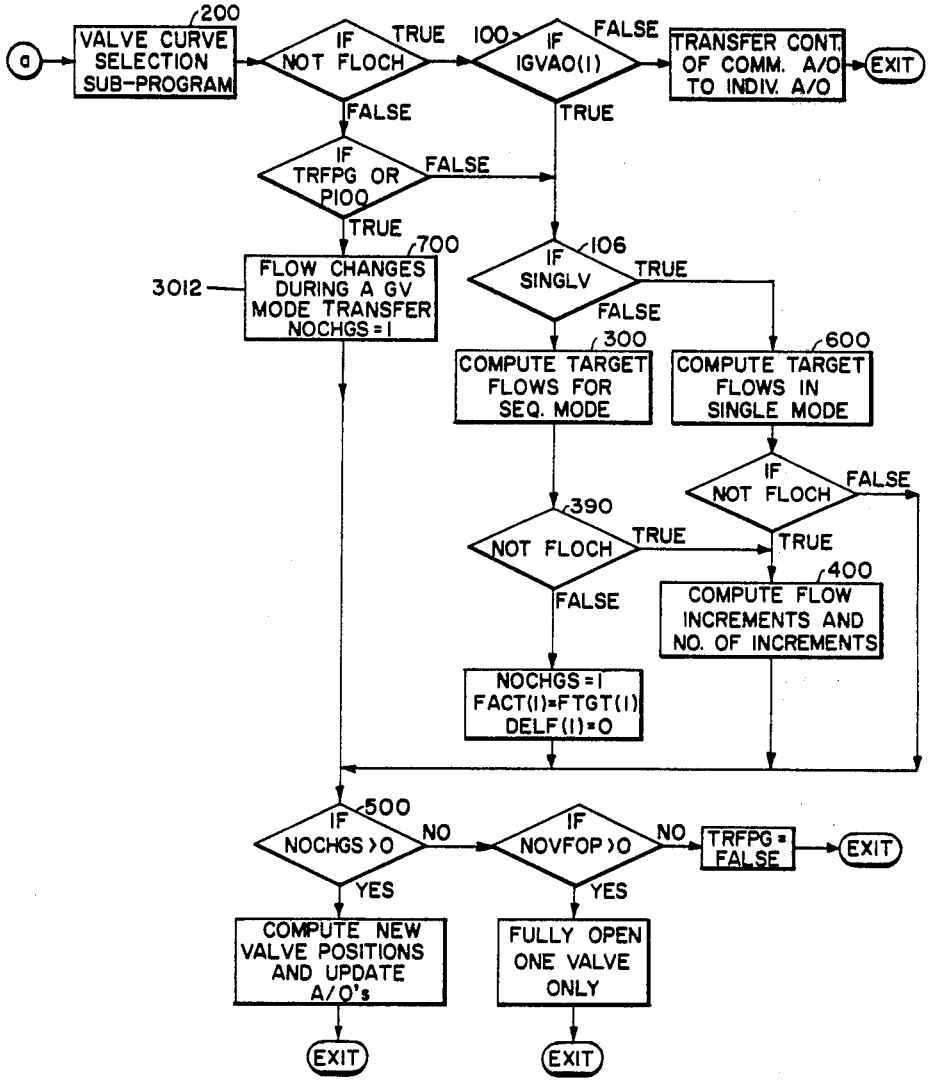
Figure 33:
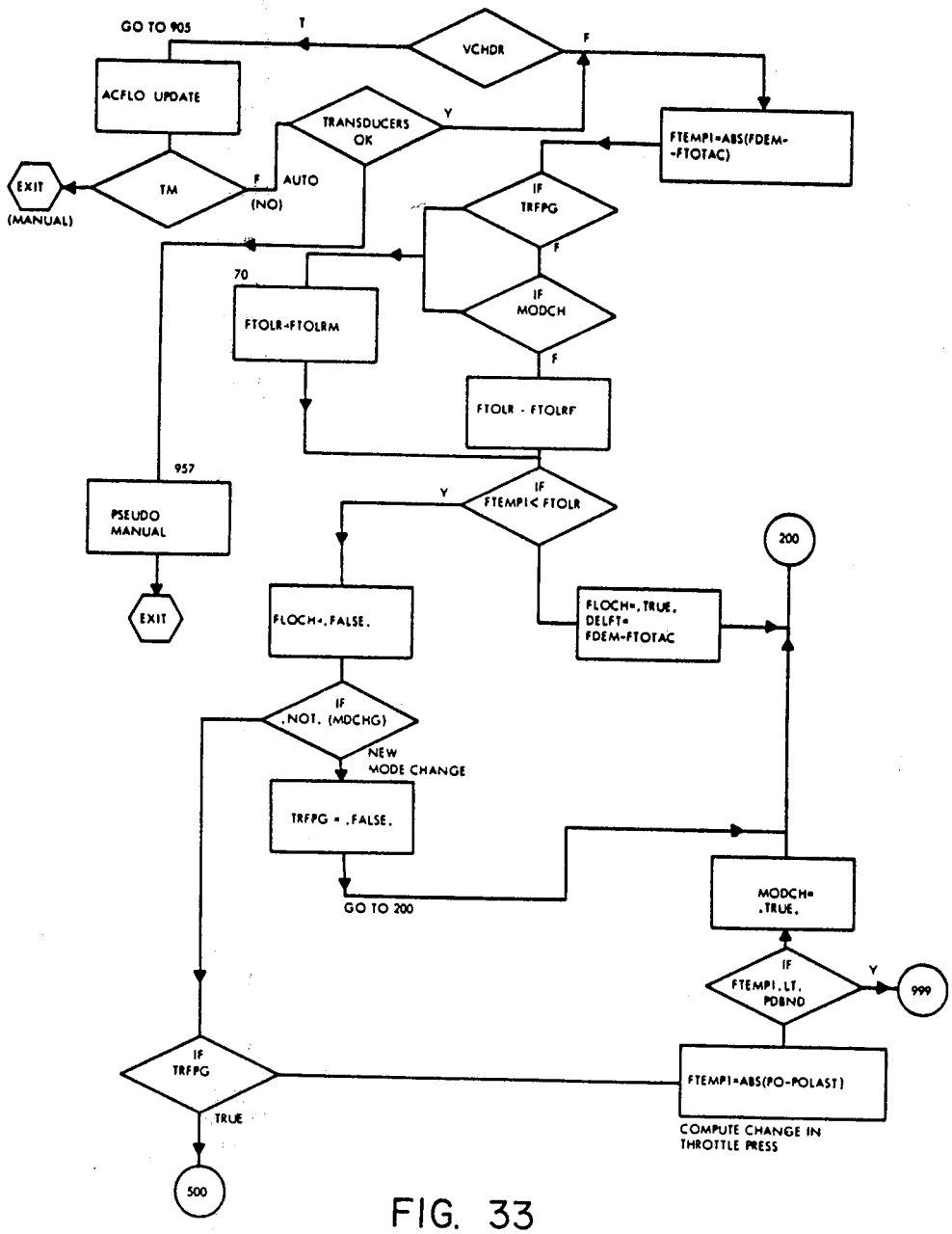
FIG. 33 shows a flow chart of a modification of a program for the operation of the governor valves which can be substituted for FIG. 23A when viewed with FIG. 23B; in accordance with the principles of the invention.

The valve management program, which is shown generally in FIGS. 23A and 23B, and FIG. 33, which is in some respects a modification of FIG. 23A includes: Valve curve selection, computing valve curve for preferred embodiment and selecting curve for alternate embodiment hereinafter described, transfer from single analog output to sequential analog output, computation of new valve flows for a transfer from single to sequential valve mode, computation of new valve flows for a transfer from sequential to single valve mode operation, computation of new valve flows for a flow demand change during a valve mode transfer, computation of the number of iterations required to complete a valve mode change, computation of valve positions, and computation of actual flows through valves after a manual mode change.

Figure 21:
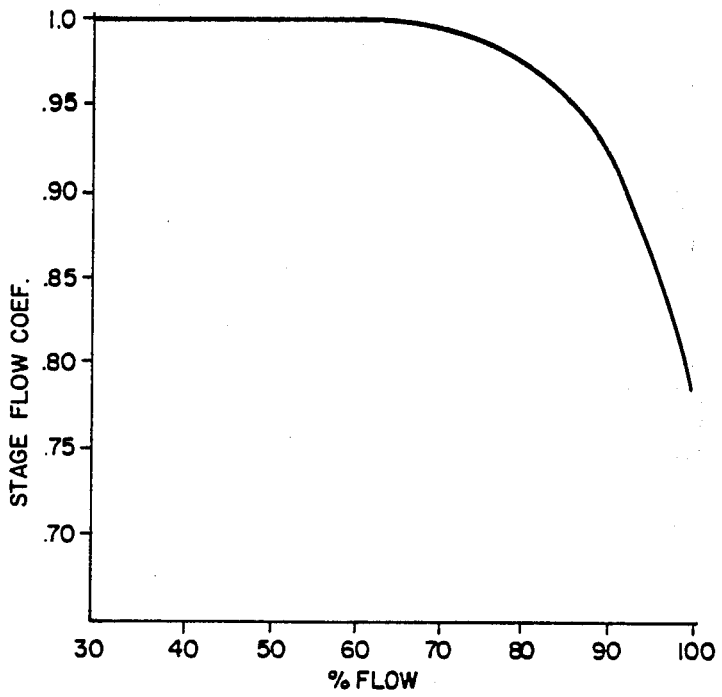
FIG. 21 shows a diagram of a flow demand vs. stage flow coefficient in accordance with the present invention.

In accordance with the preferred embodiment of the present invention, a steam flow demand is calculated by the DEH control system 1100 (see FIG. 2). Data representing a flow demand versus stage coefficient as shown in FIG. 21 is contained in computer memory based on the flow demand computed by the DEH control system. The flow value is shown on the abscissa and the stage flow coefficient is calculated along the ordinate. The stage flow coefficient is the ratio of actual flow at a flow demand over the theoretical flow if the orifice coefficient were equal to one. As the valve flow increases a range of critical flow is passed through. The resultant super critical flow exists in a range where the orifice coefficient is decreased sharply. Once the ordinate for a particular flow demand is calculated by use of the data in the computer 1100, the stage coefficient is calculated, which is used to calculate control valve positions. It should be noted that the stage flow coefficient is corrected such that the maximum flow coefficient of the orifice is normalized at 1 for simplicity of calculation.

Figure 22:
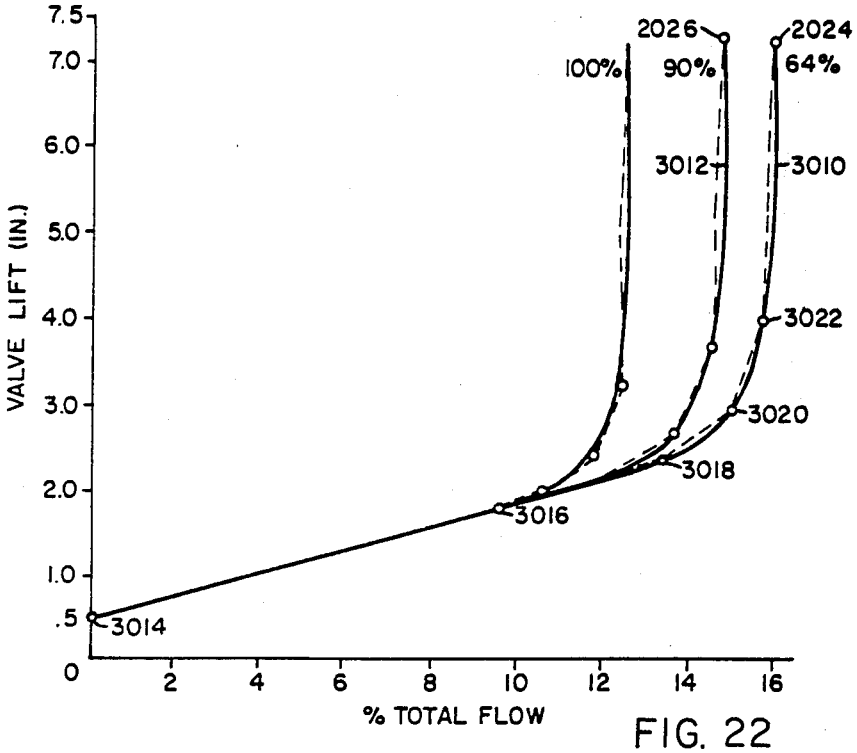
FIG. 22 shows a diagram of the total flow demand vs. valve lift in accordance with the present invention.

In FIG. 22 the flow demand is represented as a percentage of total flow of the abscissa and lift of the control or governor valve is shown on the ordinate whereby the lift of the valves for a specified flow demand can be calculated. In FIG. 22 curve 3010 is shown which represents a dynamic characteristic of operation of a single control valve from its closed position to its fully open position at approximately 64% of total steam flow. The corrected stage flow coefficient for critical flow is essentially equal one for the illustrated embodiment in FIG. 21 for flow demands of less than 64 percent total flow. The flow demand representing the transition from critical to nonsuper critical flow is determined by the design of the valves. In the example used in the present embodiment the transition occurs at 64% of total flow. However, such transition point can vary according to the system. If the flow demand is greater than that having a normalized corrected stage flow coefficient of one, a new curve, for example 3012 is calculated, because the curve for critical flow can only be used for flows up to 64%. The curve 3010 which represents a corrected stage flow coefficient of one is composed of five linear segments in order to facilitate ease of calculation and economy of memory space. In order to calculate a curve with a corrected stage flow coefficient less than one, the abscissas of the curve 3010 are multiplied by the corrected stage flow coefficient of FIG. 21. Similarly, the ordinates of the curve 3010 are corrected, by multiplying by the corrected stage flow coefficient from FIG. 21. The ordinates of the curve 3010 are corrected by subtracting the ordinate intersection point 3014 from the points 3016, 3018, and 3022.

Therefore, as the corrected stage coefficient varies due to changes in flow demand, a new dynamic curve is generated. The accuracy of representation and precision of operation is only limited by the resolution of the computer and the data representing the valve characteristics. Any desired degree of accuracy in developing dynamic curves can thus be achieved by increasing the resolution of the computer. In practice, five data points for each curve in FIGS. 21 and 22 have been sufficient to give an accuracy of better than 2% between flow demand and actual flow.

In an alternative embodiment of the invention, the valve management program selects one of a series of curves represented by data of valve flow demand versus control valve lift stored in the computer memory. A selection of a proper curve is predicted on the total flow through the turbine 10. Thereafter, the relationship between the total flow, the valve flow demand and the control valve lift is not affected by the mode of operation of the turbine 10. The data representing valve flow versus control valve lift is displayed in FIG. 22.

The transfer between single valve and sequential valve modes, and other described features in the operation of the control or governor valves GV1 through GV8 is accomplished in this embodiment by the selection of the data corresponding to an appropriate valve flow versus lift curve. As in the preferred embodiment, where the valve flow curve is computed, first a target flow or desired flow through each control or governor valve GV1 through GV8 is computed for the mode to be transferred into. Second, the flow changes, that is the differences between the initial flow and the desired flow to each valve, are computed. Next, a number of iterations is determined by dividing the largest flow change of any of the governor valves GV1 through GV8 by a predetermined maximum allowable change of flow through a valve thereby determining a number of iterations for the transfer of mode. Flow changes for each of the control or governor valves GV1 through GV8 already computed are then divided by the number of iterations required for the mode transfer. Each iterative step does not affect the total flow of fluid through the turbine 10 since the sum of the incremental flow changes is equal to zero.

During sequential valve or partial arc operation, one valve is usually partially opened and the other valves are usually either fully opened or fully closed. Since the stage flow coefficient is dependent upon flow demand or total flow, the number of valves and their positions contributing to the flow do not affect the calculation as performed on the appropriate curve of FIG. 22. The stage flow coefficient is the same if all the control valves are partially open, if some of the control valves are fully open, or if some are closed, and one control valve partially open. The fully open control valves contribute the percent of total flow as shown by their end point or corrected end point 2024 or 2026 (see FIG. 22). The partially open control valve makes up the remainder of the total flow demand in accordance with a function whereby the percent of total flow demand for the partially opened valve is entered in the abscissa in FIG. 22 and the actuator lift is shown on the ordinate.

Thus, the valve management program dynamically calculates data which represents control valve demand or flow as a function of the valve lift of a control valve while compensating for the pressure variation and the corrected first stage flow coefficient. The calculation of a dynamic flow demand versus lift characteristic is dependent upon the total flow of fluid through the turbine. The stage flow coefficient is constant regardless of the mode operation of the turbine whether it is single valve or sequential valve. In addition, as hereinafter described the valve demand versus lift characteristic data is modified dynamically for variations in the throttle pressure and also for the variation in the number of nozzles under each valve.

Referring again to FIG. 22 from point 3020 to point 2024, on curve 3010, a very high associated gain is required in order to maintain and linearize any action of the actuator for the control valves in this region.

SEQUENTIAL VALVE MODE

In the sequential mode the control valves open in succession thereby allowing all but one of the opened valves to operate fully open, and thus have a minimum throttling loss. The valve which is not opened completely is the only valve which generally controls the flow of steam through the turbine. Because of the areas at the beginning and the end of a valve stroke where control is very poor, methods of overlap or what may be termed asymmetric hysteresis have been developed which avoids these areas in control. During the use of asymmetric hysteresis, two valves are partially opened; however, only one is controlling the flow. Therefore the problem, which could occur when the control valves operate in sequential mode is prevented. When a valve controls flow in a saturation zone, a small flow change requires a considerable change in valve position. The present embodiment of the valve management program is arranged to avoid flow in the saturation zone by use of the valve overlap or the so-called asymmetric hysteresis approach whereby the associated high gain requirement and associated danger of instability is avoided.

Figure 32:
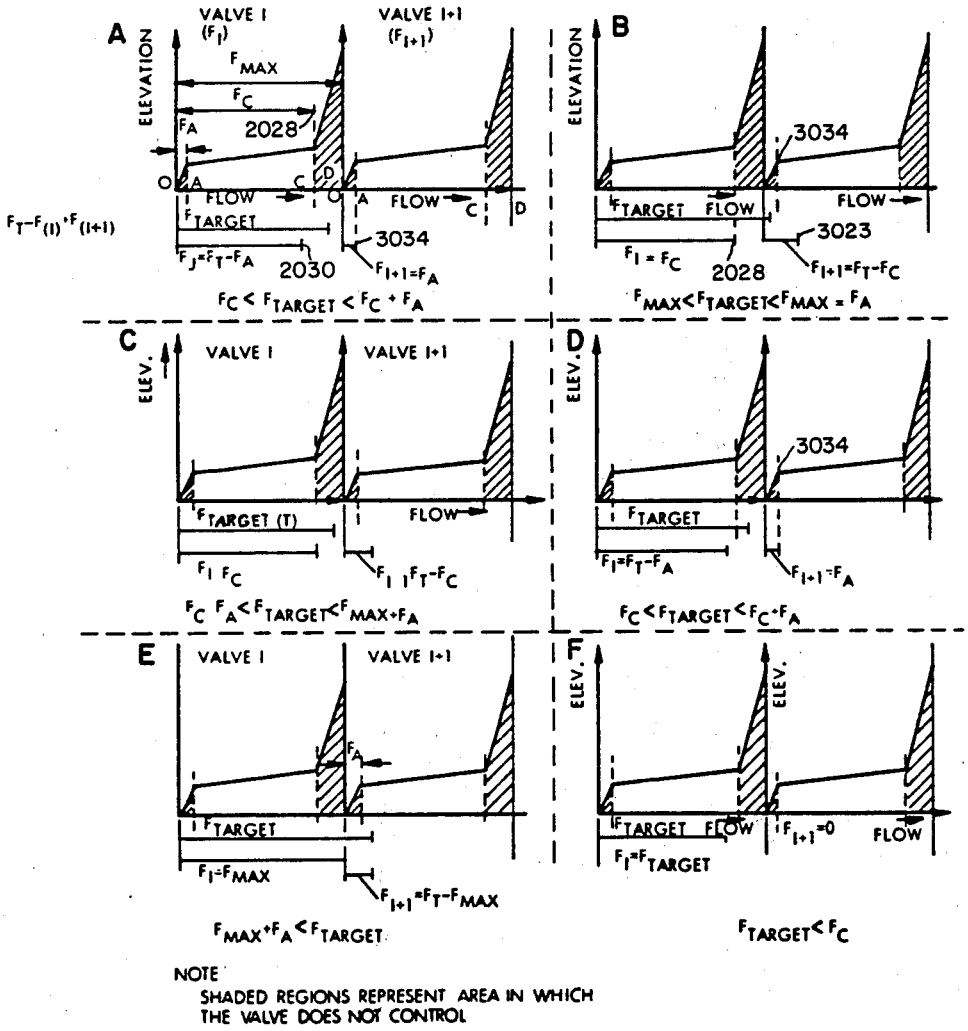
FIG. 32 shows diagrams of sequential mode valve operation in accordance with the principles of the invention.

Referring now to FIG. 32 it is shown that the governor or control valves are not controlled in the shaded OA and CD regions. A very large stroke change in these regions produces a very small flow change, which therefore requires the computer to have a very high equivalent gain. As is well known in control art a high gain can cause poles in the right-hand half complex plane of the transfer function to migrate into the right-hand half plane and therefore produce instability. The regions of steep slope CD and OA at the end of the travel and at the opening of each valve respectively are avoided in sequential control of the control valves. Valves I and I+1, are illustrated in FIG. 32 as sequentially operable valves. For example, during an increase in flow demand $F_T$, valve I stops momentarily at point 2028 as shown in portion A of FIG. 32 during its opening stroke; and closes to point 2030 at the same time as the next sequential valve I+1, opens to point 3034. Valve I and valve I+1 are moving in opposite directions at such rates that the total flow $F_T$ contributed by the two valves I and I+1 at points 2030 and 3034, respectively, would be equal to the flow contributed by valve I in the shaded region. When valves I and I+1 are moving in opposite directions the forward loop gain associated with the movement is essentially zero and therefore very stable.

The action of the valves during the opening and closing sequence is different thereby generating the hysteresis action. For example, if valve I has just opened fully, as illustrated in portion E of FIG. 32 a decrease in flow demand $F_T$ does not cause a movement of valve I until valve I+1 has closed considerably, such as shown in portion D of FIG. 32. Thus the sequence where a varying flow demand requires the full opening of valve I, and then a small decrease in flow demand requires its closing through the upper portion of its stroke where the control is poor and associated gain very high and an oscillation may result is avoided. Any system is prone to oscillation if small input signals produce large changes in output quantities.

If the control of the turbine system is transferred between valves I and I+1 because of noise in the demand signal for example, a rapid transfer may not be able to be effected because of the frequency response of the DEH system.

Also, when the point in the operating characteristic of flow demand versus actuator lift represented by valve I+1 closes to a point represented by 3034 as shown in FIG. 32 before valve I+1 closes completely in the closing sequence, valve I closes to a point represented by 2028, and valve I+1 opens to a point such as 3023 shown in FIG. 32. Thereby a transition through the area of high slope at the top of the valve stroke is avoided for a series of small changes in the flow demand.

Specifically, in the preferred embodiment, as shown in portion B of FIG. 32 the flow at the point 3023 of valve I+1 is assumed to be at least twice the flow as that as a point 3034, which point is equal to the flow in the uncontrollable range of the valve I+1; and the flow at point 3023 is greater than the flow contributed by the shaded portion of the valve I. As the flow increases, from that shown in portion A to portion B of FIG. 32 valve I opens again to point 2028 instead of opening fully to its maximum valve stroke and valve I+1 opens to the point such as 3023 so that its flow is greater than that represented by 3034. During a decreasing flow with valve I being fully opened and valve I+1 being partially open as illustrated in portion E of FIG. 32, the flow in valve I+1 decreases to the point 3034 (see portion B of FIG. 32) whereupon valve I closes to point 2028 and valve I+1 opens to point 3023 to compensate for the decrease of flow through valve I. Upon a further decrease of flow as shown in portion D of FIG. 32 such that valve I+1 decreases its flow again to the point 3034; and then as shown in portion F of FIG. 32 valve I+1 then closes completely, and valve I moves to a point which is less than 2028. By the above method changes in flow demand caused by noise fluctuations in the signals within the system will not cause a repeated opening and closing operation to occur around a particular flow demand. Once the flow has been switched from one valve to the other it will not be returned to the initial valve until a flow change greater than the shaded areas has occurred. In the present invention because of the control valves GV1–GV8 characteristics, a hysteresis or deadband which is equal to twice the flow of valve I+1 at point 3034 is utilized.

Reference is made to FIG. 32 for other examples of the sequential operation of the control valves as the target flow $F_T$ increases and decreases.

PRESSURE CORRECTION

Referring now to FIG. 23A, which together with FIG. 23B is a flow chart of the valve management system in general. A pressure correction factor calculation referred to as block 3010 corrects for any changes in the temperature and pressure of the incoming steam. The pressure correction calculations also include a deadband calculation which provide a safety measure; and also acts as a filter for noise. Without a deadband, small changes in the data due to noise typically from transducers, etc. would change the position of the valve and thereby cause unnecessary roughness in the operation of the turbine system and the output power therefrom. In addition, the governor or control valves would wear at a faster rate thereby requiring earlier maintenance.

Figure 27:
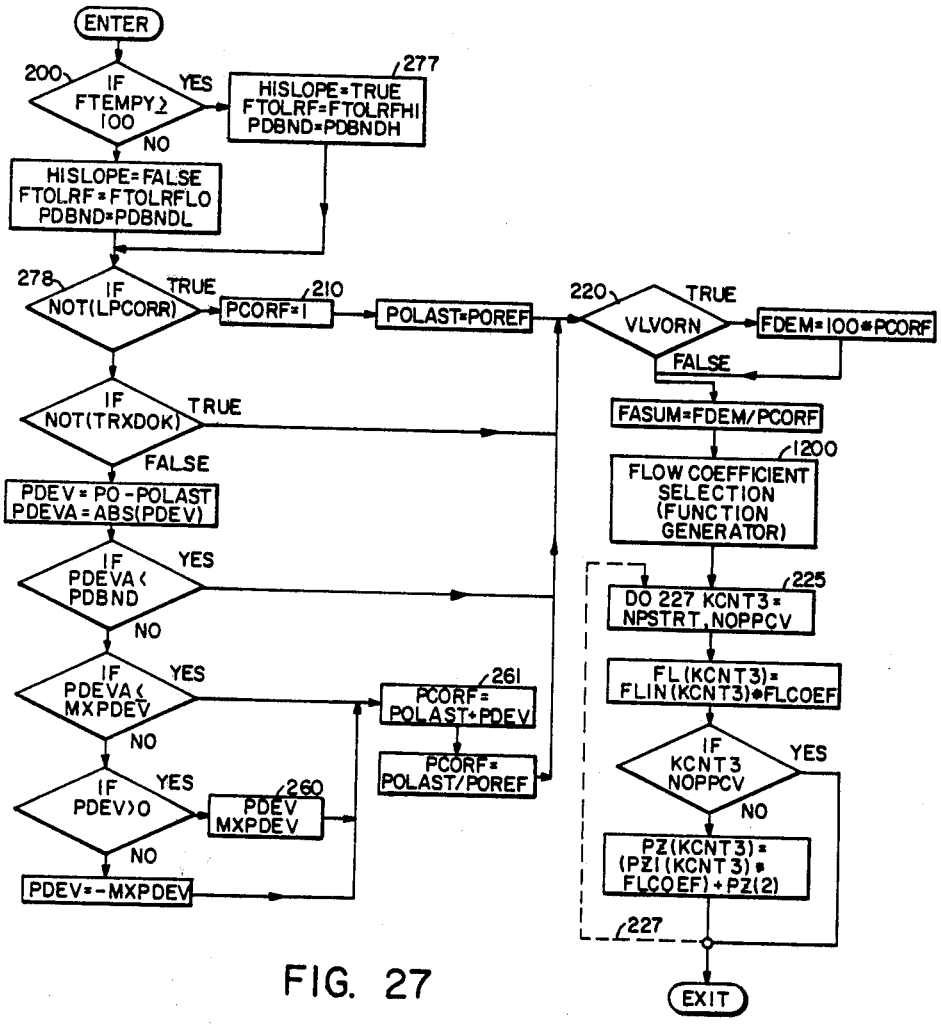
FIG. 27 shows a flow chart of the first stage flow coefficient function generator program in accordance with the present invention.
Figure 34:
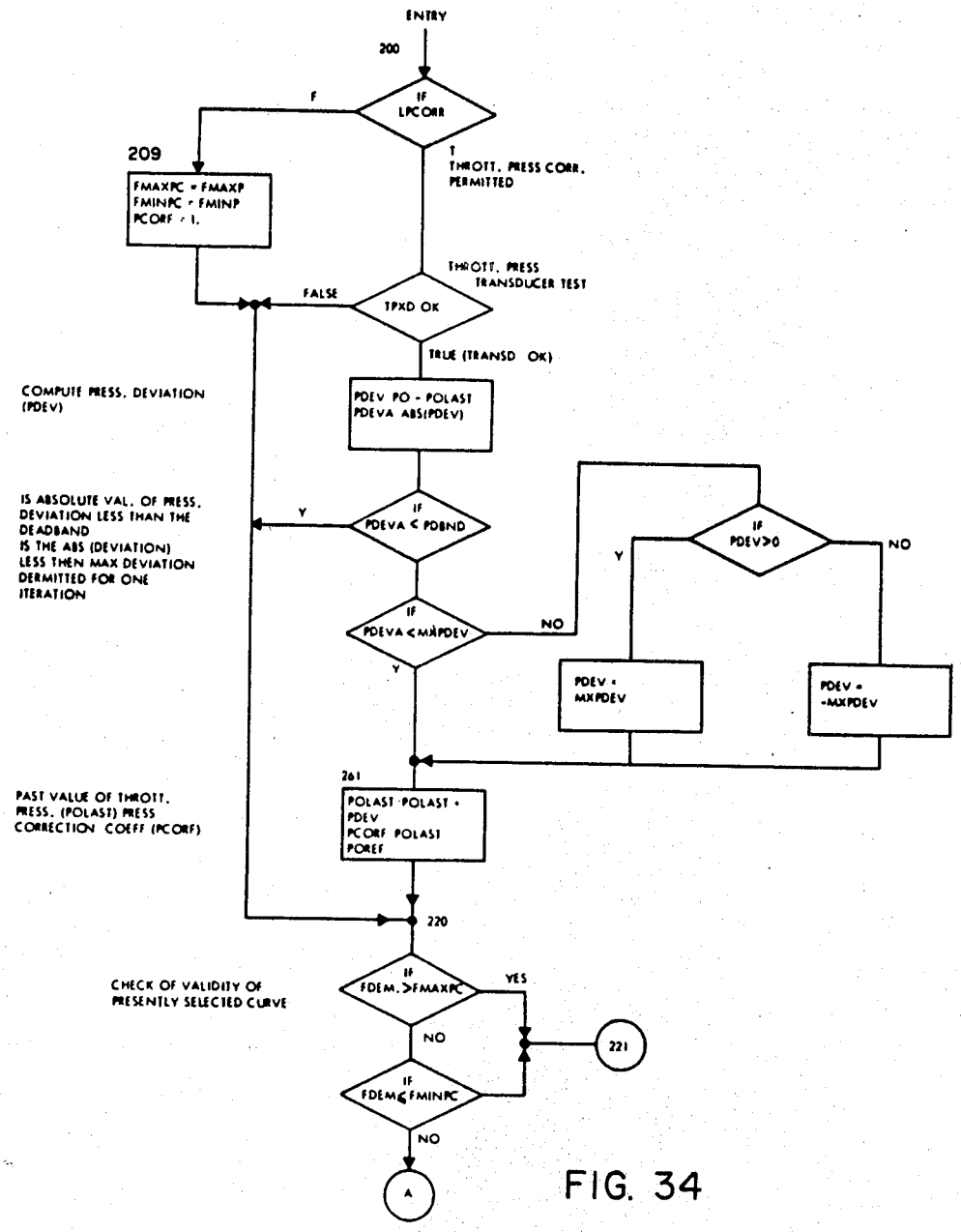
FIGS. 34 and 35 show a flow chart of a program for valve curve selection in accordance with the principles of the invention.
Figure 35:
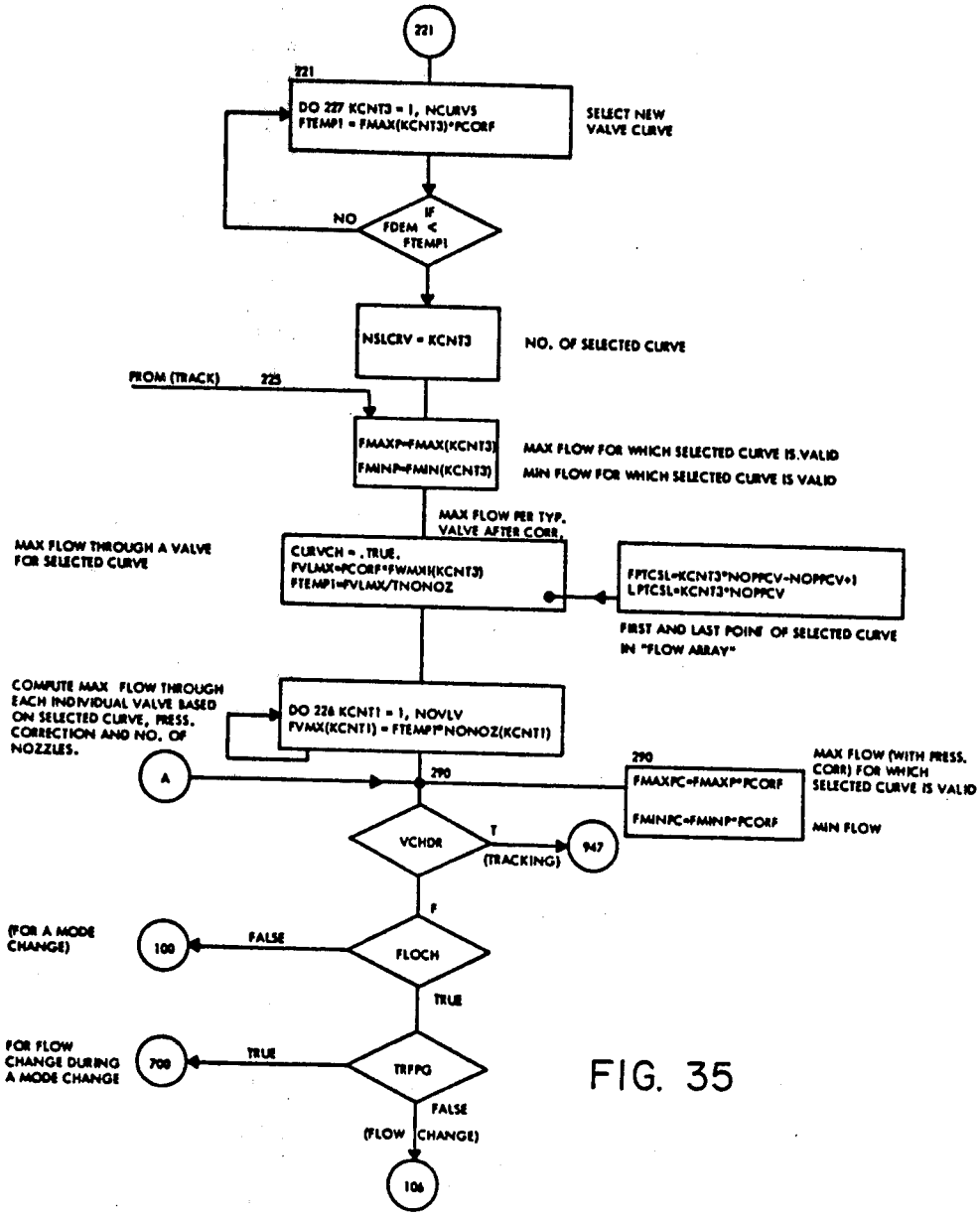

In addition, the pressure correction factor calculations 3010 include a limitation of rate of change. Therefore, should the throttle pressure or any other pressure, which is being utilized, change very rapidly, the correction for such a pressure change would be limited to a predetermined maximum rate of change. If the throttle flow correction transducer, not shown, and referred to in decision block TPXD OK is inoperative, the throttle pressure correction may be completely ignored and a normal throttle pressure correction factor of one as shown in block 209 of FIG. 34 is used. Under certain conditions of operations, stability is increased by the use of a throttle pressure correction factor of one. Under normal operation, however, the throttle correction factor forms a way of reducing errors in the flow demand signal through the turbine system. When the throttle pressure transducer is in service, a correction factor is computed as shown by the blocks associated with the appropriate descriptive legend of FIG. 27 or FIG. 34. The deviation in throttle pressure PDEVA which is considered in each iteration is limited to a maximum (MXPDEV) in order to prevent sudden changes in the valve positions through calculations and large changes along the control or governor valve curve data. As an alternative, if the throttle pressure transducer is out of service, the pressure correction factor PCORF, is kept at its last computed value POLAST as shown in FIG. 27. When the throttle pressure transducer is put back in service, the signals therefrom are only used if one of the feedback loops is in service, which provides the necessary computation for the effect of valve curve correction. FIGS. 35 and 43B are referenced for a more detailed understanding.

In computing desired valve flows in the single valve or full arc admission mode, the target flows are computed by dividing the total flow demand by the number of control or governor valves GV1 through GV8. The valves are positioned according to individual valve flow demand. In the sequential valve mode, the flow demand is divided by the maximum flow of each control or governor valves GV1–GV8 for the total flow demand whereby a whole number and a fraction result. The whole number represents the number of valves fully open in sequential valve operation; and the leftover fraction determines the flow demand of the valve which is partially open and controlling the flow of the fluid through the turbine.

Figure 24:
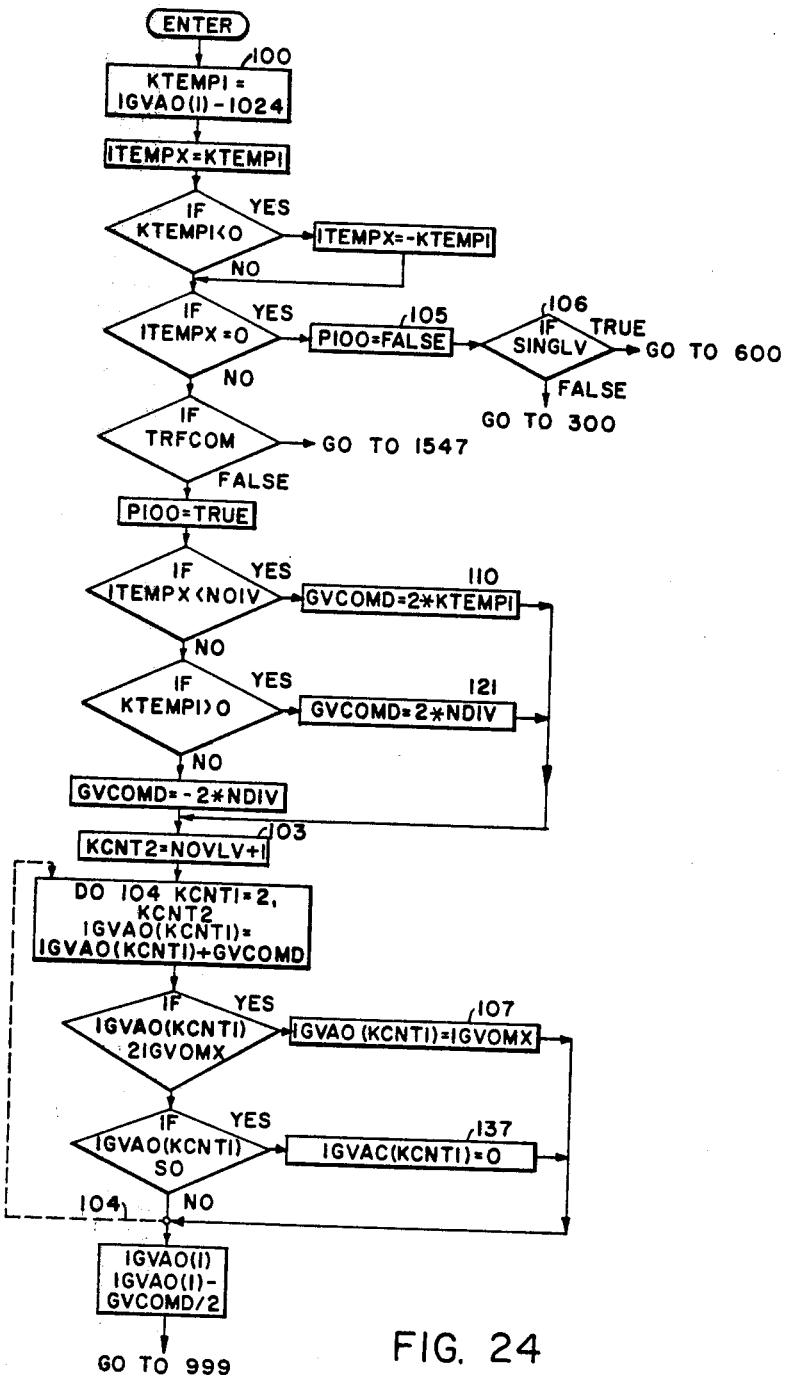
FIG. 24 shows a flow chart of a program for transfer between common analog outputs to individual analog outputs to initiate a transfer from single to sequential valve operation in accordance with the present invention.
Figure 36:
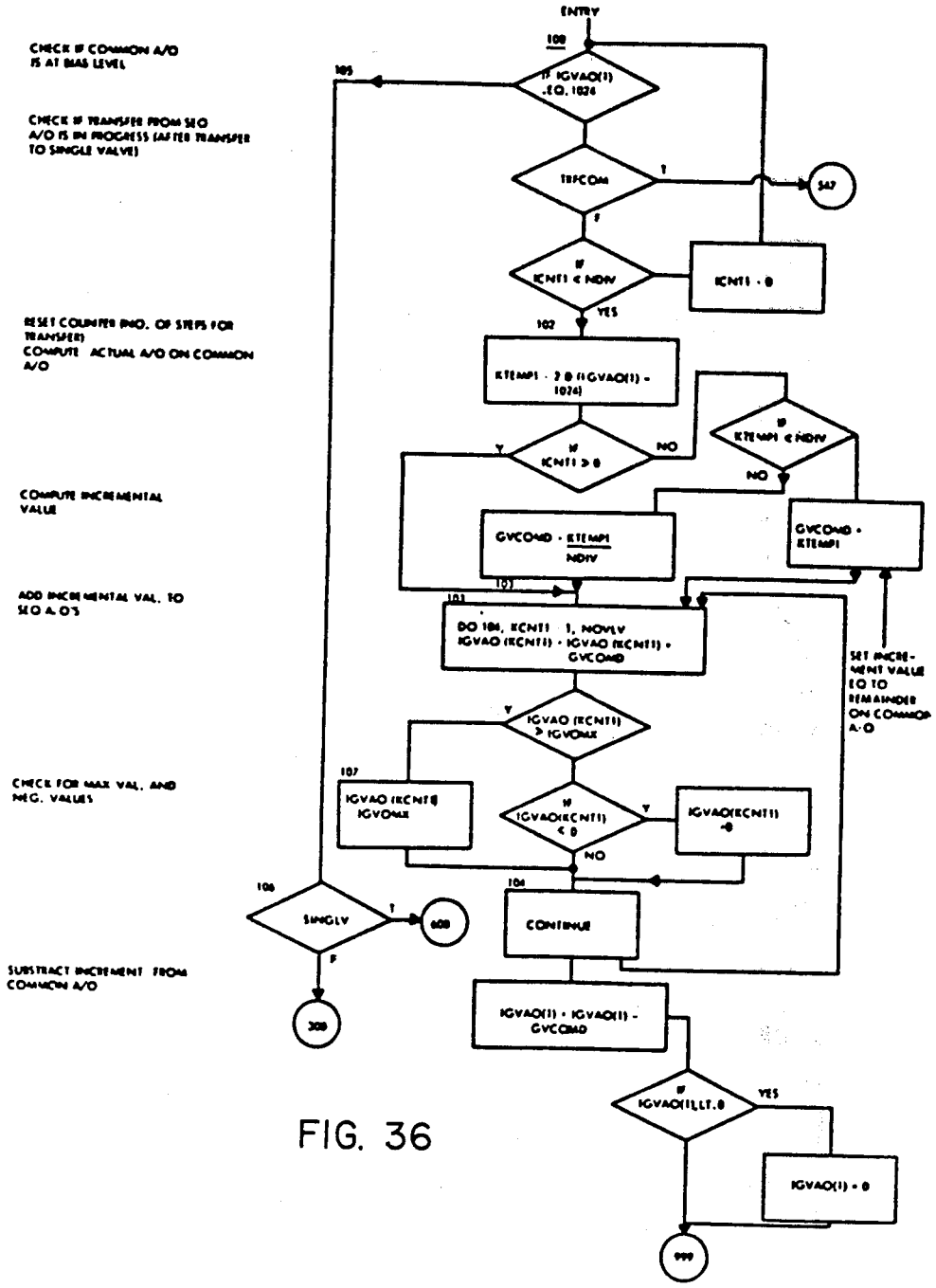
FIG. 36 shows a subroutine for the transfer of the contents of the common A/O to individual A/O's in accordance with the principles of the invention.

Reference is made now to FIGS. 24 and 36 which include a program for the transducer of the contents of the common analog outputs to the individual analog outputs, and to FIG. 5, which shows the electronic circuitry and system of the analog outputs. Transfer between the single valve mode and the sequential valve mode is made from the common analog output system 520 as shown in FIG. 5 to the individual analog outputs such as 521*a*, 521*b*, and 521*c*. When all the valves work together as in the single valve mode, a common analog output regulates the position of all of the governor or control valves GV1–GV8. Before a transfer can be initiated to sequential valve operation, the individual analog outputs 521*a*, 521*b*, and 521*c*, connected to each respective governor or control valves GV1–GV8 are adjusted to a value equivalent to the value in the common analog output 520. After the transfer of the contents of the common analog output 520 to the individual analog outputs 521*a*, 521*b*, and 521*c* the valve management program is ready to initiate a transfer to the sequential valve mode. The mechanics of the transfer between the common analog output and the individual analog output is included in detail in FIG. 5, but forms no part of the present invention and is described in Braytenbah U.S. Pat. Nos. 3,741,246 and 3,891,344. The subroutine as shown in FIG. 24 or for the transfer of contents of the common analog outputs to the individual analog outputs first checks whether there is any data in the common analog outputs 520 other than a pre-set bias value. If there is data in the common analog outputs 520, the value therein is transferred from the common analog output to the individual analog outputs in a predetermined number of steps (MDIV) without any change in the total analog output settings for the control valves. The subroutine for the transfer of the contents checks the contents of the individual analog output to assure that the maximum value is equal to the maximum allowed for the digital to analog converters described in detail in U.S. Pat. No. 3,741,246.

Figure 25:
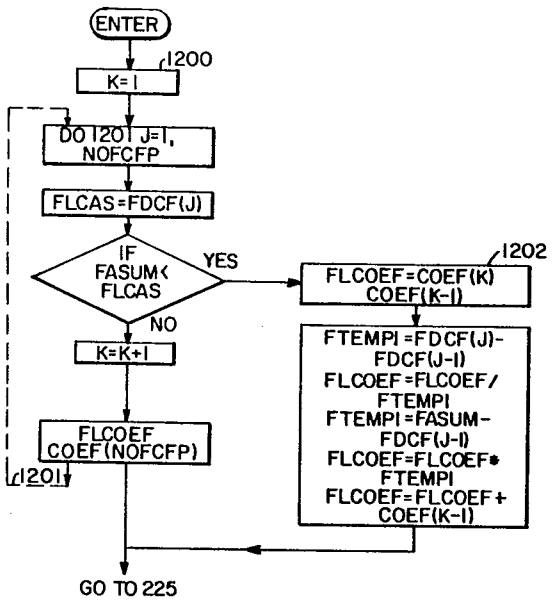
FIG. 25 includes a flow chart calculation of first stage flow coefficient vs. percentage of total flow in accordance with the present invention.

Referring now to FIG. 25, a subroutine for calculation of the flow coefficient function includes the mathematical representation of the stage flow coefficient versus percentage flow graph shown in FIG. 21.

Figure 26:
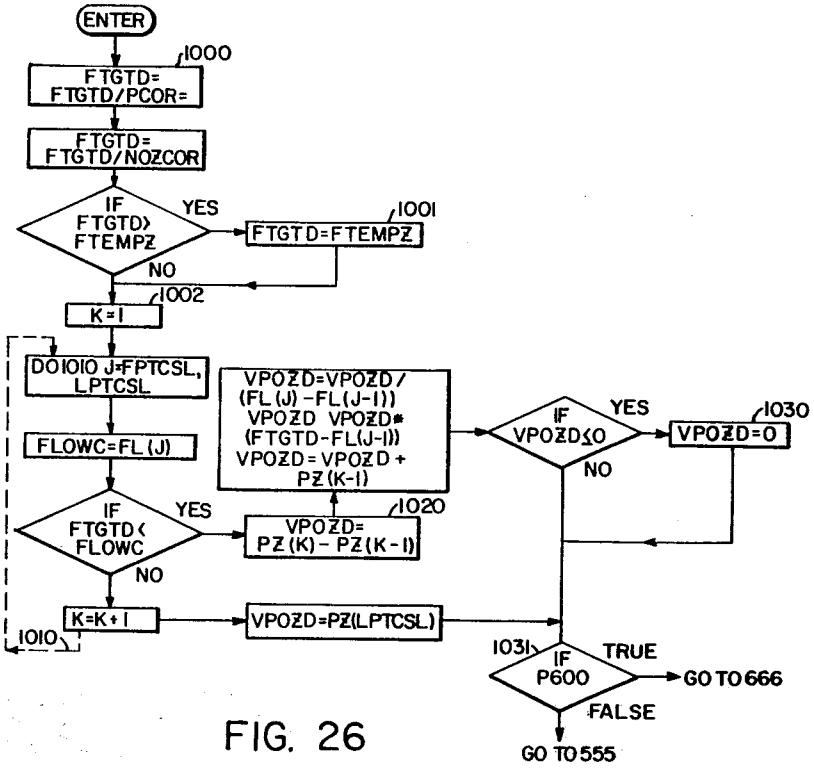
FIG. 26 shows a flow chart of a subroutine for calculation of the functions of valve curves in accordance with the present invention.

Reference is made to the subroutine for the calculation of the functions of the valve curves used in the governor or control valve GV1–GV8 movements shown in FIG. 26, which includes the mathematical representation for the calculation of the data represented by the valve lift versus total flow demand family of curves shown in FIG. 22. This valve curve GV function generator subroutine generates data representing the characteristics of the control or governor valves GV1–GV8 as functions of the total flow demand.

In FIG. 27 the flow coefficient function generator of FIG. 25 and the valve curve function generator subroutine of FIG. 26 are incorporated in a valve curve selection subroutine. The valve curve selection subroutine of FIG. 26 checks the throttle pressure and compensates for any changes above or below a standard pressure. In addition, the selection subroutine selects the proper flow coefficients from the flow coefficient subroutine of FIG. 25, and takes the interpolation of the valve curve function generator subroutine of FIG. 26, and computes the valve positions taking into account the actual conditions in the steam turbine system whereby a total flow can be determined.

FLOW CHANGES

Referring to FIG. 23B, a flow change logic calculation referred to as block 3012 insures that any changes in flow demand are executed even during a mode transfer. Therefore, if the DEH System 1100 request a change in flow demand during a mode transfer, the mode transfer is interrupted momentarily and the valves are changed in accordance with the flow change.

Figure 37:
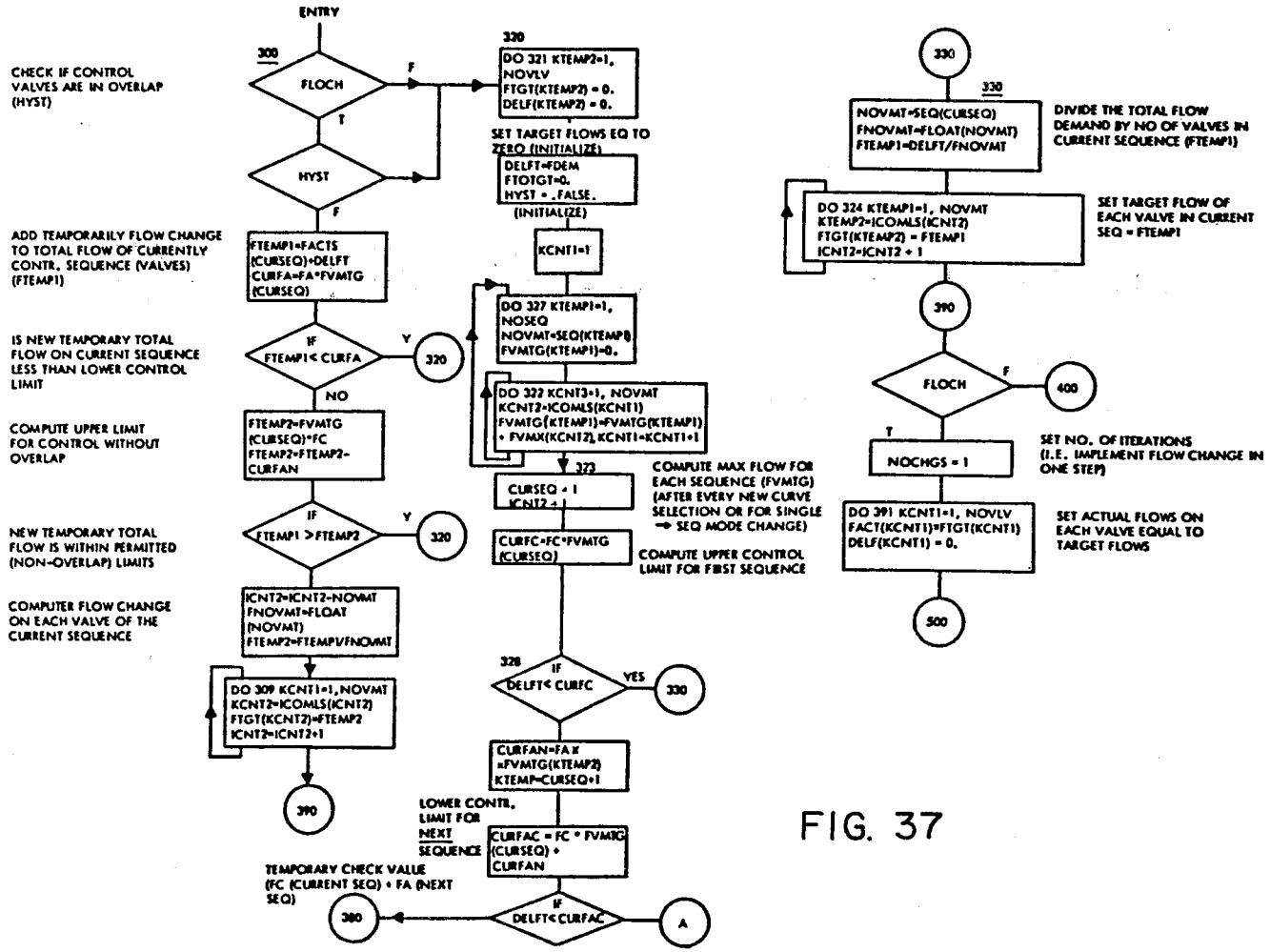
FIGS. 37 and 38 show flow charts of a subroutine for the computation of target flow changes in the sequential operating mode in accordance with the principles of the invention.
Figure 38:
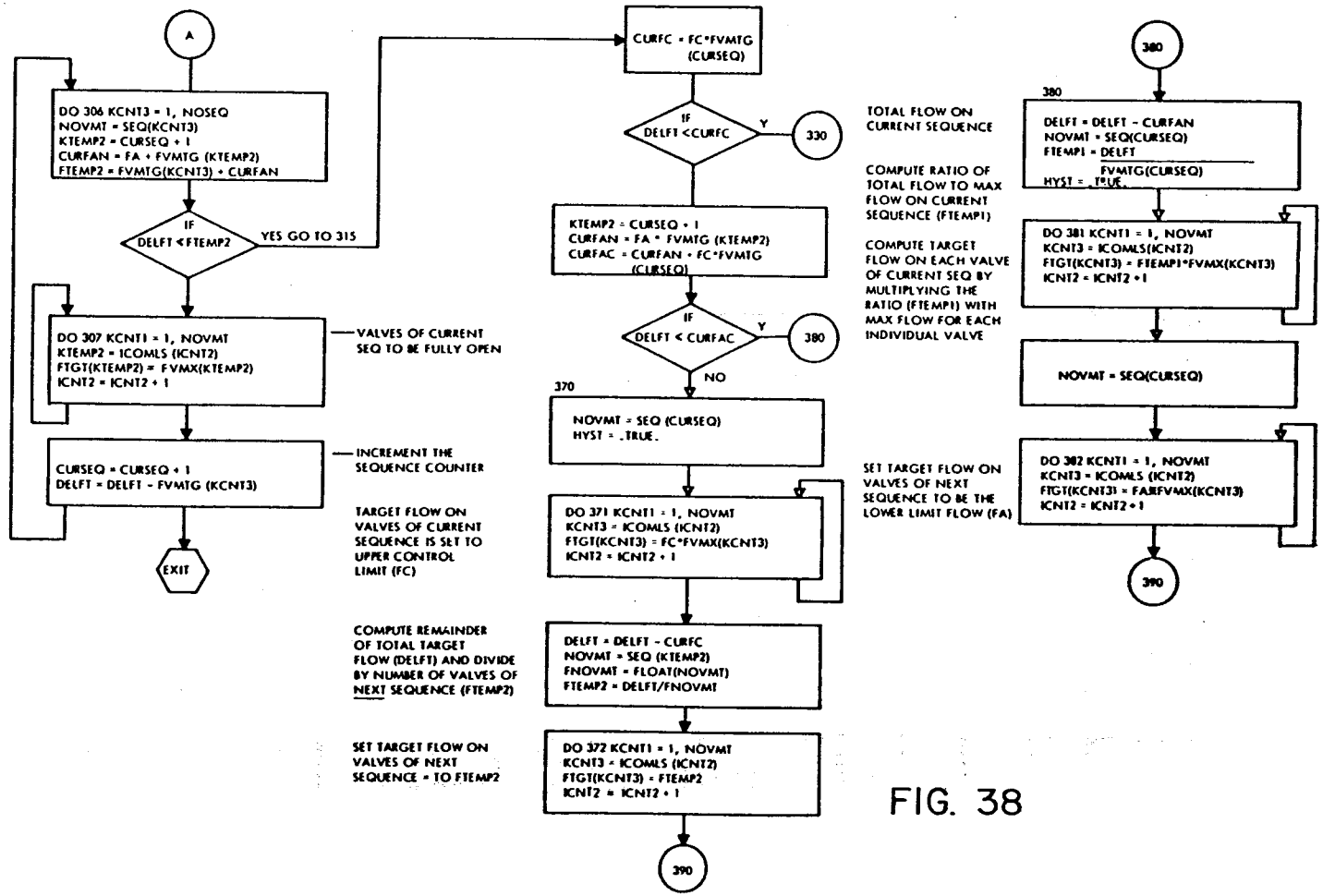

Referring to FIGS. 37 and 38, the subroutine for computation of target flow changes in the sequential mode is entered into when a mode change from single valve operation to sequential valve operation is initiated, or when a flow change is requested while operating in the sequential valve mode; and includes valve overlap or hysteresis heretofore described. The points $F_C$ and $F_A$ are those referred to in FIG. 32 where $F_A$ is the lower limit of the control zone and $F_C$ is the upper limit of the control zone of the governor or control valve. Both $F_C$ and $F_A$ may be expressed as "per unit" or other convenient values such as percentage of maximum flow.

In the computation of a flow change during a mode change, there are several paths which can be taken. A total flow demand which is less than the $F_C$ point as indicated in FIG. 32 of the first sequence referred to as valve I, in which case the total flow is divided equally among the valves I of the first sequence (see 330 of FIGS. 37 and 38). An alternative would be that the total flow demand being greater than that at the $F_C$ of the current sequence plus $F_A$ point of the next sequence referred to as valve I+1 in FIG. 32 in which case the target flow on the current sequence is fixed at the $F_C$ point, and the valve of the next sequence becomes the controlling valve (see 370 of FIG. 38). The third possibility would be that the total flow demand is less than the $F_C$ point of the current sequence plus the $F_C$ point of the next sequence. In this case the total flow on this next sequence is fixed at the $F_A$ point and the valve of the current sequence remain the controlling valve (see 380 of FIGS. 37 and 38). Yet another path would be when the flow demand is greater than the maximum flow of the current sequence plus the $F_A$ point of the next sequence, then the target flow of the current sequence is equal to the maximum flow and the next sequence becomes the controlling sequence.

Figure 28:
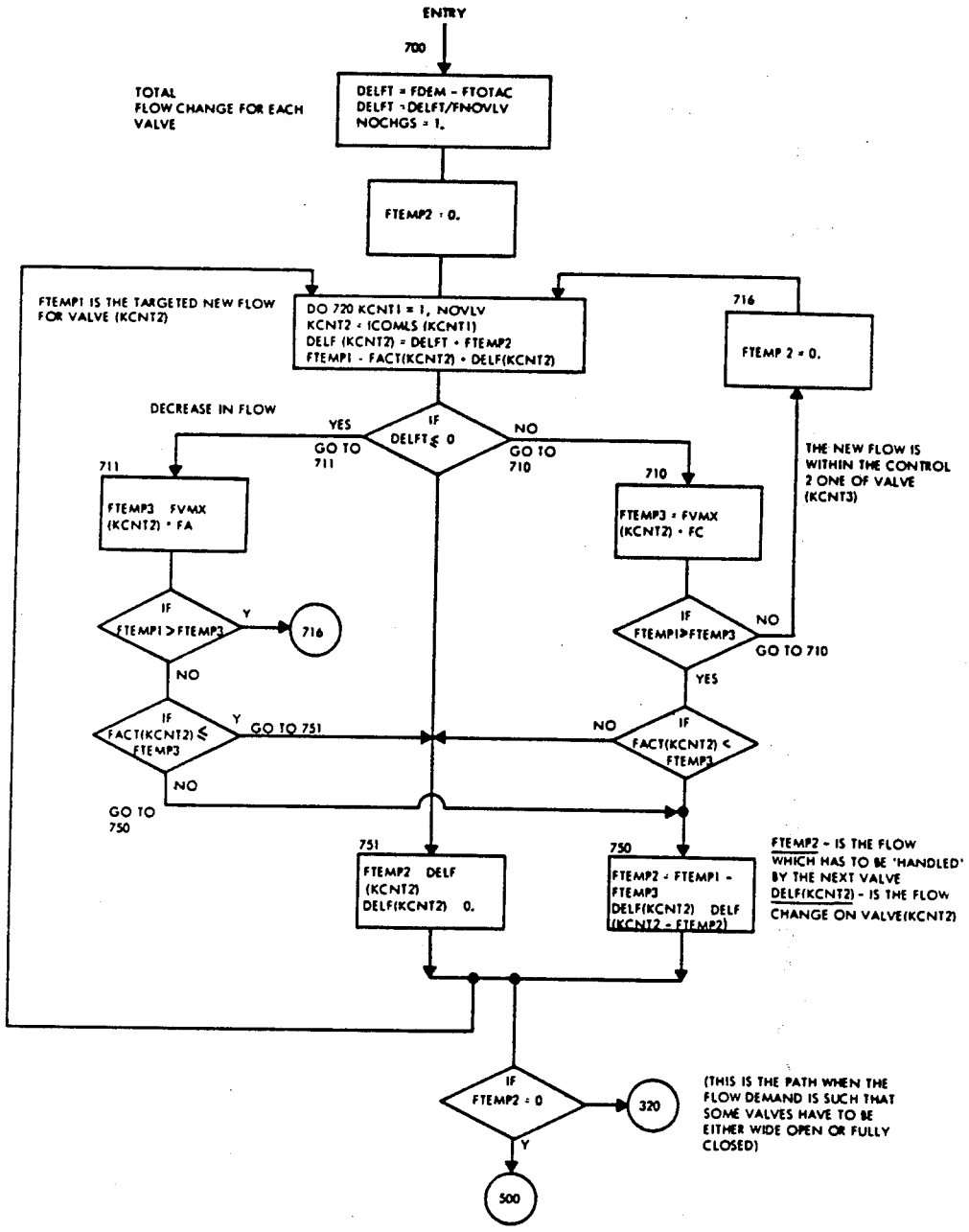
FIG. 28 shows a flow chart for flow change calculations in the sequential mode program in accordance with the present invention.

Referring now to FIG. 28 one of the basic requirements of the valve management program is seen, that is, to allow the response to a flow change during a mode change. In a mode change the control valves are in the middle of a transfer. The flow change demand is divided among the valves so that the steam flow through the turbine is held relatively constant. The only changes in the flow will be caused by tolerance errors in the data generating the curves. The flow change is divided among the valves with the restriction that none of the valves should be positioned in the overlapping or non-control zones. When one of the valves does not meet this requirement, the flow change on that valve is reduced and the difference is added to the flow change computed for the next valve and so on, etc. If a valve is in this condition the program jumps to point 320 in FIG. 28 and all the target flows are recomputed whereupon the change in flow is implemented.

Figure 39:
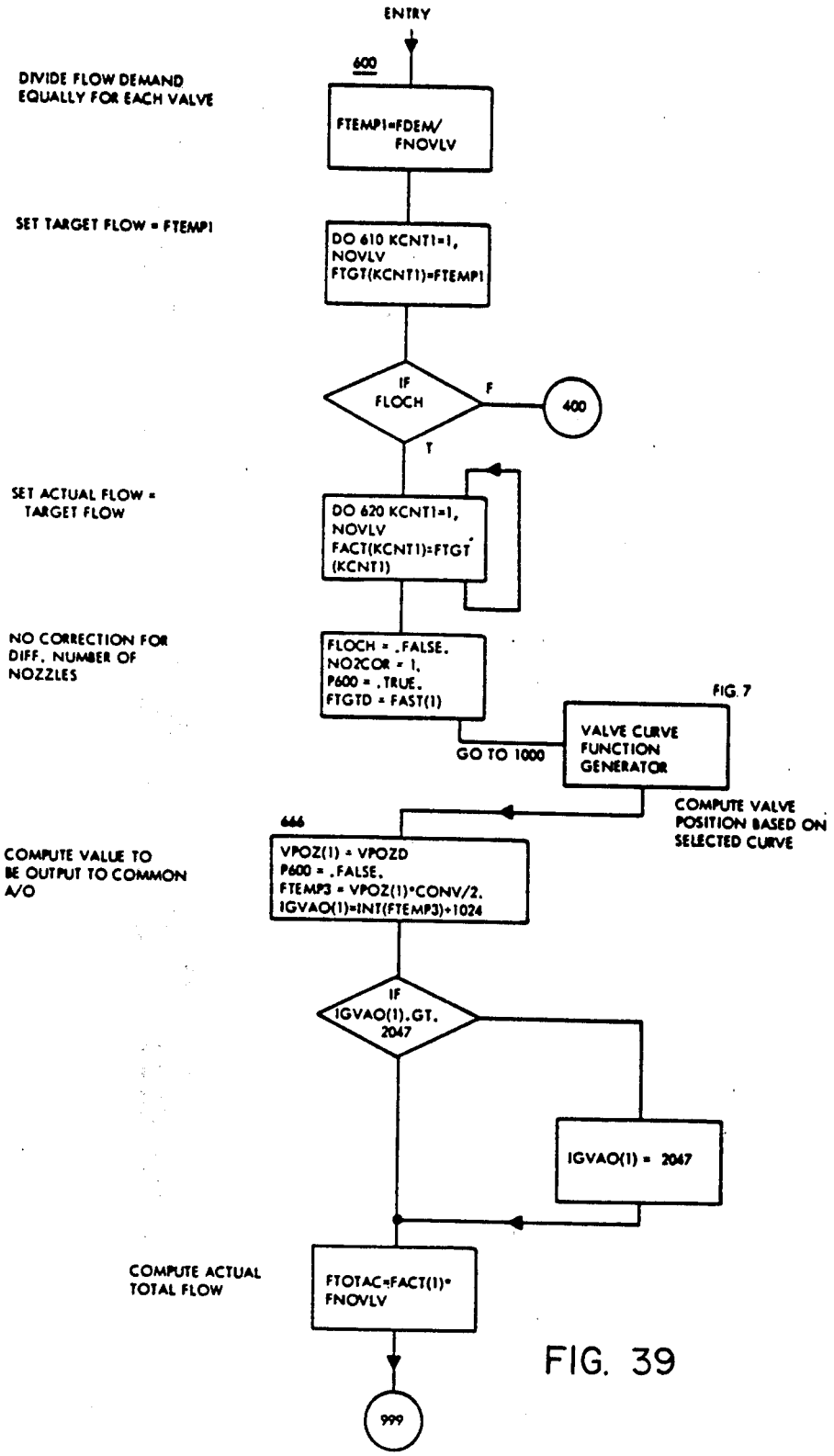
FIG. 39 shows a program for the computation of target flow for transfer from sequential to the single valve operating mode in accordance with the principles of the invention.

The change in flow through the governor or control valves is implemented in the control valve or valves which are currently in control in the sequential mode. A program sequence as shown in FIG. 37 is followed which provides for the following conditions to be met, i.e., the control valves are not in an overlap mode HYST=FALSE, or the flow change DELFT will not cause the valves to go into an overlap mode. If one of these conditions are not met, the program paths to be executed are either 330, 370, or 380 as shown in FIGS. 37 and 38, which are those used during a mode change as previously described. Referring to FIG. 39, a subroutine for computation of target flows for a transfer from sequential to single mode is shown. This routine has two purposes, i.e. to compute the new tartet flows FTGT for the transfer from the sequential to the single valve mode; and to compute the actual valve position for a flow change after the transfer to the single valve mode has been completed. The computation of the target flows FTGT for a mode change is done by dividing the total flow demand FDEM by the number of control valves FNOVLV. If a flow change is demanded when the valves are already in the single mode, the target flow becomes the actual flow since all the valves move together and there is no problem with either overlap or hysteresis. The valve position is computed using the function generator program of FIG. 26 for a selected curve thereby producing a new actual flow for each and every valve. The new position VPOZD is output to the common analog output GVAO(1) after a necessary conversion of units and scale.

Figure 29:
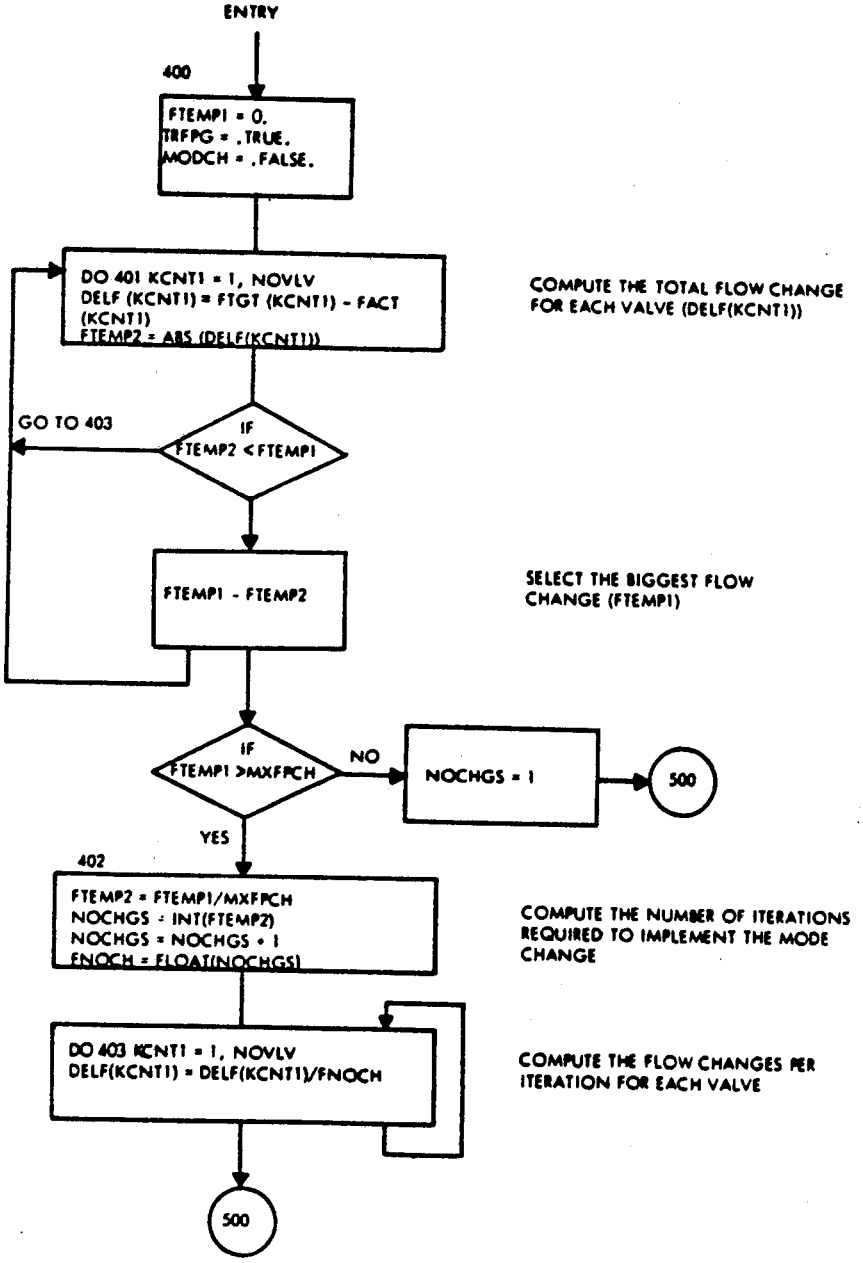
FIG. 29 shows a calculation for determining a number of incremental changes of flow and valve lift position in accordance with the present invention.
Figure 30:
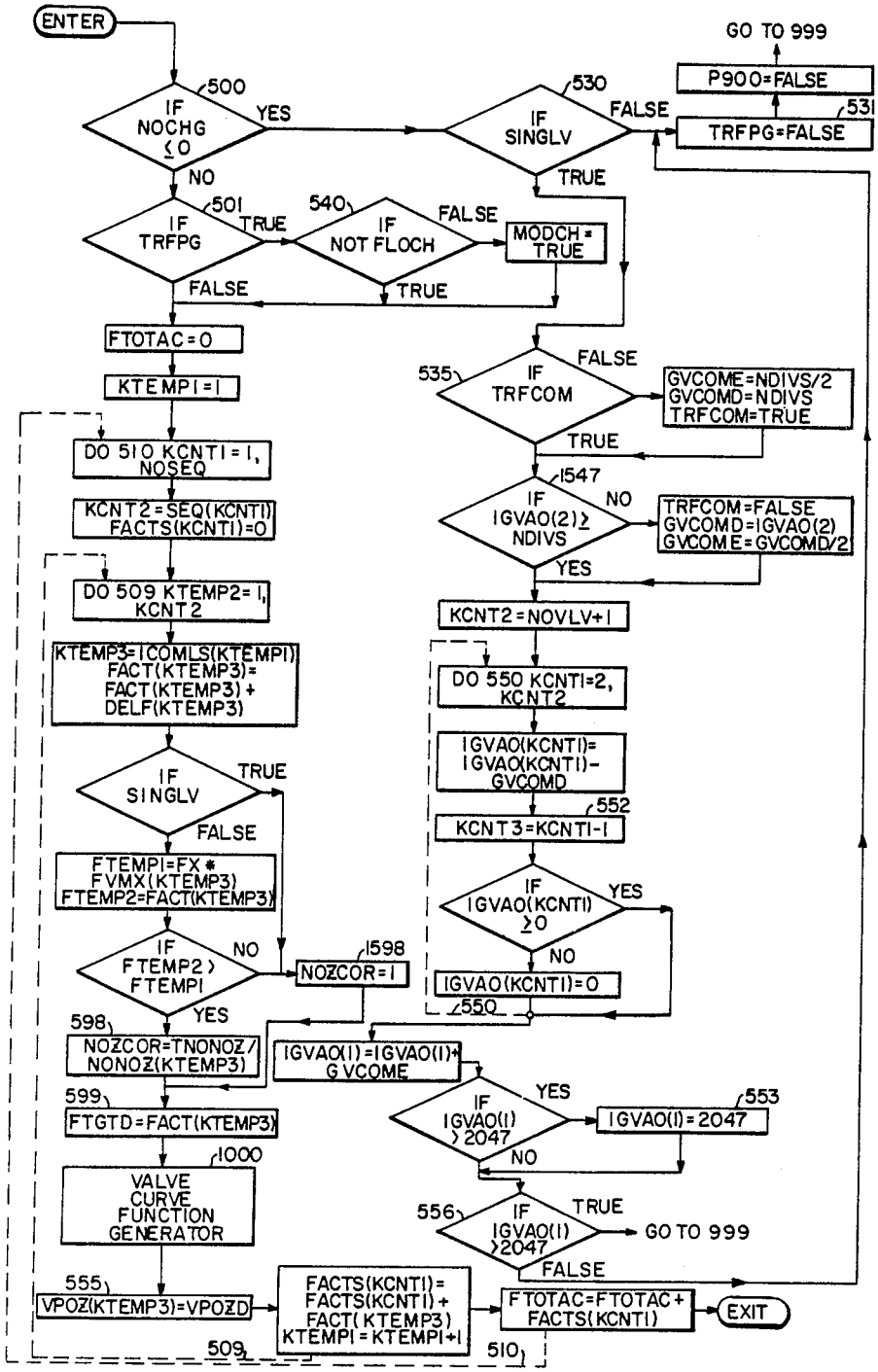
FIG. 30 shows a flow chart of a program for computing incrementally changing valve lift positions during a mode change in accordance with the principles of the invention.
Figure 41:
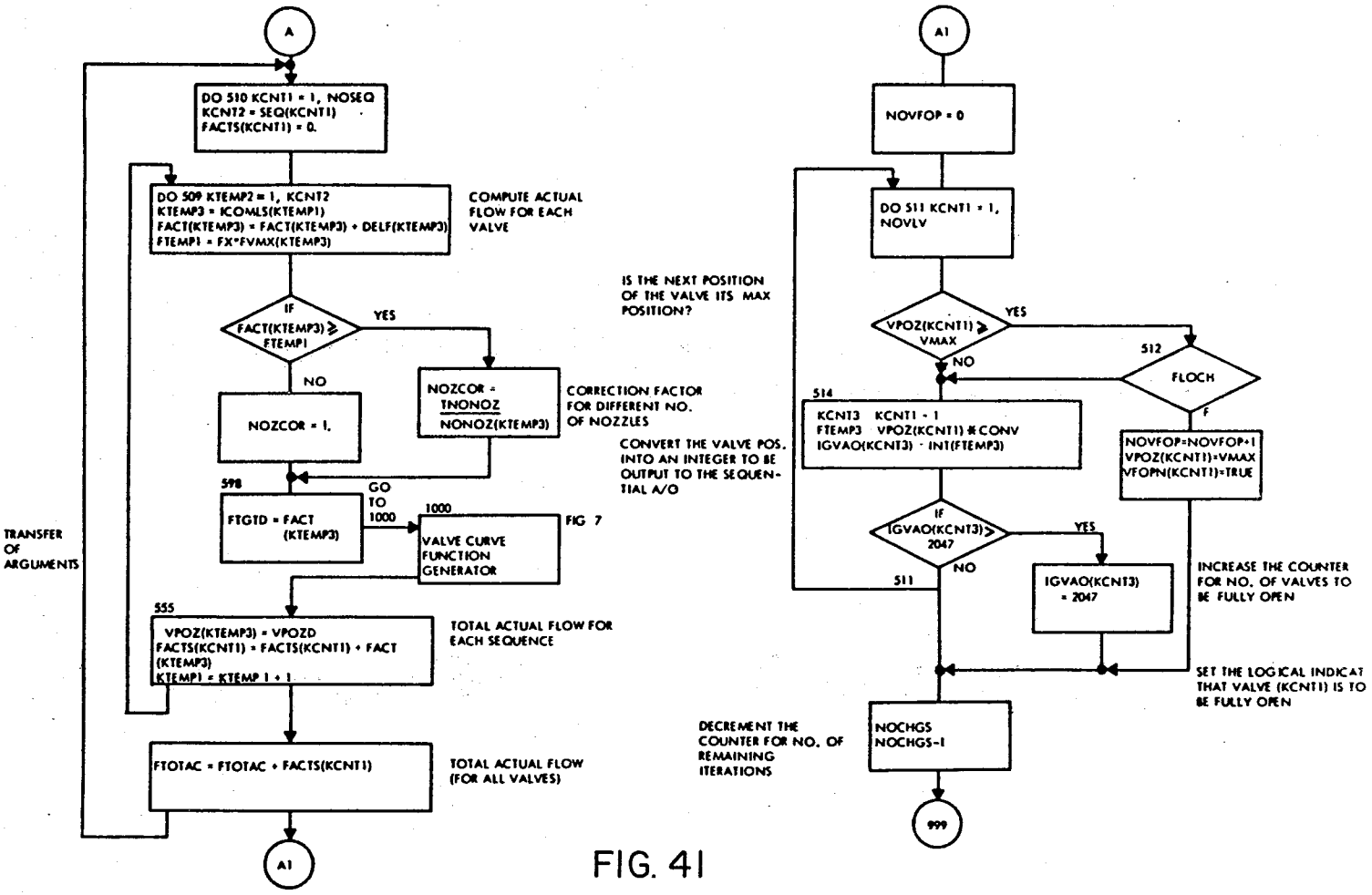

FIG. 29 shows the calculation for determining and executing a number of incremental changes in flow and associated valve position for each governor valve GV during a mode change. In a mode change between single and sequential valve operation, the flow of steam through the turbine system should preferably remain essentially constant. In this subroutine the total flow change for each control valve is calculated, and then the greatest flow change FTEMP1 for any of the governor valves is determined. The maximum flow change FTEMP1 thus determined is then divided by a predetermined maximum allowable flow change MXFPCH which then determines the number of incremental flow changes NOCHGS required for a mode transfer. The total flow change DELF for each governor valve is divided by the determined number of incremental flow changes FNOCH. Thereupon, during a mode change, each governor valve GV moves through a equal number of incremental flow change steps. This subroutine for the selection of the incremental flow change steps for each governor valve is also utilized during a change from the manual or emergency mode, where the governor valves GV1–GV8 may be in any random series of locations, to either the single valve mode or the sequential valve mode. It is within the teaching of this invention that the subroutine can be used within any mode changes. By using this method any flow variations which may occur during a mode change are given priority. This method for computation of flow changes during a mode change also insures compliance with the requirements that no flow change may occur as a result of the mode change. The incremental flow changes DELF calculated in FIG. 29 are translated into governor valve positions in the subroutine as shown in FIG. 30.

Where a number of valves operate in a single mode or the sequential mode in low load ranges, there is a possibility that the governor or control valves opening fully at the same time could cause a relatively large incremental change in load. In order to minimize any shock that would occur, the valve management program has logic operations which delay the command for full opening of each valve as shown in FIG. 41. The time delays for each of the governor or control valves are different therefore staggering their full opening and preventing a simultaneous full opening.

In FIGS. 34 and 35, the valve curve selection program which is initiated every time a mode change or a flow change is indicated by the respective function (MODCH is equal to TRUE) or (FLOWCH equals TRUE). The (see FIG. 23A) valve curve selection subroutine 200 performs the function of correcting the data representing the valve curves shown in FIG. 22 to conform with changes in throttle pressure, and selecting a valve curve in accordance with an alternate embodiment based on the total flow demand through the turbine and computing the maximum flow for each valve based on the selected curve and corrected for the number of nozzles.

A total flow demand FDEM is compared with (FMAXPC and FMINPC) as shown in FIG. 34 for selecting the new curve (see 221 of FIG. 35).

Figure 40:
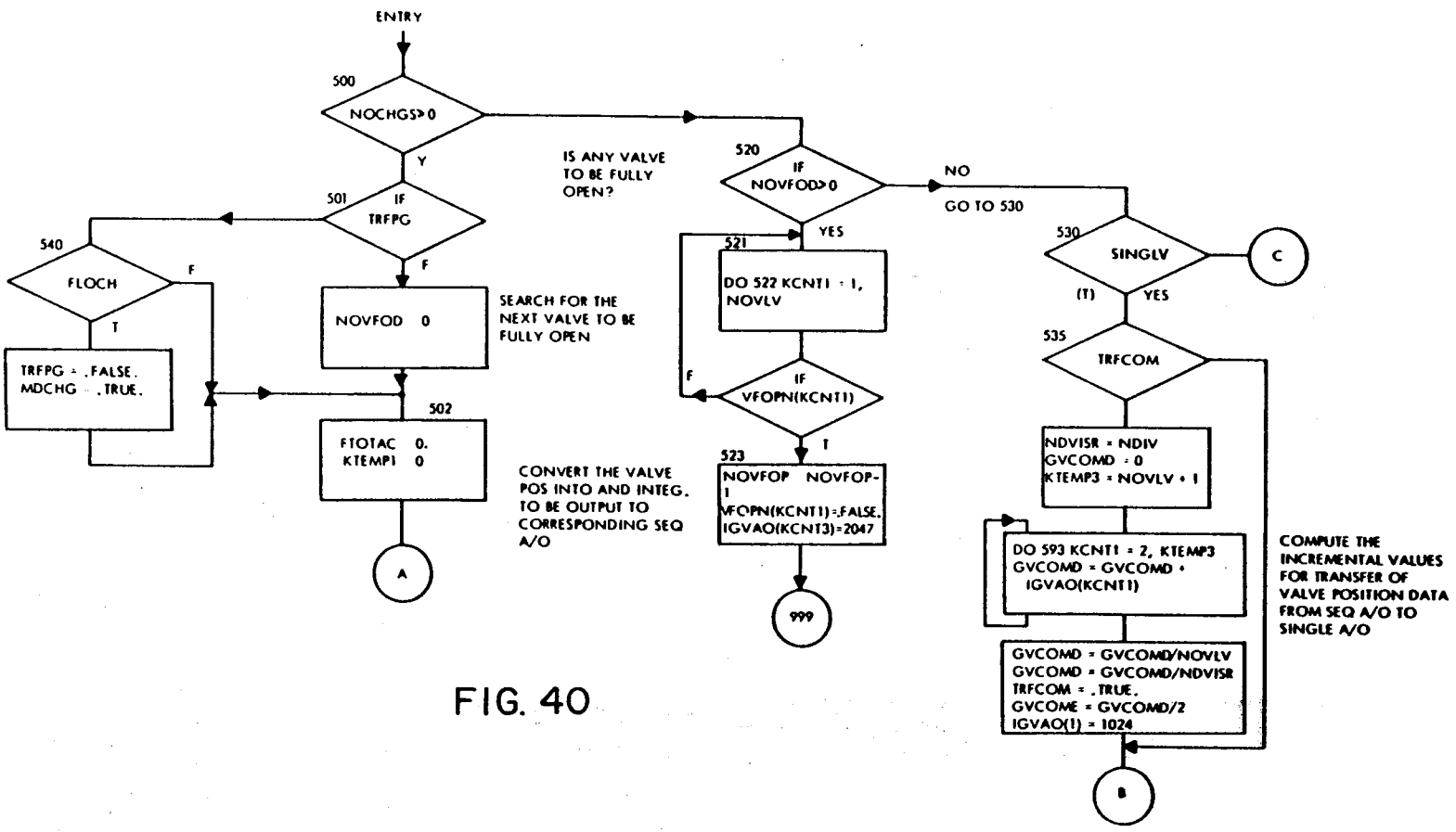
FIGS. 40, 41 and 42 show a subroutine for computation of governor valve flow changes and position in accordance with the principles of the invention.
Figure 42:
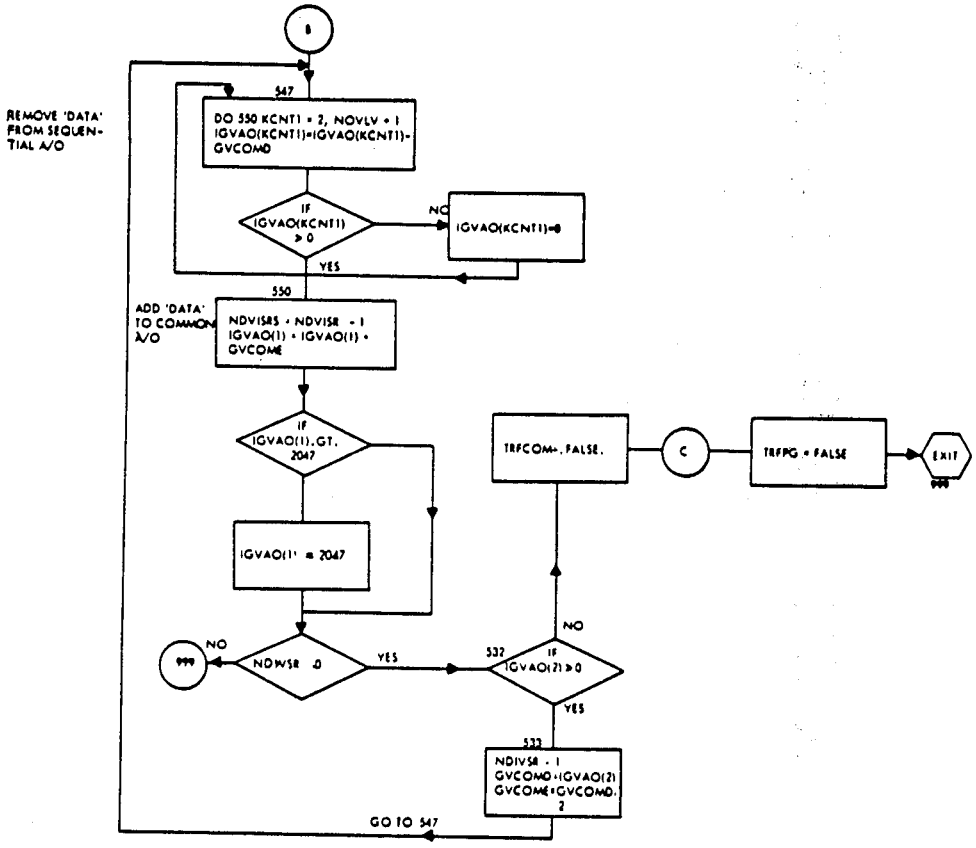

If the total flow demand exceeds the validity limits of the presently selected valve curve, (FMAXPC and FMINPC), a new curve is selected by the valve curve selection subroutine. Based on the selection of the new data representing the valve curve the following are calculated for each value, the maximum flow (FVMX), the first and last point for selecting the present curve in the flow array (FPTCSL and LPTCSL), the correction for the number of nozzles NONOZ, and the correction for the throttle pressure setting PCORF. A subroutine for computation of valve positions is shown in consolidated form of FIG. 30 and in separate modified form in FIGS. 40, 41, and 42. The actual flow of steam through each control or governor valve and the corresponding valve position or lift is herein computed. If during the manual operation of the turbine, the control or governor valves have been left in a variety of seemingly random positions, the subroutine for the computation of valve positions insures that a reinitialization of the mode change subroutines will be completed. Also, as during the case of flow change during a mode change between either the manual, single valve or sequential valve modes, the initialing computed values of valve position or lift become invalid. Therefore, new valve positions must be computed. Initially, the new actual flow is computed by adding the incremental flow change to the old or initial actual flow. The new valve positions are computed by either selecting or computing a proper curve through the function generator subprogram as previously described. A correction fact for variation in the number of nozzles under each valve is then introduced. For flows under a preselected value of maximum flow per valve, the correction factor is set to one. For flows above this ratio the nozzles are considered to be in critical flow; and another ratio is computed between the typical number of nozzles and the actual number of nozzles for the respective control valves. The actual flow is computed by adding the actual flow through each valve with the initial flow. The new output value thus obtained is outputted to the new position data in an analog output table where the new position of the valve is determined. In addition, stagger paths are included in order to insure that only not one valve will open fully during any one iteration. During the iterations following a mode change a search is made for the next valve to be fully opened and the analog output data corresponding to a fully open position. The stagger path is executed as many times as is required in order to open all the required valves in a particular sequence.

After a transfer from sequential to single valve mode the data contained in the sequential analog output are transferred to the common analog output which is the opposite sequence of what occurs during a transfer from the single valve mode to the sequential valve mode.

Figure 31:
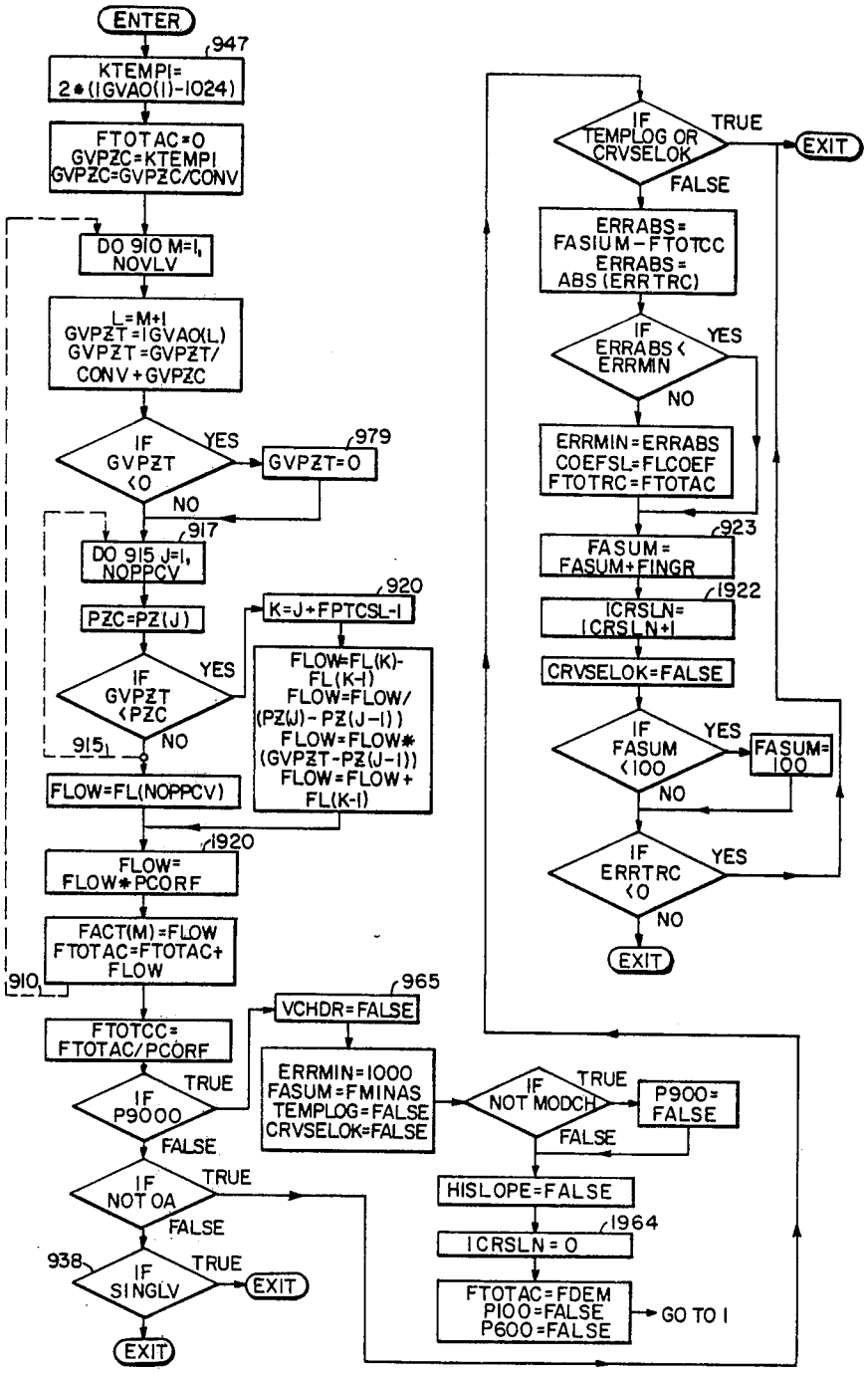
FIG. 31 shows a flow chart of a subroutine for computing actual flow values after a manual or emergency condition whereupon a connected curve of FIG. 22 is determined in accordance with the principles of the invention.

In FIG. 31, a subroutine for computing actual flow values after a manual or emergency condition is shown. During a manual or emergency condition the governor valves GV1–GV8 may be left in random positions by an operator and therefore require repositioning. The subroutine of FIG. 31 calculates the desired valve positions dependent upon the flow demand. Just as in the case of the other mode changes, a maximum flow change is calculated for each valve, then this maximum flow change is divided by a maximum allowable flow change, thereby obtaining the number of iterations required for a change from the manual or emergency conditions to one of the automatic operating modes. As in the other mode changes supra any change in flow demand will take precedence over a mode change.

Figure 43A:
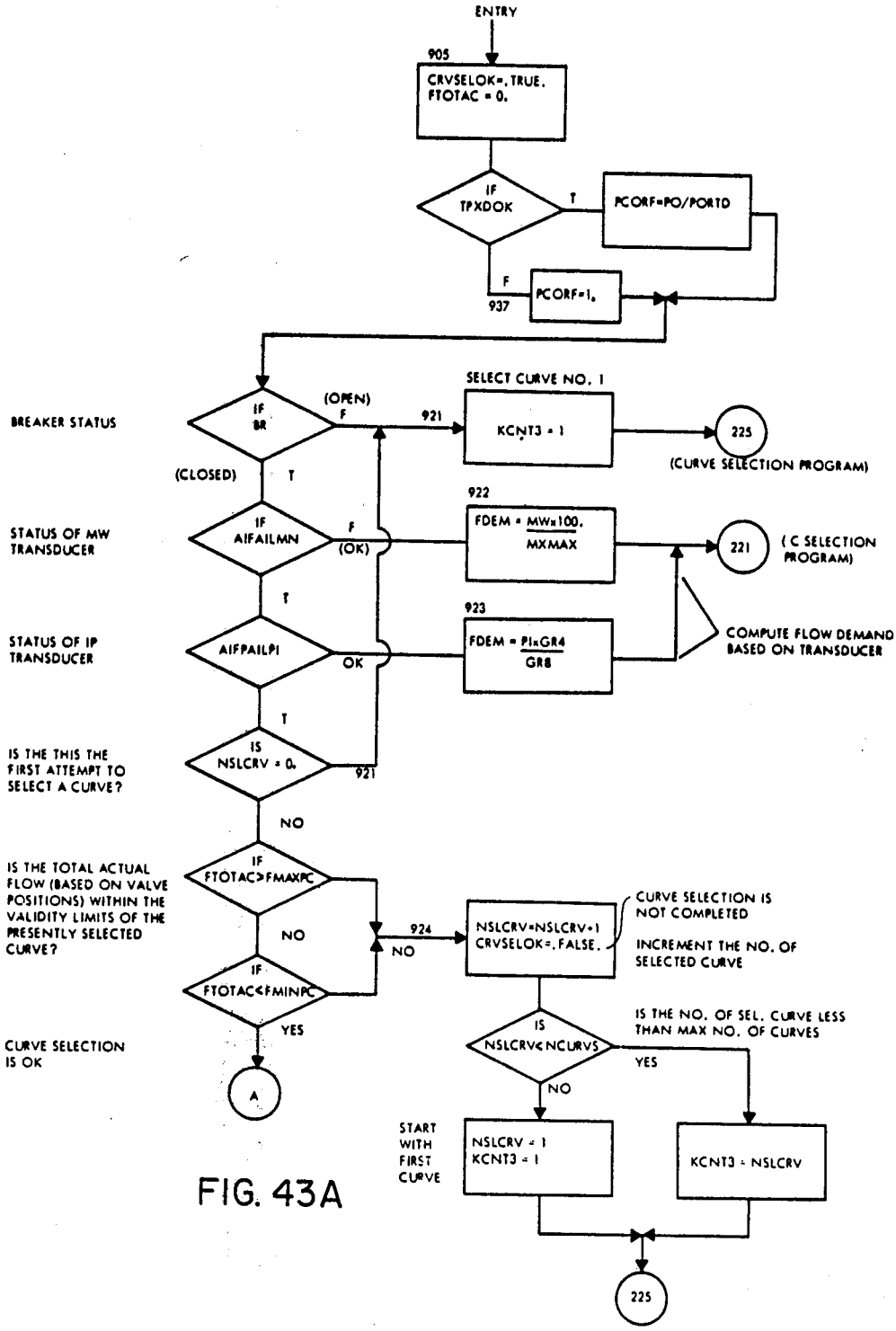
FIGS. 43A and 43B show a flow chart of the program to compute actual valve flows after a manual or emergency condition in accordance with the principles of the invention.
Figure 43B:
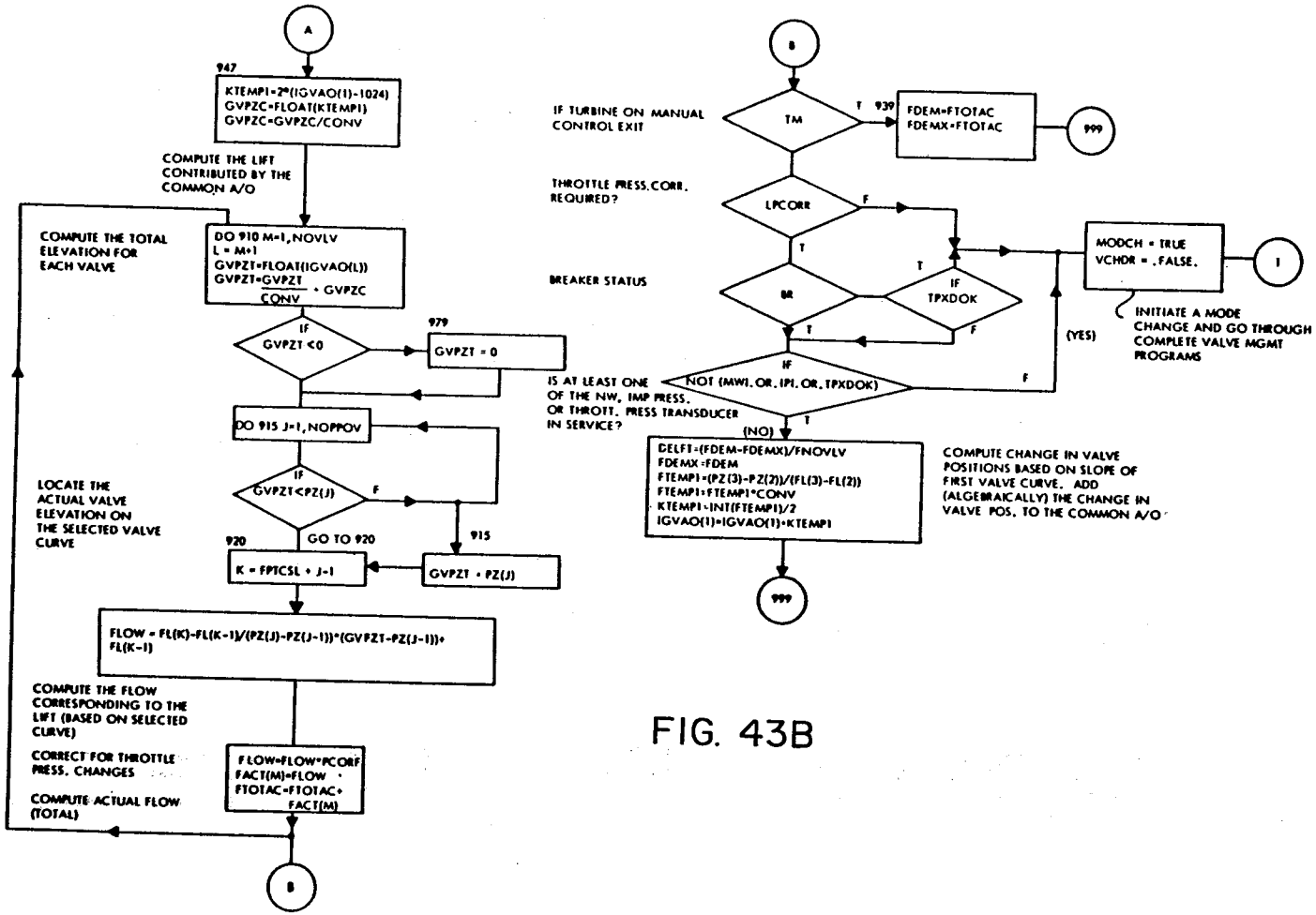

FIGS. 43A and 43B show the principle of the tracking scheme in connection with the actual curve selection of the alternate embodiment to make the reference demand speed equal to the actual speed. This equalization is accomplished by back calculating the controller output and all converted values on the basis of a back calculation of the flow demand made by the valve management program from the actual valve positions as shown in FIG. 43B. The tracking function is accomplished by this back calculation which is made to calculate the flow demand if the program is on governor valve control. The valve management program using the manual turbine logic restricts itself to this back calculation. In either the preferred embodiment where the flow vs. valve curves are calculated instead of selected as previously described; or in the embodiment where the valve curve is selected the slightly modified program of FIG. 31 and the program of FIGS. 43A and 43B can be utilized.

In order to reduce the number of cycles of computer time required by the valve management program to compute or select the proper valve curve of the alternate embodiment, the control program gives the valve management program a total flow demand equal to the actual megawatt demand over the minimum number of megawatts capable of being produced. During governor control valve operation of the turbine system, the ratio of the actual megawatt to the maximum megawatts is utilized. In throttle valve operation, however, the flow demand is set equal to the throttle valve analog output signal. The analog output signal for the throttle valve operation as well as the analog output signals for the governor valve operation have been set equal to the manual counterparts by the control programs.

The following is a list of definitions of the symbols used in the various flow charts which are provided to give a detailed understanding of the steps of the program referred to herein. The reference numerals associated with the various paths and blocks of the flow charts are included in such flow charts as well as legends so that the various functions can be followed within the chart or from one chart to another.

The entire contents of Ser. No. 306,752, entitled "System and Method Employing Valve Management for Operating a Steam Turbine", filed by Leaman Podolsky and Theodore C. Giras on Nov. 15, 1972 and assigned to the present assignee is incorporated by reference herein.

DEH COMMON DICTIONARY

| NAME | TYPE | CORE LOC. | KEYBOARD ADR. | FUNCTION |
|---|---|---|---|---|
| | | KAPPA VALVE MANAGEMENT VARIABLES | | |
| SING | L | 1450 | 1721 | SINGLE VALVE OPERATION |
| SINGX | L | 1451 | 1722 | PREVIOUS STATE OF SING |
| SEQ | L | 1452 | 1723 | SEQUENTIAL VALVE OPERATION |
| SEQX | L | 1453 | 1724 | PREVIOUS STATE OF SEQ |
| MODCH | L | 1454 | 1725 | MODE CHANGE |
| MODCHX | L | 1455 | 1726 | PREVIOUS STATE OF MODCH |
| TRFPG | L | 1456 | 1727 | TRANSFER IN PROGRESS |
| TRFPGX | L | 1457 | 1728 | PREVIOUS STATE OF TRFPG |
| TPXDBK | L. | 1458 | 1729 | PRESSURE TRANSDUCER O.K. |
| LPCORR | L | 1459 | 1730 | LOGICAL VALUE OF FLPCORR |
| VCHDR | L | 145A | 1731 | FLAG INDICATES AUTO TRACKS MANUAL |
| SINGLV | L | 145B | 1732 | SINGLE VALVE MODE |
| VT | L | 145C | 1733 | VALVE TEST |
| CRVSELBK | L | 145D | 1734 | CORRECT CURVE SELECTED IN TRACKING |
| TEMPLOG | L | 145E | 1735 | TRACKING COMPLETED |
| HISLOPE | L | 145F | 1736 | FLAGS ALL VALVES ARE FULLY OPEN |
| HYST | L | 1460 | 1737 | FLAGS CURRENT SEQUENCE IS IN OVERLAP STATE |

DEH COMMON DICTIONARY

| NAME | TYPE | | CORE LOC. | KEYBOARD ADR. | FUNCTION |
|---|---|---|---|---|---|
| | | | | | KAPPA VALVE MANAGEMENT VARIABLES |
| NUCLININ | L | * | 1461 | 1738 | NUCLEAR IN LINE |
| SINGEND | L | * | 1462 | 1739 | SINGLE ENDED STEAM CHEST |
| STOPVLVS | L | * | 1463 | 1740 | STOP VALVES |
| VTTRACK | L | | 1464 | 1741 | VALVE TEST TRACK |
| REFAO | L | * | 1465 | 1742 | REFERENCE ANALOG OUTPUT OPTION |
| FRQAO | L | * | 1466 | 1743 | FREQUENCY BIAS ANALOG OUTPUT OPTION |
| FIXTPSP | L | * | 1467 | 1744 | FIXED THROTTLE PRESSURE SETPOINT |
| | L | | 1468 | 1745 | SPARE |
| ICRSLN | I | | 1469 | 2746 | NO. OF ITERATIONS PRIOR TO TRACKING COMPLETE |
| NSLCRV | I | | 146A | 2747 | NO. OF SELECTED CURVES |
| IGVAO(1) | I | | 146B | 2748 | GV COMMON A/O |
| IGVAO(2) | I | | 146C | 2749 | GV1 SEQ A/O |
| IGVAO(3) | I | | 146D | 2750 | GV2 SEQ A/O |
| IGVAO(4) | I | | 146E | 2751 | GV3 SEQ A/O |
| IGVAO(5) | I | | 146F | 2752 | GV4 SEQ A/O |
| IGVAO(6) | I | | 1470 | 2753 | GV5 SEQ A/O |
| IGVAO(7) | I | | 1471 | 2754 | GV6 SEQ A/O |
| IGVAO(8) | I | | 1472 | 2755 | GV7 SEQ A/O |
| IGVAO(9) | I | | 1473 | 2756 | GV8 SEQ A/O |
| IGVAO(10) | I | | 1474 | 2757 | TV COMMON A/O |
| NOVLV | I | * | 1475 | 2758 | NO. OF GV'S |
| NTV | I | * | 1476 | 2759 | NO. OF TV'S |
| NDIVS | I | * | 1477 | 2760 | MAX. DECREMENT FROM SEQ. A/O TO COMMON A/O |
| NDIV | I | * | 1478 | 2761 | MAX. DECREMENT FROM COMMON A/O TO SEQ. A/O |
| ICOMLS(1) | I | * | 1479 | 2762 | GV OPENING 1ST |
| ICOMLS(2) | I | * | 147A | 2763 | GV OPENING 2ND |
| ICOMLS(3) | I | * | 147B | 2764 | GV OPENING 3RD |
| ICOMLS(4) | I | * | 147C | 2765 | GV OPENING 4TH |
| ICOMLS(5) | I | * | 147D | 2766 | GV OPENING 5TH |
| ICOMLS(6) | I | * | 147E | 2767 | GV OPENING 6TH |
| ICOMLS(7) | I | * | 147F | 2768 | GV OPENING 7TH |
| ICOMLS(8) | I | * | 1480 | 2769 | GV OPENING 8TH |
| NOPPCV | I | * | 1481 | 2770 | NO. OF POINTS PER GOV. VALVE CURVE |
| FPTCSL | I | * | 1482 | 2771 | FIRST POINT OF SELECTED CURVE |
| LPTCSL | I | * | 1483 | 2772 | LAST POINT OF SELECTED CURVE |
| NOSEQ | I | * | 1484 | 2773 | NO. OF SEQUENCES |
| SEQT(1) | I | * | 1485 | 2774 | NO. OF VALVES IN SEQ. 1 |
| SEQT(2) | I | * | 1486 | 2775 | NO. OF VALVES IN SEQ. 2 |
| SEQT(3) | I | * | 1487 | 2776 | NO. OF VALVES IN SEQ. 3 |
| SEQT(4) | I | * | 1488 | 2777 | NO. OF VALVES IN SEQ. 4 |
| SEQT(5) | I | * | 1489 | 2778 | NO. OF VALVES IN SEQ. 5 |
| SEQT(6) | I | * | 148A | 2779 | NO. OF VALVES IN SEQ. 6 |
| ICOTLR | I | * | 148B | 2780 | TOLERANCE FOR TRANSFER SINGLE TO SEQ. A/O |
| NPSTRT | I | * | 148C | 2781 | NO. OF FIRST POINT ON VLV CURVE FOR FLOWEF COR |
| NOFCFP | I | * | 148D | 2782 | NO. OF POINTS FOR FLOW COEF. CURVE |
| INTRIES | I | * | 148E | 2783 | NO. OF ITERATIONS PER TRACKING |
| ITYPTEST | I | | 148F | 2784 | TYPE OF VALVETEST |
| ITESTPAT(1) | I | * | 1490 | 2785 | BIT ON CCO WORD FOR TV1 OR SV1 |
| ITESTPAT(2) | I | * | 1491 | 2786 | BIT ON CCO WORD FOR TV2 OR SV2 |
| ITESTPAT(3) | I | * | 1492 | 2787 | BIT ON CCO WORD FOR TV3 OR SV3 |
| ITESTPAT(4) | I | * | 1493 | 2788 | BIT ON CCO WORD FOR TV4 OR SV4 |
| ITESTPAT(5) | I | * | 1494 | 2789 | BIT ON CCO WORD FOR GV1 |
| ITESTPAT(6) | I | * | 1495 | 2790 | BIT ON CCO WORD FOR GV2 |
| ITESTPAT(7) | I | * | 1496 | 2791 | BIT ON CCO WORD FOR GV3 |
| ITESTPAT(8) | I | * | 1497 | 2792 | BIT ON CCO WORD FOR GV4 |
| ITESTPAT(9) | I | * | 1498 | 2793 | BIT ON CCO WORD FOR GV5 OR BV1 |
| ITESTPAT(10) | I | * | 1499 | 2794 | BIT ON CCO WORD FOR GV6 OR BV2 |
| ITESTPAT(11) | I | * | 149A | 2795 | BIT ON CCO WORD FOR GV7 OR BV3 |
| ITESTPAT(12) | I | * | 149B | 2796 | BIT ON CCO WORD FOR GV8 |
| ITESTPAT(13) | I | * | 149C | 2797 | BIT ON CCO WORD FOR GV1 + GV3 + GV5 + GV7 |
| ITESTPAT(14) | I | * | 149D | 2798 | BIT ON CCO WORD FOR GV2 + GV4 + GV6 + GV8 |
| ITVDB | I | * | 149E | 2799 | THROTTLE VALVE DEADBAND FOR CONTINGENCY CHECK |
| IGVDB | I | * | 149F | 2800 | GOVERNOR VALVE DEADBAND FOR CONTINGENCY CHECK |

DEH COMMON DICTIONARY

| NAME | TYPE | CORE LOC. | KEYBOARD ADR. | FUNCTION |
|---|---|---|---|---|
| | | KAPPA VALVE MANAGEMENT VARIABLES | | |
| NOCONV | I * | 14A0 | 2801 | NO. OF A/I BIT PATTERNS CONVERTED TO ENG. UNITS |
| SPREF | I * | 14A1 | 2802 | VARIABLE USED IN THE SPEED CHAN INT #2 PROGRAM |
| SPREF2 | I * | 14A2 | 2803 | RESET VALUE FOR RK REGISTER CARD |
| NWR | I * | 14A3 | 2804 | *8913(WR*3600); *8533(WR*1800) |
| IGVDB1 | I * | 14A4 | 2805 | GOV VALVE DEADBAND FOR CONTINGENCY CHECK |
| | I | 14A5 | 2806 | SPARE |
| | I | 14A6 | 2807 | SPARE |
| | I | 14A7 | 2808 | SPARE |
| PDBND | R * | 14A8 | 3405 | PRESSURE DEADBAND |
| MXPDEV | R * | 14AA | 3406 | MAX-THROTT-PRESS-CORRECTION PER ITERATION |
| FTOLRM | R * | 14AC | 3407 | FLOWCHANGE DEADBAND DURING MODE CHANGE |
| FTOLRF | R * | 14AE | 3408 | FLOWCHANGE DEADBAND IF NO MODE CHANGE |
| MXFPCH | R * | 14B0 | 3409 | MAX FLOW CHANGE PER ITERATION |
| FC | R * | 14B2 | 3410 | UPPER BREAK POINT OF VALVE CURVE |
| FA | R * | 14B4 | 3411 | LOWER BREAK POINT OF VALVE CURVE |
| FDEM | R | 14B6 | 4412 | FLOW DEMAND |
| FASUM | R | 14B8 | 4413 | FLOW ASSUMED,STARTING VALUE IN TM |
| ERRMIN | R | 14BA | 4414 | MINIMUM ERROR |
| PDBNDL | R * | 14BC | 3415 | PRESSURE DEADBAND FOR PRESSURE CORRECTION LOW |
| PDBNDH | R * | 14BE | 3416 | PRESSURE DEADBAND FOR PRESSURE CORRECTION HIGH |
| POLAST | R | 14C0 | 4417 | LAST VALUE OF THROTTLE PRESSURE |
| XSP | R * | 14C2 | 3418 | *1. (WR*3600); *2.(WR*1800) |
| TNONOZ | R * | 14C4 | 3419 | TYP. NO OF NOZZLES PER GV |
| FNOVLV | R * | 14C6 | 3420 | NO. OF GOV VALVES |
| FTOLR | R | 14C8 | 3421 | DEADBAND FOR FLOW CHANGES |
| VMAX | R * | 14CA | 3422 | MAXIMUM VALVE POSITION |
| FX | R * | 14CC | 3423 | CORRECT CURVES FOR INEQUAL NO. OF NOZZLES |
| CONV | R * | 14CE | 3424 | CONVERSION FACTOR BINARY A/D TO INCHES |
| FL(1) | R | 14D0 | 3425 | FLOW TABLE |
| FL(2) | R | 14D2 | 3426 | FLOW TABLE |
| FL(3) | R | 14D4 | 3427 | FLOW TABLE |
| FL(4) | R | 14D6 | 3428 | FLOW TABLE |
| FL(5) | R | 14D8 | 3429 | FLOW TABLE |
| FL(6) | R | 14DA | 3430 | FLOW TABLE |
| FL(7) | R | 14DC | 3431 | FLOW TABLE |
| PZ(1) | R * | 14DE | 3432 | POSITION TABLE |
| PZ(2) | R * | 14E0 | 3433 | POSITION TABLE |
| PZ(3) | R * | 14E2 | 3434 | POSITION TABLE |
| PZ(4) | R * | 14E4 | 3435 | POSITION TABLE |
| PZ(5) | R * | 14E6 | 3436 | POSITION TABLE |
| PZ(6) | R * | 14E8 | 3437 | POSITION TABLE |
| PZ(7) | R * | 14EA | 3438 | POSITION TABLE |
| PCORF | R | 14EC | 3439 | THROTTLE PRESSURE CORRECTION FACTOR |
| FACTS(1) | R | 14EE | 3440 | ACTUAL FLOW FOR SEQ. NO. 1 |
| FACTS(2) | R | 14F0 | 3441 | ACTUAL FLOW FOR SEQ. NO. 2 |
| FACTS(3) | R | 14F2 | 3442 | ACTUAL FLOW FOR SEQ. NO. 3 |
| FACTS(4) | R | 14F4 | 3443 | ACTUAL FLOW FOR SEQ. NO. 4 |
| FACTS(5) | R | 14F6 | 3444 | ACTUAL FLOW FOR SEQ. NO. 5 |
| FACTS(6) | R | 14F8 | 3445 | ACTUAL FLOW FOR SEQ. NO. 6 |
| FACTS(7) | R | 14FA | 3446 | ACTUAL FLOW FOR SEQ. NO. 7 |
| FACTS(8) | R | 14FC | 3447 | ACTUAL FLOW FOR SEQ. NO. 8 |
| NONOZ(1) | R * | 14FE | 3448 | NO. OF NOZZLE FOR GV 1 |
| NONOZ(2) | R * | 1500 | 3449 | NO. OF NOZZLE FOR GV 2 |
| NONOZ(3) | R * | 1502 | 3450 | NO. OF NOZZLE FOR GV 3 |
| NONOZ(4) | R * | 1504 | 3451 | NO. OF NOZZLE FOR GV 4 |
| NONOZ(5) | R * | 1506 | 3452 | NO. OF NOZZLE FOR GV 5 |
| NONOZ(6) | R * | 1508 | 3453 | NO. OF NOZZLE FOR GV 6 |
| NONOZ(7) | R * | 150A | 3454 | NO. OF NOZZLE FOR GV 7 |
| NONOZ(8) | R * | 150C | 3455 | NO. OF NOZZLE FOR GV 8 |
| FDCF(1) | R * | 150E | 3456 | FLOW TABLE FOR FLOW COEFFICIENT |
| FDCF(2) | R * | 1510 | 3457 | FLOW TABLE FOR FLOW COEFFICIENT |
| FDCF(3) | R * | 1512 | 3458 | FLOW TABLE FOR FLOW COEFFICIENT |
| FDCF(4) | R * | 1514 | 3459 | FLOW TABLE FOR FLOW COEFFICIENT |

DEH COMMON DICTIONARY

| NAME | TYPE | CORE LOC. | KEYBOARD ADR. | FUNCTION |
|---|---|---|---|---|
| | | | | KAPPA VALVE MANAGEMENT VARIABLES |
| FDCF(5) | R * | 1516 | 3460 | FLOW TABLE FOR FLOW COEFFICIENT |
| FDCF(6) | R * | 1518 | 3461 | FLOW TABLE FOR FLOW COEFFICIENT |
| FDCF(7) | R * | 151A | 3462 | FLOW TABLE FOR FLOW COEFFICIENT |
| FTOLRFLO | R * | 151C | 3463 | LOW FLOW TOLERANCE |
| FTOLRFHI | R * | 151E | 3464 | HIGH FLOW TOLERANCE |
| FWMXB | R * | 1520 | 3465 | MAX POSSIBLE FLOW THRU ONE GV |
| FMINAS | R * | 1522 | 3466 | USED TO INITIALIZE FASUM AFTER COMP. RESTART |
| FINCR | R * | 1524 | 3467 | FLOW INCREMENT FOR TRACKING |
| TRCTOLR | R * | 1526 | 3468 | FLOW TOLERANCE FOR TRACKING |
| COEF(1) | R * | 1528 | 3469 | TABLE FOR FLOW COEFFICIENT CURVE |
| COEF(2) | R * | 152A | 3470 | TABLE FOR FLOW COEFFICIENT CURVE |
| COEF(3) | R * | 152C | 3471 | TABLE FOR FLOW COEFFICIENT CURVE |
| COEF(4) | R * | 152E | 3472 | TABLE FOR FLOW COEFFICIENT CURVE |
| COEF(5) | R * | 1530 | 3473 | TABLE FOR FLOW COEFFICIENT CURVE |
| COEF(6) | R * | 1532 | 3474 | TABLE FOR FLOW COEFFICIENT CURVE |
| COEF(7) | R * | 1534 | 3475 | TABLE FOR FLOW COEFFICIENT CURVE |
| FLIN(1) | R * | 1536 | 3476 | VALVE CURVE FOR FLOW=COEF *MAX (FLOW) |
| FLIN(2) | R * | 1538 | 3477 | VALVE CURVE FOR FLOW=COEF *MAX (FLOW) |
| FLIN(3) | R * | 153A | 3478 | VALVE CURVE FOR FLOW=COEF *MAX (FLOW) |
| FLIN(4) | R * | 153C | 3479 | VALVE CURVE FOR FLOW=COEF *MAX (FLOW) |
| FLIN(5) | R * | 153E | 3480 | VALVE CURVE FOR FLOW=COEF *MAX (FLOW) |
| FLIN(6) | R * | 1540 | 3481 | VALVE CURVE FOR FLOW=COEF *MAX (FLOW) |
| FLIN(7) | R * | 1542 | 3482 | VALVE CURVE FOR FLOW=COEF *MAX (FLOW) |
| PZI(1) | R * | 1544 | 3483 | VALVE CURVE FOR FLOW=COEF**MAX* (POSITION) |
| PZI(2) | R * | 1546 | 3484 | VALVE CURVE FOR FLOW=COEF**MAX* (POSITION) |
| PZI(3) | R * | 1548 | 3485 | VALVE CURVE FOR FLOW=COEF**MAX* (POSITION) |
| PZI(4) | R * | 154A | 3486 | VALVE CURVE FOR FLOW=COEF**MAX* (POSITION) |
| PZI(5) | R * | 154C | 3487 | VALVE CURVE FOR FLOW=COEF**MAX* (POSITION) |
| PZI(6) | R * | 154E | 3488 | VALVE CURVE FOR FLOW=COEF**MAX* (POSITION) |
| PZI(7) | R * | 1550 | 3489 | VALVE CURVE FOR FLOW=COEF**MAX* (POSITION) |
| FLOWCHNG | R * | 1552 | 3490 | FLOW DEMAND CHANGE FOR CONTINGENCY CHECK |
| | R | 1554 | 3491 | SPARE |
| | R | 1556 | 3492 | SPARE |
| | R | 1558 | 3493 | SPARE |
| | R | 155A | 3494 | SPARE |
| | R | 155C | 3495 | SPARE |
| | R | 155E | 3496 | SPARE |
| | R | 1560 | 3497 | SPARE |
| | R | 1562 | 3498 | SPARE |
| | R | 1564 | 3499 | SPARE |
| ATSSCAN | L * | 1566 | | ATS SCAN TRUE=YES FALSE = NO |
| ADSPULSE | L * | 1567 | | ADS INPUT PULSE TYPE TRUE=DISCRETE,FALSE=CONTIN |

INDICATES THAT THIS VARIABLE MUST BE INITIALIZED

FEED FORWARD

In summary the preferred embodiment of the present invention includes the infinitely variable dynamic function generation of flow demand versus actuator lift characteristics, which allows the use of a feedforward system without the need of feedback.

Continuous dynamic function generation provides a virtually exact, within the resolution of the calculation, prediction of the operating characteristics of the governor valves at any load and flow of steam, and continuously updates and calculates the conditions of flow and load for any value and change in both the single and sequential valve modes and during transfer between the single, sequential and manual modes.

Transfers between the single valve mode, the sequential valve mode and manual mode are accomplished by dynamic calculation of the control valve curve for a desired total flow through the turbine. First, a total flow demand is computed by the DEH program. Second, a corrected stage flow coefficient is determined for the flow demand. Third, data is generated which can be represented in curve form as total flow demand versus control valve actuator lift utilizing the corrected stage flow coefficient. Fourth, the difference between the calculated total flow demand or target flow and the initial flow demand is calculated. Fifth, the number of variations or iterations required to implement the change of positions from the actual initial flow to the target flow is computed by dividing the greatest flow change by a maximum allowable flow change per sampling period. Sixth, the flow changes for each valve are then divided by the number of iterations required to perform the change from initial to target flow. During all mode transfers the same approach is used.

In the sequential mode, the digital computer generates a system of asymmetric overlap load characteristics in order to provide stable operation. The asymmetric overlap system is provided with the continuous dynamic function generation.

The asymmetric overlap system provides for stability of operation in the upper end of the valve strokes and the opening strokes where the valve characteristics are very nonlinear, and in addition, prevents the occurrence of non-linear oscillations by decreasing their frequency well below the response frequency of the computer system.

Because of the continuous dynamic function generation of the valve characteristics, the valve management system, which is a feedforward system can operate without the use of feedback transducers from the impulse pressure, speed and load.

The valve management system may operate with feedback functions. However, one of its greatest advantages is in the capability to operate as a feedforward system without the delay which is characteristic of feedback signals which are delayed by being fed back and compared with an input signal or quantity.

Also, the present invention includes the capability for correcting for the number of nozzles connected under each control valve. The number of nozzles emitting steam into the low pressure turbine may vary because of defects which inevitably do occur in the foundry casting into which the nozzles are machined. In addition, tracking is provided with the digital computer bumplessly transferring from a manual mode to the automatic mode at limiting flow changes by iterative means thereby reducing thermal and mechanical shakes in the turbine. In the pressure correction mode, a deadband and limitation of rate change similar to integration is provided thereby reducing thermal and mechanical shakes to and accuracy and precision of the system. Upon the monitoring of specific malfunctions, the digital computer automatically transfers from the sequential valve mode to the single valve mode and other malfunctions to a manual mode. Bumpless transfer is also provided between the sequential analog output hardware and the single analog output hardware.

The functions of the digital computer, supra, could be performed on an analog computer, using operational amplifiers, diode function generators, etc. even the changes of parameters could be performed on a special potentiometer operator's panel where an operator changes the parameters of the system by operating potentiometers and/or switches, for example.

What is claimed is:

1. A control system for a turbine power plant wherein the valve lift position of each of a plurality of steam inlet valve means, each including at least one valve, is controlled to admit a selected portion of the total turbine steam flow through associated nozzle groups in accordance with a selected single or sequential mode of valve operation and the flow of steam through each of the valve means varies for a given valve lift position in accordance with the total flow of steam to the turbine, said system comprising:

means to generate an electrical representation in accordance with the total steam flow demand for the turbine;

means governed by a selected mode of operation and the total steam flow demand representation to generate an electrical representation of desired flow for each of the valve means;

calculating means including (a) means governed by the total flow demand representation to generate an electrical representation of steam flow versus valve lift position based upon the effect of pressure drop across the nozzles, (b) means governed by the electrical representation of desired flow and the generated electrical representation of steam flow versus valve lift to generate for each respective valve means an electrical representation of valve position; and means governed by the electrical representation of valve lift position to operate each of the valve means to a position repersentation corresponding to such valve lift position.

2. A system according to claim 1 wherein the calculating means is structured in a programmed digital computer.

3. A system according to claim 1 wherein the steam flow versus valve lift position representation generated by the calculating means is a selected one of a plurality of characterizations stored in the calculating means; which characterizations correspond to respective percentages of total steam flow capacity of the turbine.

4. A system according to claim 3 wherein the calculating means is structured in a programmed digital computer.

5. A system according to claim 1 wherein the calculating means further includes means to modify the steam flow versus valve position representation in accordance with a coefficient based on pressure drop.

6. A system according to claim 5 wherein the calculating means is structured in a programmed digital computer.

7. A system according to claim 1 further comprising means to detect the pressure of the steam to the turbine, and the calculating means further includes means to modify the total steam flow demand electrical representation in accordance with the detected steam pressure.

8. A system according to claim 7 wherein the calculating means is structured in a programmed digital computer.

9. A system according to claim 1 wherein the generated electrical representation of desired valve flow corresponds to a portion of the maximum flow for a respective valve means, and the calculating means further includes means governed by the number of individual nozzles associated with a respective valve means to modify the maximum flow representation.

10. A control system for a turbine power plant wherein the valve lift position for each of a plurality of steam inlet valve means is controlled to admit a selected portion of the total turbine steam flow through respective groups of nozzles in accordance with a selected single or sequential mode of valve operation and the steam flow through each of the valve means varies for a given lift position in accordance with the total flow of steam to the turbine, said system comprising means to generate an electrical representation of total steam flow demand for the turbine;

calculating means including (a) means to store an electrical representation of a valve position versus steam flow characterization, (b) means to modify the characterization representation in accordance with the variation in the generated representation of total steam flow demand, (c) means to generate for each of the valve means an electrical representation of valve position in accordance with the modified characterization representation; and means to operate the valve means in accordance with the generated representation of valve position.

11. A system according to claim 10 wherein the calculating means is structured in a programmed digital computer.

12. A system according to claim 10 wherein the characterization representation corresponds to the relationship between valve lift position and the steam flow capacity of each valve means.

13. A system according to claim 10 wherein the predetermined characterization for each valve means is modified by said modifying means in accordance with the relationship between the generated representation of total steam flow demand and the effect on valve lift position of pressure drop across the nozzles for such flow.

14. A system according to claim 10 further comprising means to sense the actual steam pressure upstream of the valve means; and the calculating means includes means to modify the generated representation of total steam flow demand in accordance with the sensed pressure.

15. A system according to claim 14 wherein the calculating means is structured in a programmed digital computer.

16. A system according to claim 14 wherein the calculating means further includes means to detect a change in the sensed steam pressure at predetermined time intervals, and includes means to modify the generated representation of total steam flow demand in accordance with a predetermined pressure change limit during each predetermined time interval until said generated representation of total steam flow demand is modified in accordance with the sensed change in steam pressure.

17. A system according to claim 16 wherein the calculating means is structured in a programmed digital computer.

18. A system according to claim 10 wherein each said valve means controls the admission of steam through a group of steam inlet nozzle groups and wherein at least one of the nozzle groups includes a number of individual nozzles different from the other nozzle groups, and said calculating means further includes means to modify the generated electrical representation of valve position for a respective valve means in accordance with the number of nozzles in said on nozzle group associated with said respective valve means.

19. A system according to claim 18 wherein the calculating means is structured in a programmed digital computer.

20. An electric power generating system, comprising a high pressure turbine having a plurality of arcuately spaced nozzle groups to admit steam past at least one row of turbine blades to a common impulse chamber;

an electric generator rotatable by said turbine and adapted to be connected to an electrical load;

a plurality of steam inlet valve means each of which controls a portion of the total steam flow through a respective nozzle group in accordance with a selected single or sequential mode of valve operation;

means connecting the steam inlet valves to a steam source;

means to generate an electrical representation of position for each of the plurality of steam inlet valves;

means to generate a representation of electrical load demand for the generator, calculating means including (a) means to vary each generated valve position representation in accordance with a predetermined characterization based on steam flow versus valve position, (b) means to modify the predetermined characterization as the load demand representation varies; and valve control means to operate each of the valves to a position corresponding to its generated representation of valve position.

21. A system according to claim 20 wherein the calculating means is structured in a programmed digital computer.

22. An electric power generating system according to claim 20 wherein the means to modify the predetermined characterization for each of the valves is governed by the relationship between the generated load demand representation and load capacity of the steam turbine to reflect the effect on the flow of steam through the valves of pressure drop across the nozzles.

23. An electric power generating system according to claim 20 further comprising, means to detect an actual change in pressure of the steam; and wherein the calculating means includes means to modify the characterization of steam flow versus valve position repetitively at spaced time intervals, means to further modify the load demand representation in accordance with a predetermined maximum and minimum detected pressure during each said spaced time interval.

24. A system according to claim 23 wherein the calculating means is structured in a programmed digital computer.

25. An electric power generating system according to claim 20 wherein at least one of the associated group of nozzles for a respective valve includes a different number of nozzles; and the calculating means further includes means to modify a respective valve position representation in accordance with the number of nozzles in said associated group.

* * * * *